US007844191B2

(12) United States Patent
Endou et al.

(10) Patent No.: US 7,844,191 B2
(45) Date of Patent: Nov. 30, 2010

(54) IMAGE FORMING APPARATUS AND IMAGE FORMING METHOD PERFORMED BY THE IMAGE FORMING APPARATUS

(75) Inventors: Osamu Endou, Yokohama (JP); Atsushi Tano, Kawasaki (JP)

(73) Assignee: Ricoh Company Limited, Tokyo (JP)

( * ) Notice: Subject to any disclaimer, the term of this patent is extended or adjusted under 35 U.S.C. 154(b) by 141 days.

(21) Appl. No.: 12/163,012

(22) Filed: Jun. 27, 2008

(65) Prior Publication Data

US 2009/0003865 A1 Jan. 1, 2009

(30) Foreign Application Priority Data

Jun. 28, 2007 (JP) ..... 2007-170119

(51) Int. Cl.
*G03G 15/08* (2006.01)
*G03G 15/16* (2006.01)
*G03G 21/10* (2006.01)

(52) U.S. Cl. ..... 399/66; 399/101; 399/257; 399/359

(58) Field of Classification Search ..... 399/66, 399/71, 101, 257, 302, 359
See application file for complete search history.

(56) References Cited

U.S. PATENT DOCUMENTS 5,606,408 A 2/1997 Yano et al. ..... 399/343
5,740,494 A 4/1998 Shoji et al. ..... 399/71
5,955,228 A 9/1999 Sakai et al. ..... 430/53
7,095,966 B2 * 8/2006 Adachi ..... 399/257 X
7,567,765 B2 * 7/2009 Chiba ..... 399/66
2006/0056884 A1 3/2006 Sawai et al. ..... 399/302
2008/0124112 A1 * 5/2008 Soma et al. ..... 399/71
2008/0240764 A1 * 10/2008 Yamane ..... 399/71

FOREIGN PATENT DOCUMENTS

JP 3553817 B2 5/2004
JP 2007-147782 A * 6/2007
JP 2007-248559 A * 9/2007

* cited by examiner

*Primary Examiner*—Sophia S Chen
(74) *Attorney, Agent, or Firm*—Oblon, Spivak, McClelland, Maier & Neustadt, L.L.P.

(57) ABSTRACT

An image forming apparatus, in which an image forming method is performed, includes an image carrier, an optical writing unit, a developing unit developing a toner image including an output image and a forcible toner consumption image, a transfer unit including an endless moving member to transfer the toner image onto the endless moving member directly or a recording medium carried on the endless moving member, a first remover to remove residual toner from the image carrier after transfer, a toner recycling unit to convey the residual toner to the developing unit, a controller to form the forcible toner consumption image and transfer the forcible toner consumption image onto the surface of the endless moving member, and a second remover to remove the forcible toner consumption image from the endless moving member.

15 Claims, 20 Drawing Sheets

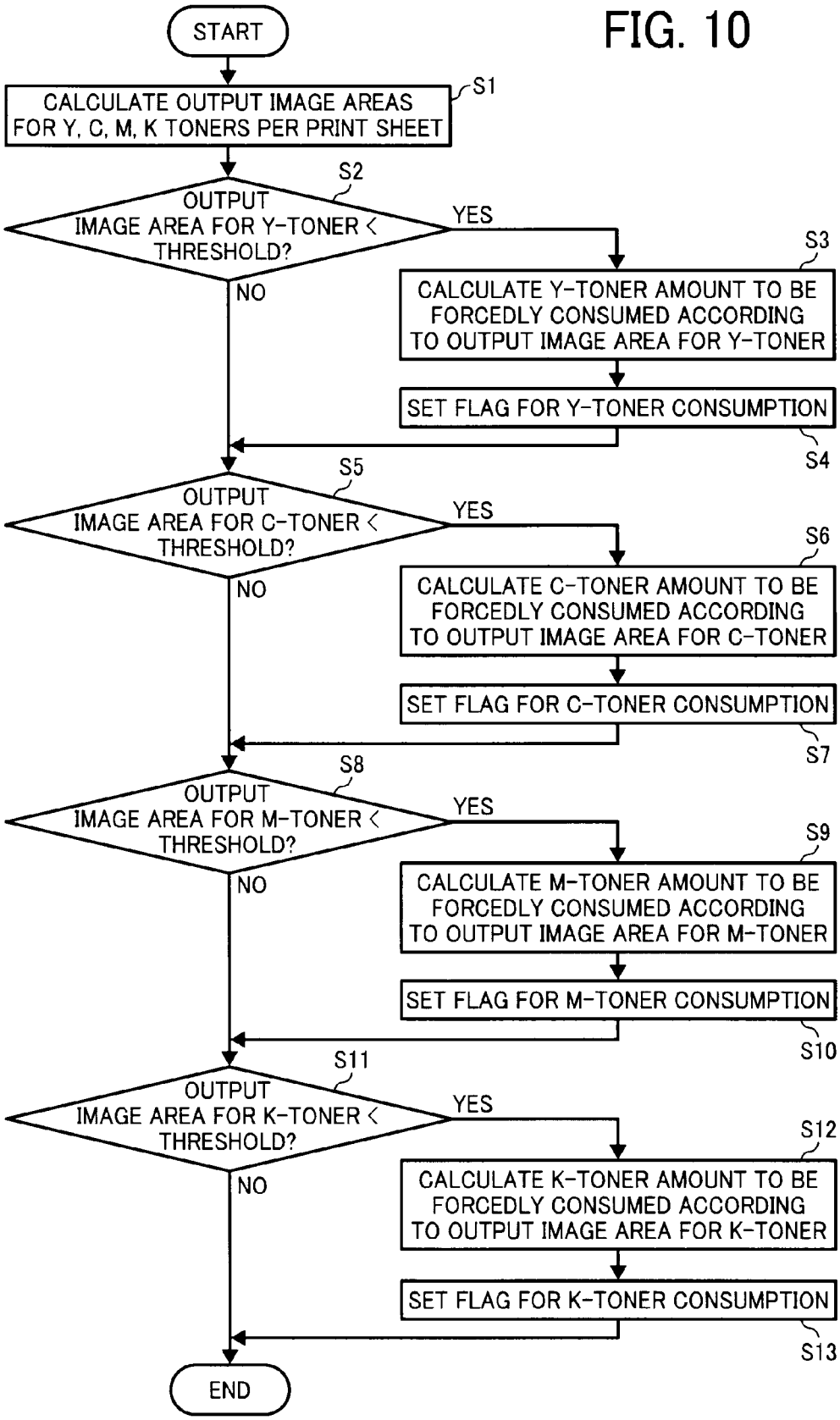
FIG. 10
START
CALCULATE OUTPUT IMAGE AREAS FOR Y, C, M, K TONERS PER PRINT SHEET
S1
S2
OUTPUT IMAGE AREA FOR Y-TONER < THRESHOLD?
YES
NO
S3
CALCULATE Y-TONER AMOUNT TO BE FORCEDLY CONSUMED ACCORDING TO OUTPUT IMAGE AREA FOR Y-TONER
SET FLAG FOR Y-TONER CONSUMPTION
S4
S5
OUTPUT IMAGE AREA FOR C-TONER < THRESHOLD?
YES
NO
S6
CALCULATE C-TONER AMOUNT TO BE FORCEDLY CONSUMED ACCORDING TO OUTPUT IMAGE AREA FOR C-TONER
SET FLAG FOR C-TONER CONSUMPTION
S7
S8
OUTPUT IMAGE AREA FOR M-TONER < THRESHOLD?
YES
NO
S9
CALCULATE M-TONER AMOUNT TO BE FORCEDLY CONSUMED ACCORDING TO OUTPUT IMAGE AREA FOR M-TONER
SET FLAG FOR M-TONER CONSUMPTION
S10
S11
OUTPUT IMAGE AREA FOR K-TONER < THRESHOLD?
YES
NO
S12
CALCULATE K-TONER AMOUNT TO BE FORCEDLY CONSUMED ACCORDING TO OUTPUT IMAGE AREA FOR K-TONER
SET FLAG FOR K-TONER CONSUMPTION
S13
END

IMAGE FORMING APPARATUS AND IMAGE FORMING METHOD PERFORMED BY THE IMAGE FORMING APPARATUS

CROSS-REFERENCE TO RELATED APPLICATIONS

The present patent application claims priority under 35 U.S.C. §119 from Japanese Patent Application No. 2007-170119, filed on Jun. 28, 2007 in the Japan Patent Office, the contents and disclosure of which are hereby incorporated by reference herein in their entirety.

BACKGROUND OF THE INVENTION

1. Field of the Invention

Exemplary embodiments of the present invention generally relate to an image forming apparatus and an image forming method performed by the image forming apparatus, and more particularly, to an image forming apparatus that forms a forcible toner consumption image on an image carrier when necessary to forcibly consume toner contained in developer contained in a developing unit, and an image forming method performed by the image forming apparatus.

2. Discussion of the Related Art

Related-art image forming apparatuses such as copiers, facsimile machines, and printers include a developing unit for containing developers used to develop a latent image formed on an image carrier such as a photoconductor into a toner image.

One known image forming apparatus employs a two-component developer that includes toner and magnetic carrier particles to convey the developer held on a developer carrier such as a developing roller to a development region located opposite the image carrier and transfer toner contained in the developer from a surface of the carrier onto the latent image formed on the image carrier, thereby developing the latent image into the toner image. The developer carrier conveys the magnetic carrier particles from the development region and returns them to the developing unit for reuse. The developers contained in the developing unit may be agitated while being supplied as appropriate, so that a toner concentration is maintained within a prescribed range.

However, if a known image forming apparatus having such developing unit frequently produces an image having a low image area, the developing unit may be run for a rather long period of time without consuming an appropriate amount of toner. As a result, the toner may be agitated excessively in the developing unit, which can degrade the toner. When the degraded toner is thus stressed, additives that are externally added to the surfaces of toner particles to adjust flowability and chargeability become separated from or embedded in the toner particles, thereby degrading the function thereof. Such degraded toners may contaminate a background part or non-image forming part on a surface of a recording medium, degrade development ability and transfer efficiency, etc., which can cause degradation of the quality of images such as contamination, degradation of image density, degradation of granularity, etc.

One approach to solving this problem is to provide an image forming apparatus that can calculate an output image area per unit of time based on an area of an output image. When a result of calculation is below a given threshold or when the toner contained in the developing unit is excessively agitated, the image forming apparatus forms a forcible toner consumption image to forcibly consume toner excessively agitated in the developing unit. When it is determined based on the area of the output image that the toner has been excessively agitated, the image forming apparatus may form the forcible toner consumption image to forcibly consume such toner.

However, in order to reduce costs, a known image forming apparatus adopting this approach is also designed to recycle the remaining toner. That is, after a toner image is transferred onto a recording medium or an intermediate transfer member, at least a small amount of residual toner remains on the surface of the image carrier. Such residual toner is then removed from the surface of the image carrier by a residual toner removal unit since, if the residual toner is discarded, unnecessary toner consumption may be conducted. Therefore, the remaining toner may be returned to the developing unit for recycling.

The above-described configuration, however, cannot sufficiently prevent accumulation of degraded toner particles in the developing unit because even though the toner particles excessively agitated in the developing unit are discharged from the developing unit by the formation of the forcible toner consumption image, the residual toner removal unit may still remove the forcible toner consumption image from the surface of the image carrier and returns the excessively agitated toner into the developing unit. Thus, the excessively agitated toner particles may continue to accumulate in the developing unit, defeating the purpose of employing the forcible toner consumption image in the first place.

Therefore, there is still a need for an image forming apparatus that can both effectively reduce the costs of toner usage by recycling residual toner remaining on the surface of the image carrier even after image transfer to a recording medium or an intermediate transfer member, as well as effectively suppress or prevent the quality of formed images from deteriorating due to accumulation of the degraded toner in the developing unit.

SUMMARY OF THE INVENTION

Exemplary aspects of the present invention have been made in view of the above-described circumstances.

Exemplary aspects of the present invention provide an image forming apparatus that can effectively reduce costs on toner usage by recycling residual toner remaining on a surface of an image carrier even after image transfer to a recording medium or an intermediate transfer member and that can effectively suppress or prevent quality of image from degrading due to accumulation of deteriorated toner in a developing unit.

Other exemplary aspects of the present invention provide an image forming apparatus that can effectively suppress or prevent quality of image from degrading due to accumulation of deteriorated toner in a developing unit.

Other exemplary aspects of the present invention provide an image forming method that can perform in the above-described image forming apparatuses.

In one exemplary embodiment, an image forming apparatus includes an image carrier configured to carry a latent image on a surface thereof, an optical writing unit configured to optically write the latent image on the surface of the image carrier, a developing unit configured to develop with toner the latent image into a toner image including an output image and a forcible toner consumption image, a transfer unit including an endless moving member, the transfer unit configured to transfer the toner image onto either a surface of the endless moving member directly or a recording medium carried on the surface of the endless moving member, a first remover configured to remove residual toner remaining on the surface of the image carrier after the toner image is transferred by the transfer unit, a toner recycling unit configured to convey the residual toner to the developing unit for recycling, a controller configured to form the forcible toner consumption image on the image carrier at a given timing and transfer the forcible toner consumption image onto the surface of the endless moving member, and a second remover configured to remove the forcible toner consumption image from the surface of the endless moving member.

The above-described image forming apparatus may further include a contact member configured to contact the surface of the endless moving member to form a transfer nip, and the transfer unit may transfer the output image produced based on image data onto the surface of the endless moving member and then onto the recording medium sandwiched between the contact member and the endless moving member at the transfer nip.

The above-described image forming apparatus may further include a contact and separation unit configured to separate the contact member from the endless moving member when the forcible toner consumption image formed on the surface of the endless moving member passes the transfer nip.

The above-described image forming apparatus may further include an electrical field generator configured to generate a given electrical field in the transfer nip formed between the image carrier and the endless moving member. The given electrical field may include a first electrical field to electrostatically move the toner from the surface of the endless moving member to the contact member when the output image transferred onto the endless moving member passes the transfer nip, and a second electrical field to electrostatically move the toner from the contact member to the surface of the endless moving member when the forcible toner consumption image transferred onto the endless moving member passes the transfer nip.

Further, in one exemplary embodiment, an image forming apparatus includes an image carrier configured to carry a latent image on a surface thereof, an optical writing unit configured to optically write the latent image on the surface of the image carrier, a developing unit configured to develop with toner the latent image into a toner image including an output image and a forcible toner consumption image, a moving member including either a first moving member configured to receive the toner image from the image carrier and hold the toner image on a surface thereof or a second moving member configured to carry a recording medium on a surface thereof to receive the toner image from the image carrier on the surface thereof, a transfer unit, a remover, a toner recycling unit configured to convey the residual toner to the developing unit for recycling, and a controller configured to form the forcible toner consumption image on the image carrier at a given timing. The transfer unit transfers the toner image to the moving member while forming a given electrical field in a secondary transfer nip formed between the image carrier and the moving member. The given electrical field includes a first electrical field for providing an electrostatic force from the image carrier to the moving member with respect to the toner charged with a given polarity, negative or positive, when the output image based on the image data is transferred from the surface of the image carrier onto either the first moving member or the recording medium carried by the second moving member, and a second electrical field between the image carrier and the moving member for providing an electrostatic force from the image carrier to the moving member with respect to the toner charged with a polarity opposite to the given polarity when the forcible toner consumption image is transferred from the surface of the image carrier onto either the first moving member or the recording medium carried by the second moving member. The remover removes residual toner remaining on the surface of the image carrier after the toner image is transferred by the transfer unit, and removes the toner from the surface of the moving member after the moving member passes the transfer unit.

The transfer unit may charge the moving member with the polarity opposite to the given polarity when the output image based on the image data is transferred from the surface of the image carrier onto either the first moving member or the recording medium carried by the second moving member, and charge the moving member with the given polarity when the forcible toner consumption image is transferred along with a movement of the surface of the image carrier.

The transfer unit may apply a smaller amount of charge when charging the moving member with the given polarity than when charging the moving member with the polarity opposite to the given polarity.

A surface friction coefficient of the moving member may be greater than a surface friction coefficient of the image carrier in a primary transfer nip where the image carrier and the moving member contact each other.

When the forcible toner consumption image is transferred with the movement of the surface of image carrier, a surface speed of the moving member may be greater than a surface speed of the image carrier.

A ratio of an amount of toner per unit area to the image carrier for developing the forcible toner consumption image may be smaller than a ratio of an amount of toner unit area to the image carrier for developing the output image.

The image carrier may be constituted as multiple image carriers configured to carry respective latent images formed on surfaces thereof and the developing unit may be constituted as multiple developing units configured to develop the latent images with respective colors of toner into toner images. The transfer unit may sequentially transfer the toner images onto the moving member to form a composite color toner image, and charge the moving member with the given polarity at respective positions facing the other downstream image carriers, and stop charging when the moving member carrying the toner transferred from the forcible toner consumption image formed on an extreme upstream image carrier onto the moving member moves to the positions with a movement of the surface of the moving member.

When the moving member carrying the toner transferred from the forcible toner consumption image onto the moving member moves to the positions facing the other downstream image carriers, a surface potential applied at the positions to a non-image forming part of the forcible toner consumption image on the extreme upstream image carrier may be set lower than a surface potential applied at the positions to a non-image forming part of the output image on the image carrier.

The transfer unit may separate the moving member from the multiple image carriers disposed downstream from an extreme upstream image carrier, and then move the moving member carrying the toner transferred from the forcible toner consumption image formed on the extreme upstream image carrier to the moving member to positions to face the image carriers disposed downstream from the extreme upstream image carrier with a movement of the surface of the moving member.

The forcible toner consumption image may be formed on the extreme upstream image carrier to transfer the toner included in the forcible toner consumption image onto the moving member.

Of the multiple image carriers, a yellow image carrier for forming a yellow toner image may be disposed at an extreme upstream position to transfer the yellow toner image before other color toner images.

Of the multiple image carriers, a black image carrier for forming a black toner image may be disposed at an extreme downstream position to transfer the black toner image last.

The forcible toner consumption image may be formed only on a black image carrier of the multiple image carriers to transfer the toner included in the forcible toner consumption image formed on the black image carrier onto the moving member.

Of the multiple image carriers, a black image carrier for forming a black toner image may be disposed at an extreme downstream position to transfer the black toner image last. The forcible toner consumption image may be formed only on the black image carrier and on the extreme upstream image carrier to transfer the toners included in the forcible toner consumption image formed on the black image carrier and the extreme upstream image carrier onto the moving member.

The remover may remove the toner remaining on the moving member while the moving member is separated from the multiple image carriers other than the extreme upstream image carrier and an extreme downstream image carrier when an image forming operation is stopped abnormally and a recovery operation is conducted.

Further, in one exemplary embodiment, an image forming method includes optically writing a latent image on a surface of an image carrier based on image data, developing with toner the latent image into a toner image including an output image and a forcible toner consumption image, transferring the toner image onto a surface of a moving member including a first moving member for directly receiving the toner image on a surface thereof and a second moving member for indirectly receiving the toner image on a recording medium carried on a surface thereof while forming a given electrical field constituted as a first electrical field for providing an electrostatic force from the image carrier to the moving member with respect to the toner charged with a given polarity, negative or positive, when the output image is transferred from the surface of the image carrier to the moving member and a second electrical field for providing an electrostatic force from the image carrier to the moving member with respect to the toner charged with a polarity opposite to the given polarity when the forcible toner consumption image is transferred from the surface of the image carrier to the moving member, removing residual toner remaining on the surface of the image carrier after the moving member passes the transfer unit, conveying the residual toner to the developing unit for recycling, and forming the forcible toner consumption image on the image carrier at a given timing.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIG. 10 is a flowchart of a forced toner consumption determination process executed by the controller of the image forming apparatus of FIG. 1;

DETAILED DESCRIPTION OF THE PREFERRED EMBODIMENTS

Figure 1:
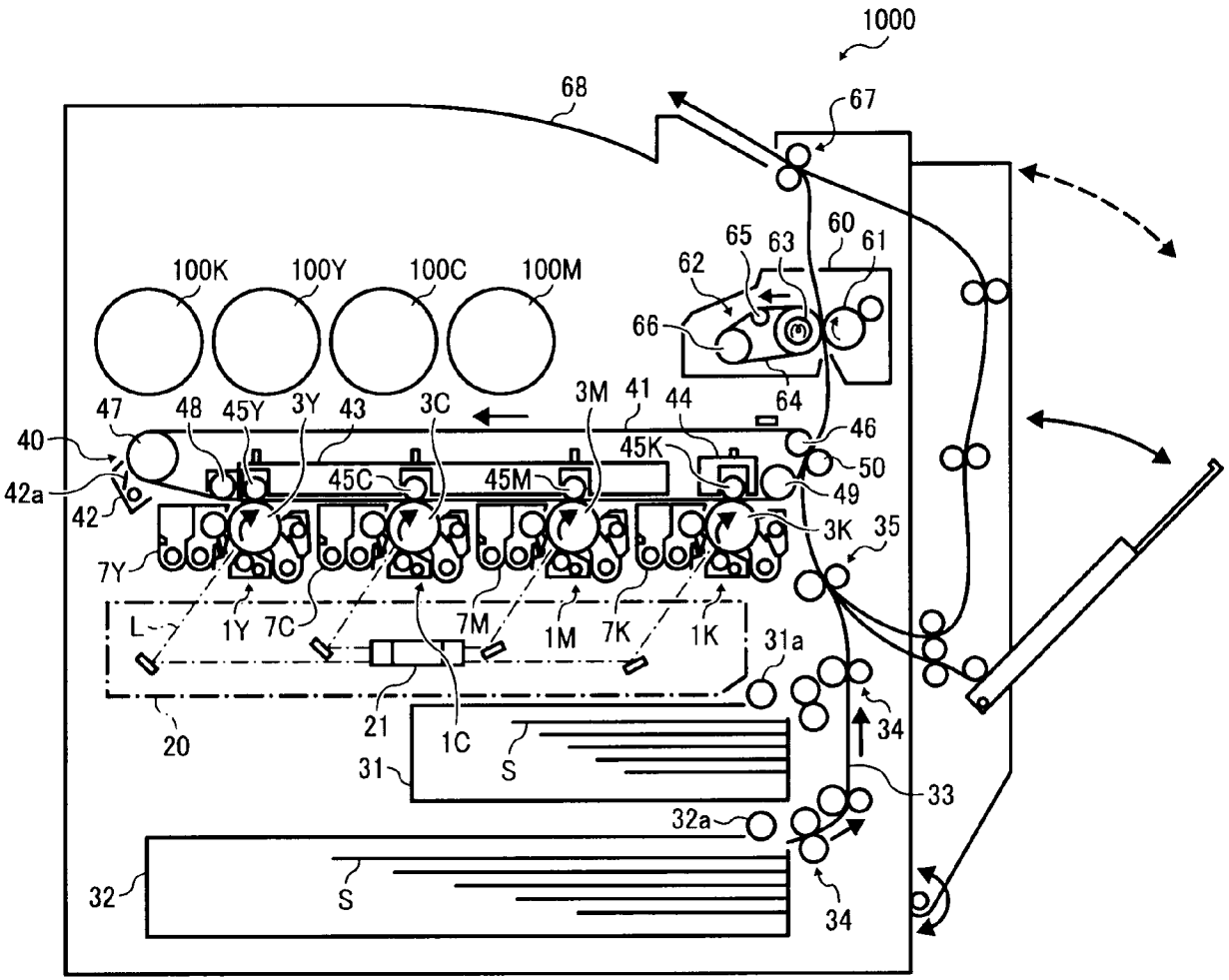
FIG. 1 is a schematic configuration of an internal portion of an image forming apparatus according to a first exemplary embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

FIG. 1 is a schematic configuration of a printer 1000 serving as an electrophotographic image forming apparatus according to a first exemplary embodiment of the present invention.

As shown in FIG. 1, the printer 1000 includes process units 1Y, 1C, 1M, and 1K serving as an image forming mechanism. The process units 1Y, 1C, 1M, and 1K are used to form toner images of yellow, cyan, magenta, and black, respectively. Hereinafter, reference characters of "Y", "C", "M", and "K" are used to indicate each color of yellow, cyan, magenta, and black, as required. The process units 1Y, 1C, 1M, and 1K have a similar configuration for forming a toner image, except toner colors (i.e., yellow, cyan, magenta, and black toner). For example, the process unit 1Y for forming a yellow toner image may include a photoconductor unit 2Y, and a developing unit 7Y, as shown in FIG. 2.

Figure 3:
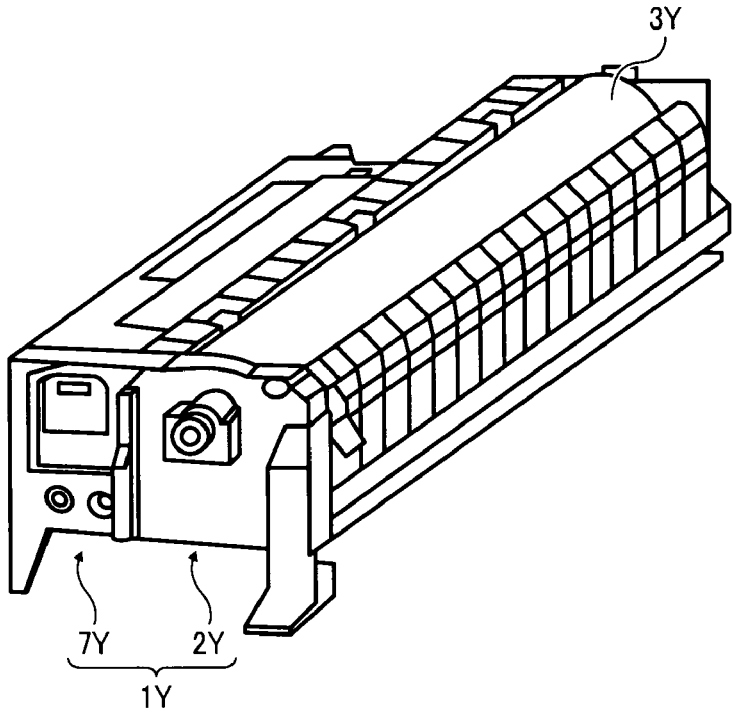
FIG. 3 is a perspective view of the process unit of FIG. 2.
Figure 4:
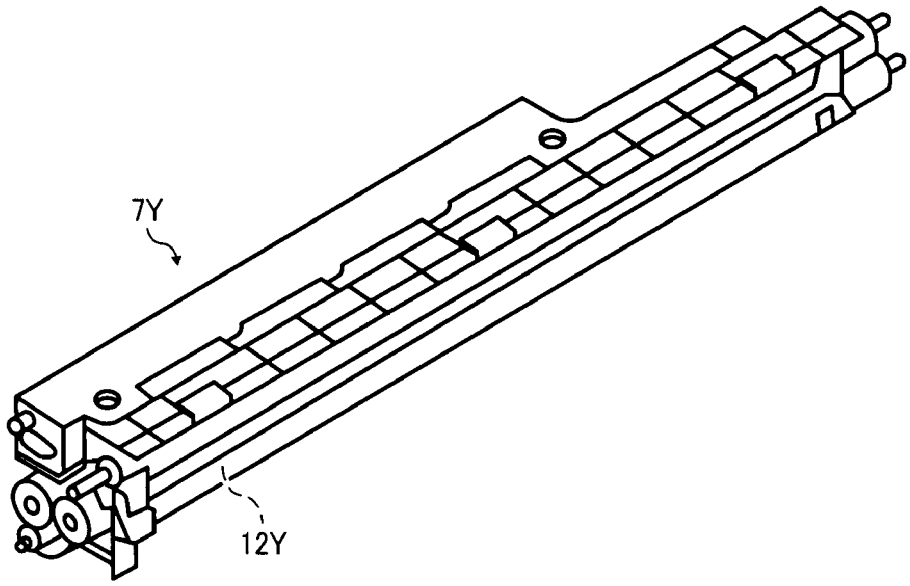
FIG. 4 is a perspective view of a developing unit included in the process unit of FIG. 2.

The photoconductor unit 2Y and the developing unit 7Y may be integrally mounted as the process unit 1Y, as shown in FIG. 3. Such process unit 1Y may be detachably attached to the printer 1000. After the process unit 1Y is removed from the printer 1000, the developing unit 7Y can be further detachable from the photoconductor unit 2Y, as shown in FIG. 4.

Figure 2:
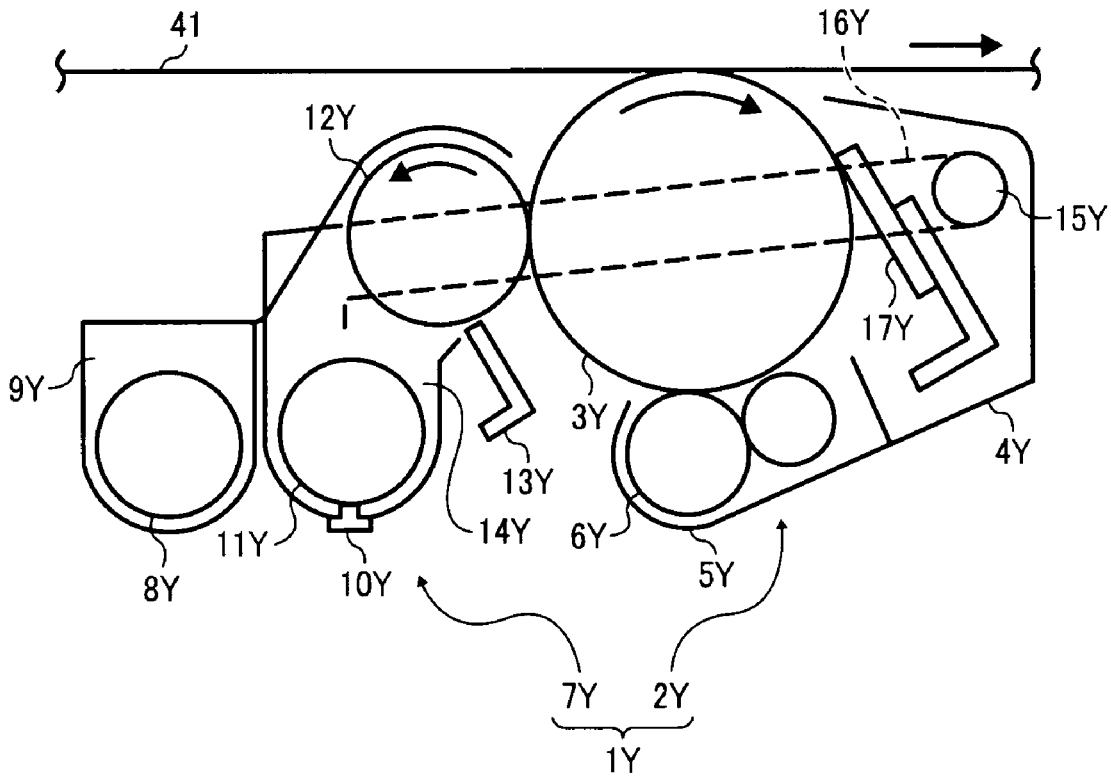
FIG. 2 is an enlarged view showing a schematic configuration of a process unit of the image forming apparatus of FIG. 1.

As shown in FIG. 2, the photoconductor unit 2Y includes a photoconductor 3Y, a drum cleaning unit 4Y, a charging unit 5Y, and a discharging unit, not shown, and so forth.

The photoconductor 3Y in FIG. 2 is a drum-shaped member, and serves as an image carrier. The drum cleaning unit 4Y, in FIG. 2, serves as a remover.

The charging unit 5Y uniformly charges a surface of the photoconductor 3Y, which rotates in a clockwise direction in FIG. 2 by a driver, not shown. The charging unit 5Y in FIG. 2 includes a contact type charger such as a charging roller 6Y, for example. The charging roller 6Y is supplied with a charging bias voltage from a power source, not shown, and at the same time rotates in a counterclockwise direction. By disposing the charging roller 6Y close to the photoconductor 3Y, the charging unit 5Y can charge the surface of the photoconductor 3Y. The charging bias voltage includes an alternating current voltage superimposed by a direct current voltage. Instead of the charging roller 6Y, the charging unit 5Y may include a charging brush, for example, to be held in contact with the surface of the photoconductor 3Y.

Furthermore, the charging unit 5Y may include a non-contact type charger, such as a scorotron charger, not shown, to uniformly charge the surface of the photoconductor 3Y.

The surface of the photoconductor 3Y, which is uniformly charged by the charging unit 5Y, may be exposed by a laser light beam, which is emitted from an optical writing unit 20, to form an electrostatic latent image for a yellow toner image on the surface of the photoconductor 3Y.

As shown in FIG. 2, the developing unit 7Y includes a first developer container 9Y having a first conveying screw 8Y therein, for example. The developing unit 7Y may further include a second developer container 14Y having a toner concentration sensor 10Y, a second conveying screw 11Y, a developing roller 12Y, and a doctor blade 13Y. The toner concentration sensor 10Y (hereinafter, T-sensor 10Y) may include a magnetic permeability sensor, for example.

The first and second developer containers 9Y and 14Y may contain a yellow developing agent, not shown, having magnetic carrier and yellow toner. The yellow toner may be negatively charged.

The first conveying screw 8Y, rotated by a driver, not shown, conveys the yellow developing agent to one end direction of the first developer container 9Y. Then, the yellow developing agent is conveyed into the second developer container 14Y through an opening, not shown, of a separation wall, provided between the first developer container 9Y and the second developer container 14Y.

The second conveying screw 11Y, rotated in the second developer container 14Y by a driver, not shown, conveys the yellow developing agent to one end direction of the second developer container 14Y from a far side to a near side in FIG. 2.

The T-sensor 10Y, attached to a bottom of the second developer container 14Y, detects toner concentration in the yellow developing agent being conveyed in the second developer container 14Y.

As shown in FIG. 2, the developing roller 12Y is provided over the second conveying screw 11Y while the developing roller 12Y and second conveying screw 11Y are provided in the second developer container 14Y in a parallel manner.

As shown in FIG. 2, the developing roller 12Y may include a developing sleeve and a magnet roller, both not shown.

The developing sleeve may be made of non-magnetic material and formed in a pipe shape, such as an aluminum pipe, that can be rotated in a counterclockwise direction in FIG. 2. The magnet roller may be included in the developing sleeve.

When the developing sleeve rotates in a counterclockwise direction in FIG. 2, a portion of the yellow developing agent, conveyed by the second conveying screw 11Y, may be carried-up to a surface of the developing sleeve with an effect of magnetic force of the magnet roller. Then, the doctor blade 13Y, which is provided over the developing sleeve with a given space therebetween, regulates a thickness of layer of the yellow developing agent on the developing sleeve. Such thickness-regulated yellow developing agent is conveyed to a developing area, which faces the photoconductor 3Y, with rotations of the developing sleeve. Then, yellow toner in the yellow developing agent is conveyed to an electrostatic latent image formed on the surface of the photoconductor 3Y to develop into a yellow toner image on the surface of the photoconductor 3Y. The yellow developing agent, which loses the yellow toner by such developing process, is returned to the second conveying screw 11Y with rotations of the developing sleeve of the developing roller 12Y. Then, the yellow developing agent is conveyed by the second conveying screw 11Y and returned to the first developer container 9Y through an opening, not shown, of the separation wall.

The toner concentration sensor 10Y detects permeability of the yellow developing agent, and transmits a detected permeability to a controller 200 (see FIG. 9) of the printer 1000 as voltage signal. The permeability of yellow developing agent correlates with a yellow toner concentration in the yellow developing agent. Accordingly, the T-sensor 10Y outputs a voltage signal corresponding to an actual yellow toner concentration in the second developer container 14Y.

The controller 200 includes a random access memory or RAM, which stores a reference value "Vtref" for voltage signal transmitted from the toner concentration sensor 10Y. The reference value "Vtref" is set to a value, which is preferable for developing process. The reference value "Vtref" is set to a preferable toner concentration for each of yellow toner, cyan toner, magenta toner, and black toner. The RAM stores such preferable toner concentration value as data.

With respect to the developing unit 7Y, the controller 200 compares a reference value "Vtref" for yellow toner concentration and an actual voltage signal coming from the T-sensor 10Y. Then, the controller 200 drives a toner supplying unit, not shown, for a given time period based on the above-described comparison to supply fresh yellow toner to the developing unit 7Y. With this process, fresh yellow toner can be supplied to the first developer container 9Y, as required, by which a yellow toner concentration in the yellow developing agent in the first developer container 9Y is set to a preferable level after the developing process, which consumes yellow toner. Accordingly, yellow toner concentration in the yellow developing agent in the second developer container 14Y may be maintained at a given range. Such toner supply control is similarly performed for other process units 1C, 1M, and 1K, using different color toners with developing agent.

The yellow toner image formed on the photoconductor 3Y is then transferred to an intermediate transfer belt 41, which will be described later.

The drum cleaning unit 4Y of the photoconductor unit 2Y includes a cleaning blade 17Y that is held in contact with the surface of the photoconductor 3Y. By the cleaning blade 17Y, the drum cleaning unit 4Y removes residual toner remaining on the surface of the photoconductor 3Y after transferring a yellow toner image to the intermediate transfer belt 41. That is, in the printer 1000, the drum cleaning unit 4Y serves as a remaining toner removing unit for removing residual toner remaining on the surface of the photoconductor 3Y serving as an image carrier.

The drum cleaning unit 4Y causes the residual toner removed by the cleaning blade 17Y to fall by its own weight onto a toner collecting screw 15Y and to convey, according to the rotation of the toner collecting screw 15Y, from the near side to the far side in a direction perpendicular to the drawing sheet of FIG. 2, and discharge to the outside of the printer 1000.

At one end portion on the far side in the direction perpendicular to the drawing sheet of FIG. 2, a toner recycling mechanism 16Y, which serves as a toner recycling unit, is disposed extending between the drum cleaning unit 4Y and the developing unit 7Y. The toner recycling mechanism 16Y receives the residual toner discharged by the drum cleaning unit 4Y and conveys the residual toner into the second developer container 14Y of the developing unit 7Y. Thus, the residual toner removed from the surface of the photoconductor 3Y is returned to the second developer container 14Y of the developing unit 7Y to be reused.

After cleaned by the drum cleaning unit 4Y, the surface of the photoconductor 3Y is electrically discharged by the discharging unit. This removal of electricity initializes the surface of the photoconductor 3Y, and the photoconductor 3Y can become ready for a subsequent image forming operation.

Back in FIG. 1, similar to the process unit 1Y, the process units 1C, 1M, and 1K form cyan toner image, magenta toner image, and black toner image on the photoconductors 3C, 3M, and 3K, respectively, to be transferred onto the intermediate transfer belt 41. Then, respective drum cleaning units, which is similar to the drum cleaning unit 4Y, removes residual toners remaining on the photoconductors 3C, 3M, and 3K.

As shown in FIG. 1, the printer 1000 includes the optical writing unit 20 under the process units 1Y, 1C, 1M, and 1K.

The optical writing unit 20 irradiates the laser light beam L to each of the photoconductors 3Y, 3C, 3M, and 3K of the respective process units 1Y, 1C, 1M, and 1K based on image data. With such process, electrostatic latent images for yellow, cyan, magenta, and black colors are formed on the respective photoconductors 3Y, 3C, 3M, and 3K.

The optical writing unit 20 irradiates the laser light beam L to the photoconductors 3Y, 3C, 3M, and 3K with a polygon mirror 21 and other optical components such as lens and mirrors. The polygon mirror 21, rotated by a motor, not shown, deflects the laser light beam L coming from a light source, not shown. Such light beam then goes via the plurality of optical components to the photoconductors 3Y, 3C, 3M, and 3K.

The optical writing unit 20 may include a different structure such as a light emitting diode array or LED array for scanning the photoconductors 3Y, 3C, 3M, and 3K, for example.

The printer 1000 in FIG. 1 further includes a first sheet cassette 31 and a second sheet cassette 32 under the optical writing unit 20. As shown in FIG. 1, the first sheet cassette 31 and the second sheet cassette 32 may be provided in a vertical direction each other.

The first sheet cassette 31 and the second sheet cassette 32 store a bundle of sheets as recording media. A top sheet in the first sheet cassette 31 or the second sheet cassette 32 is referred as a recording sheet S serving as a recording medium. The recording sheet S contacts with a first sheet feeding roller 31*a* or a second sheet feeding roller 32*a*.

When the first sheet feeding roller 31*a*, driven by a driver, not shown, rotates in a counterclockwise direction in FIG. 1, the recording sheet S in the first sheet cassette 31 is fed to a sheet feeding route 33, which extends in a vertical direction in a right side of the printer 1000 in FIG. 1. Similarly, when the second sheet feeding roller 32*a*, driven by a driver, not shown, rotates in a counterclockwise direction in FIG. 1, the recording sheet S in the second sheet cassette 32 is fed to the sheet feeding route 33.

The sheet feeding route 33 is provided with a plurality of pairs of conveying rollers 34 as shown in FIG. 1. The plurality of pairs of conveying rollers 34 convey the recording sheet S in one direction in the sheet feeding route 33 (e.g., from the lower direction to the upper direction in the sheet feeding route 33).

The sheet feeding route 33 is also provided with a pair of registration rollers 35 at the end of the sheet feeding route 33.

The pair of registration rollers 35 receives the recording sheet S, fed by the pairs of conveying rollers 34, and then the pair of registration rollers 35 stops its rotation temporarily. Then, the pair of registration rollers 35 feeds the recording sheet S to a secondary transfer nip (to be described later) at a given timing.

As shown in FIG. 1, the printer 1000 further includes a transfer unit 40 over the process units 1Y, 1C, 1M, and 1K. The transfer unit 40 of FIG. 1 includes the intermediate transfer belt 41, a belt cleaning unit 42, a first bracket 43, a second bracket 44, primary transfer rollers 45Y, 45C, 45M, and 45K, a back-up roller 46, a drive roller 47, a support roller 48, and a tension roller 49.

The intermediate transfer belt 41, which serves as an endless moving member or a moving member, is extended by the primary transfer rollers 45Y, 45C, 45M, and 45K, the back-up roller 46, the drive roller 47, the support roller 48, and the tension roller 49. The intermediate transfer belt 41 travels in a counterclockwise direction in FIG. 1 in an endless manner with a driving force of the drive roller 47.

The primary transfer rollers 45Y, 45C, 45M, and 45K, the photoconductors 3Y, 3C, 3M, and 3K may form primary transfer nips respectively while sandwiching the intermediate transfer belt 41 therebetween. The primary transfer rollers 45Y, 45C, 45M, and 45K apply a primary transfer biasing voltage, supplied from a power source, not shown, to an inner face of the intermediate transfer belt 41. The primary transfer biasing voltage may have a polarity (e.g., positive polarity) opposite to a toner polarity (e.g., negative polarity).

The intermediate transfer belt 41 traveling in an endless manner receives the yellow, cyan, magenta, and black toner images from the photoconductors 3Y, 3C, 3M, and 3K at the primary transfer nips for yellow, cyan, magenta, and black toner images in a superimposing and sequential manner, by which the yellow, cyan, magenta, and black toner images may be transferred to the intermediate transfer belt 41. Accordingly, the intermediate transfer belt 41 may have a four-color or full-color toner image thereon.

As shown in FIG. 1, a secondary transfer roller 50, which serves as a contact member, contacts an outer surface of the intermediate transfer belt 41 to form a secondary transfer nip with the back-up roller 46 while sandwiching the intermediate transfer belt 41 therebetween.

The pair of registration rollers 35 feeds the recording sheet S to the secondary transfer nip at a given timing, which is synchronized with a timing for forming the full-color toner image on the intermediate transfer belt 41.

A secondary transfer electrical field is generated between the secondary transfer roller 50 and the back-up roller 46. The full-color toner image formed on the intermediate transfer belt 41 is transferred to the recording sheet S at the secondary transfer nip with an effect of the secondary transfer electrical field and nip pressure to form a full-color toner image.

After transferring toner images at the secondary transfer nip to the recording sheet S, some toner particles may remain on the intermediate transfer belt 41. The belt cleaning unit 42 serving as a remover removes such remaining toner particles from the intermediate transfer belt 41.

The belt cleaning unit 42 removes toner particles remaining on the intermediate transfer belt 41 by contacting a cleaning blade 42*a* on the outer surface of the intermediate transfer belt 41.

The first bracket 43 of the transfer unit 40 swings with a given rotational angle at an axis of the support roller 48 with an ON/OFF of solenoid, not shown.

In case of forming a monochrome image with the printer 1000, the first bracket 43 is rotated in a counterclockwise direction in FIG. 1 for some degree by activating the solenoid. With such rotating movement of the first bracket 43, the primary transfer rollers 45Y, 45C, and 45M revolve in a counterclockwise direction around a rotational axis of the support roller 48. With the above-described process, the intermediate transfer belt 41 is spaced apart from the photoconductors 3Y, 3C, and 3M. Accordingly, a monochrome image can be formed on the recording sheet S by driving the process unit 1K while stopping other process units 1Y, 1C, and 1M. Such configuration may preferably reduce or suppress an aging of the process units 1Y, 1C, and 1M because the process units 1Y, 1C, and 1M may not be driven when a monochrome image forming is conducted.

In case of forming a color image with the printer 1000, the first bracket 43 is rotated in a clockwise direction in FIG. 1 for some degree. With such rotating movement of the first bracket 43, the primary transfer rollers 45Y, 45C, and 45M revolve in a clockwise direction around the rotational axis of the support roller 48. With the above-described process, the intermediate transfer belt 41 contacts the photoconductors 3Y, 3C, and 3M. Accordingly, a color image can be formed on the recording sheet by driving the process units 1Y, 1C, 1M, and 1K while forming four primary transfer nips for yellow, cyan, magenta, and black toners, respectively.

As shown in FIG. 1, the printer 1000 includes a fixing unit 60 over the secondary transfer nip.

The fixing unit 60 includes a pressure roller 61 and a fixing belt unit 62.

The fixing belt unit 62 includes a fixing belt 64, a heat roller 63, a tension roller 65, a drive roller 66, and a temperature sensor, not shown. The heat roller 63 includes a heat source such as halogen lamp, for example. The fixing belt 64, extended by the heat roller 63, the tension roller 65, and the drive roller 66, travel in a counterclockwise direction in an endless manner. During such traveling movement of the fixing belt 64, the heat roller 63 heats the fixing belt 64 from the inner side.

As shown in FIG. 1, the pressure roller 61 facing the heat roller 63 may contact an outer surface of the heated fixing belt 64. Accordingly, the pressure roller 61 and the fixing belt 64 form a fixing nip.

The temperature sensor is provided over an outer surface of the fixing belt 64 with a given space and near the fixing nip so that the temperature sensor may detect a surface temperature of the fixing belt 64, which is just going into the fixing nip. The temperature sensor transmits a detected temperature to a power source circuit, not shown, as a signal. Based on the signal, the power source circuit may control a power ON/OFF to the heat source in the heat roller 63, for example. With such controlling, the surface temperature of the fixing belt 64 may be maintained at a given level such as approximately 140 degree Celsius, for example.

The recording sheet S that has passed through the secondary transfer nip is then transported to the fixing unit 60. The fixing unit 60 applies pressure and heat to the recording sheet S at the fixing nip to fix the full-color toner image on the recording sheet S.

After the fixing process, the recording sheet S is discharged to an outside of the printer 1000 with a pair of sheet discharging rollers 67.

The printer 1000 further includes a sheet stack 68 on a top of the printer 1000. The recording sheet S discharged by the pair of sheet discharging rollers 67 is stacked on the sheet stack 68.

The printer 1000 further includes toner cartridges 100Y, 100C, 100M, and 100K over the transfer unit 40. The toner cartridges 100Y, 100C, 100M, and 100K store yellow, cyan, magenta, and black toners, respectively. The yellow, cyan, magenta, and black toners are supplied from the toner cartridges 100Y, 100C, 100M, and 100K to the developing unit 7Y, 7C, 7M, and 7K of the process units 1Y, 1C, 1M, and 1K, as required.

The toner cartridges 100Y, 100C, 100M, and 100K and the process units 1Y, 1C, 1M, and 1K are separately detachable from the printer 1000.

Hereinafter, a drive force transmitting configuration in the printer 1000 is described with reference to FIGS. 5 and 6. The drive force transmitting configuration may be attached to a housing structure of the printer 1000.

Figure 5:
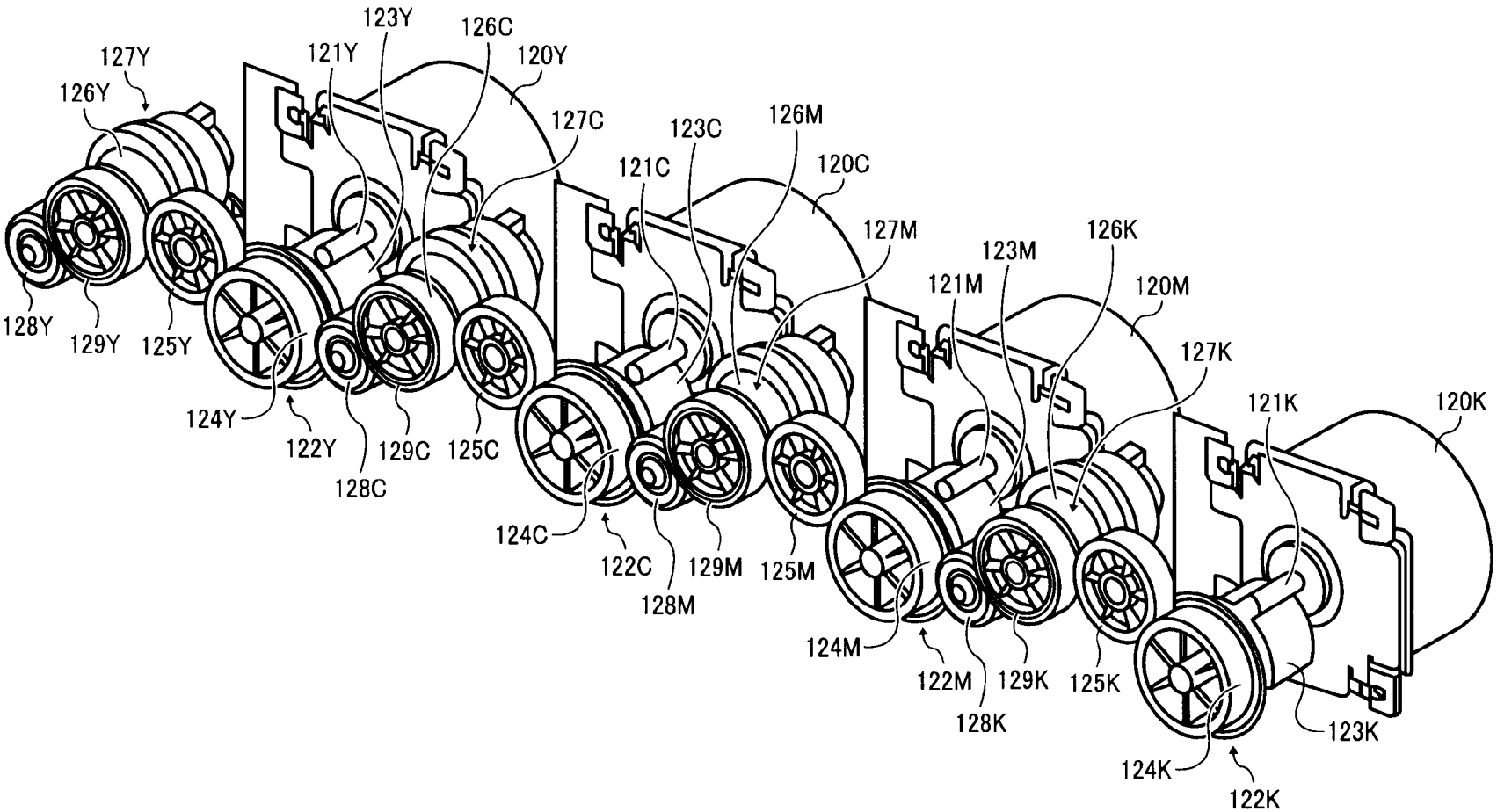
FIG. 5 is a perspective view of a drive-force transmitting configuration in the image forming apparatus of FIG. 1.

FIG. 5 is a perspective view of the drive force transmitting configuration in the printer 1000. FIG. 6 is a top view of the drive force transmitting configuration of FIG. 5.

As shown in FIG. 5, the printer 1000 includes a support plate to which process drive motors 120Y, 120C, 120M, and 120K are attached. The process drive motors 120Y, 120C, 120M, and 120K drive the process unit 1Y, 1C, 1M, and 1K, respectively. Each of the process drive motors 120Y, 120C, 120M, and 120K includes a shaft, to which drive gears 121Y, 121C, 121M, and 121K are attached.

Under the shaft of the process drive motors 120Y, 120C, 120M, and 120K, developing gears 122Y, 122C, 122M, and 122K are provided. The developing gears 122Y, 122C, 122M, and 122K drive the developing unit 7Y, 7C, 7M, and 7K. The developing gears 122Y, 122C, 122M, and 122K are engaged to a shaft, not shown, protruded from the support plate SP, and rotate on the shaft.

Each of the developing gears 122Y, 122C, 122M, and 122K includes first gears 123Y, 123C, 123M, and 123K, and second gears 124Y, 124C, 124M, and 124K, respectively. The first gear 123Y and second gear 124Y have a same shaft and rotate altogether. Other first gears 123C, 123M, and 123K, and second gears 124C, 124M, and 124K also have a similar configuration.

Figure 6:
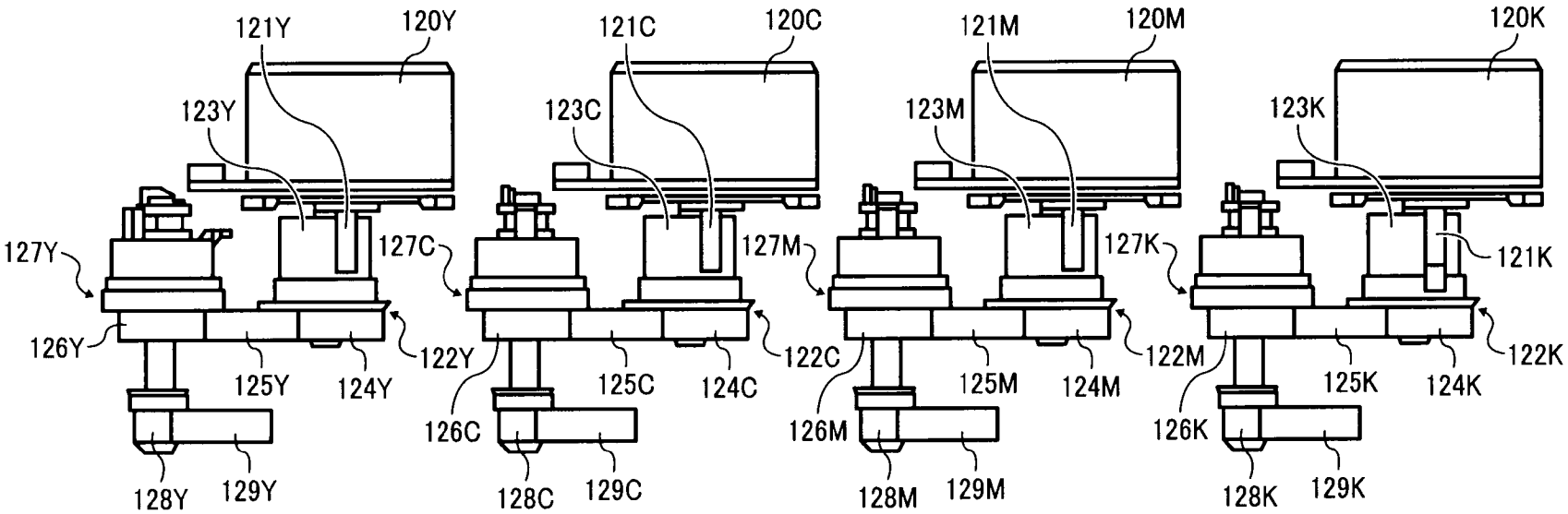
FIG. 6 is a top view of the drive-force transmitting configuration of FIG. 5.

As shown in FIGS. 5 and 6, the first gears 123Y, 123C, 123M, and 123K are provided between the process drive motors 120Y, 120C, 120M, and 120K, and the second gears 124Y, 124C, 124M, and 124K, respectively. The first gears 123Y, 123C, 123M, and 123K are meshed to the drive gears 121Y, 121C, 121M, and 121K of the process drive motors 120Y, 120C, 120M, and 120K, respectively. Accordingly, the developing gears 122Y, 122C, 122M, and 122K are rotatable by a rotation of the process drive motors 120Y, 120C, 120M, and 120K, respectively.

The process drive motors 120Y, 120C, 120M, and 120K include a direct current or DC brushless motor such as a direct current or DC servomotor, for example. The drive gears 121Y, 121C, 121M, and 121K, and photoconductor gears (see for example 133Y of FIG. 8) have a given speed reduction ratio such as 1:20, for example.

As shown in FIGS. 5 and 6, first linking gears 125Y, 125C, 125M, and 125K are provided at the left side of the developing gears 122Y, 122C, 122M, and 122K. The first linking gears 125Y, 125C, 125M, and 125K are rotatable on a shaft, not shown, provided on the support plate.

As shown in FIGS. 5 and 6, the first linking gears 125Y, 125C, 125M, and 125K are meshed to the second gears 124Y, 124C, 124M, and 124K of the developing gears 122Y, 122C, 122M, and 122K, respectively. Accordingly, the first linking gears 125Y, 125C, 125M, and 125K are rotatable with a rotation of the developing gears 122Y, 122C, 122M, and 122K, respectively.

As shown in FIG. 6, the first linking gears 125Y, 125C, 125M, and 125K are meshed to the second gears 124Y, 124C, 124M, and 124K, respectively, at an upstream side of drive force transmitting direction. As also shown in FIG. 6, the first linking gears 125Y, 125C, 125M, and 125K are also meshed to clutch input gears 126Y, 126C, 126M, and 126K, respectively, at a down-stream side the drive force transmitting direction.

As shown in FIGS. 5 and 6, the clutch input gears 126Y, 126C, 126M, and 126K are supported by developing clutches 127Y, 127C, 127M, and 127K, respectively. Each of the developing clutches 127Y, 127C, 127M, and 127K are controlled by the controller 200 (see FIG. 9) of the printer 1000. Specifically, the controller 200 controls power supply to the developing clutches 127Y, 127C, 127M, and 127K by conducing power ON/OFF to the developing clutches 127Y, 127C, 127M, and 127K.

Under a control by the controller 200, a clutch shaft of the developing clutches 127Y, 127C, 127M, and 127K are engaged to the clutch input gears 126Y, 126C, 126M, and 126K to rotate with the clutch input gears 126Y, 126C, 126M, and 126K.

Or under a control by the controller 200, the clutch shaft of the developing clutches 127Y, 127C, 127M, and 127K are disengaged from the clutch input gears 126Y, 126C, 126M, and 126K to rotate only the clutch input gears 126Y, 126C, 126M, and 126K, in which the clutch input gears 126Y, 126C, 126M, and 126K are idling.

As shown in FIG. 6, clutch output gears 128Y, 128C, 128M, and 128K are attached to an end of the clutch shaft of the developing clutches 127Y, 127C, 127M, and 127K, respectively.

When power is supplied to the developing clutches 127Y, 127C, 127M, and 127K, the clutch shaft of the developing clutches 127Y, 127C, 127M, and 127K are engaged to the clutch input gears 126Y, 126C, 126M, and 126K. Then, a rotation of the clutch input gears 126Y, 126C, 126M, and 126K are transmitted to the clutch shaft of the developing clutches 127Y, 127C, 127M, and 127K, by which the clutch output gears 128Y, 128C, 128M, and 128K are rotated.

On one hand, when a power supply to the developing clutches 127Y, 127C, 127M, and 127K is stopped, the clutch shaft of the developing clutches 127Y, 127C, 127M, and 127K is disengaged from the clutch input gears 126Y, 126C, 126M, and 126K, by which only the clutch input gears 126Y, 126C, 126M, and 126K are idling without rotating the clutch shaft of the developing clutches 127Y, 127C, 127M, and 127K.

Accordingly, the rotation of the clutch input gears 126Y, 126C, 126M, and 126K are not transmitted to the clutch output gears 128Y, 128C, 128M, and 128K, respectively.

Therefore, a rotation of the clutch output gears 128Y, 128C, 128M, and 128K may be stopped because the process drive motors 120Y, 120C, 120M, and 120K are idling.

As shown in FIG. 6, second linking gears 129Y, 129C, 129M, and 129K are meshed at the right side of the clutch output gears 128Y, 128C, 128M, and 128K, respectively. Accordingly, the second linking gears 129Y, 129C, 129M, and 129K may be rotatable with the clutch output gears 128Y, 128C, 128M, and 128K, respectively.

The above-described drive force transmitting configuration in the printer 1000 may transmit a drive force as below, where each suffix is omitted. Specifically, a drive force may be transmitted with a sequential order beginning from the process drive motor 120, the drive gear 121, the first gear 123 and the second gear 124 of the developing gear 122, the first linking gear 125, the clutch input gear 126, the clutch output gear 128, and to the second linking gear 129.

Figure 7:
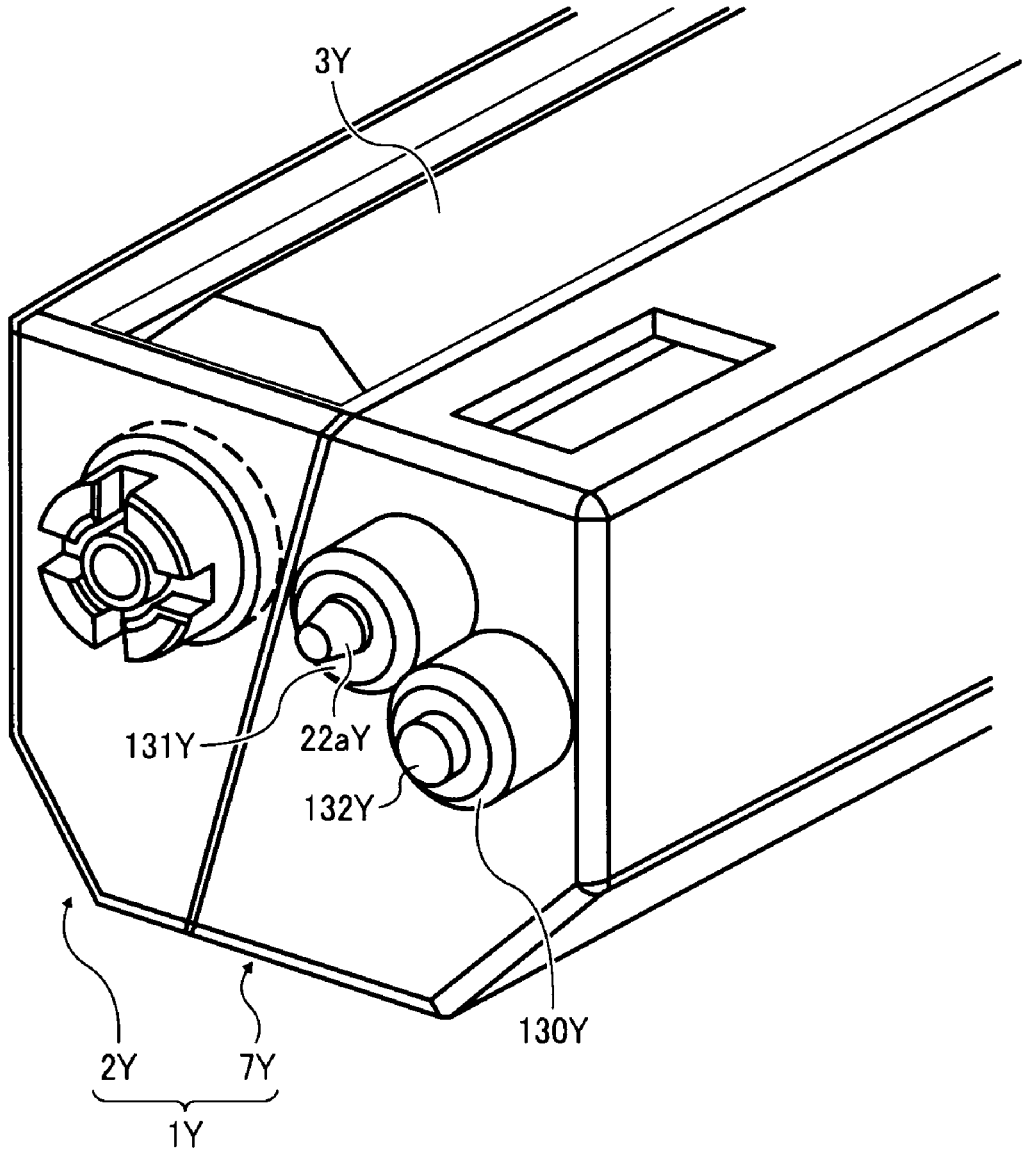
FIG. 7 is a partial perspective view of one end of the process unit of FIG. 2.

FIG. 7 is a partial perspective view of the process unit 1Y.

The developing sleeve 22Y in the developing unit 7Y has a shaft 22*a*Y, which protrudes from one end face of a casing of the developing unit 7Y as shown in FIG. 7.

As shown in FIG. 7, the shaft 22*a*Y is attached with a first sleeve gear 131Y. Also, an attachment shaft 132Y is protruded from the one end face of a casing of the developing unit 7Y. The attachment shaft 132Y is attached with a third linking gear 130Y rotatable with the attachment shaft 132Y. The third linking gear 130Y meshes with the first sleeve gear 131Y as shown in FIG. 7.

When the process unit 1Y is set in the printer 1000, the third linking gear 130Y meshing with the first sleeve gear 131Y meshes with the second linking gear 129Y shown in FIGS. 5 and 6.

Accordingly, a rotation of the second linking gear 129Y is sequentially transmitted to the third linking gear 130Y, and then to the first sleeve gear 131Y, by which the developing sleeve 22Y is rotated.

Similarly, a rotation may be transmitted to a developing sleeve of the other process units 1C, 1M, and 1K in a similar manner.

FIG. 7 shows one end of the process unit 1Y. At the other end of the process unit 1Y, the shaft 22*a*Y of the developing sleeve 22Y is also protruded from the casing, and the protruded portion of the shaft 22*a*Y is attached with a second sleeve gear, not shown.

Although not shown in FIG. 7, each of the first conveying screw 8Y and the second conveying screw 11Y (see in FIG. 2) has a shaft, which protrudes from the other end of the casing of the process unit 1Y. The protruded portion of the shaft of the first conveying screw 8Y and the shaft of the second conveying screw 11Y are attached with a first screw gear, not shown, and a second screw gear, not shown, respectively.

The second screw gear meshes with the second sleeve gear, and also meshes with the first screw gear.

When the developing sleeve 22Y is rotated by a rotation of the first sleeve gear 131Y, the second sleeve gear at the other end of the process unit 1Y is also rotated. With rotations of the second sleeve gear, the second screw gear is rotated, and then a driving force, transmitted from the second screw gear, rotates the second conveying screw 11Y. Furthermore, the first screw gear meshed to the second screw gear transmits a driving force to the first conveying screw 8Y, by which the first conveying screw 8Y rotates.

A similar configuration may be applied to other process units 1C, 1M, and 1K.

As above described, each of the process units 1Y, 1C, 1M, and 1K includes a group of gears, which may be used for a developing process such as the drive gear 121, the developing gear 122, the first linking gear 125, the clutch input gear 126, the clutch output gear 128, the second linking gear 129, the third linking gear 130, the first sleeve gear 131, the second sleeve gear, the first screw gear, and the second screw gear.

Figure 8:
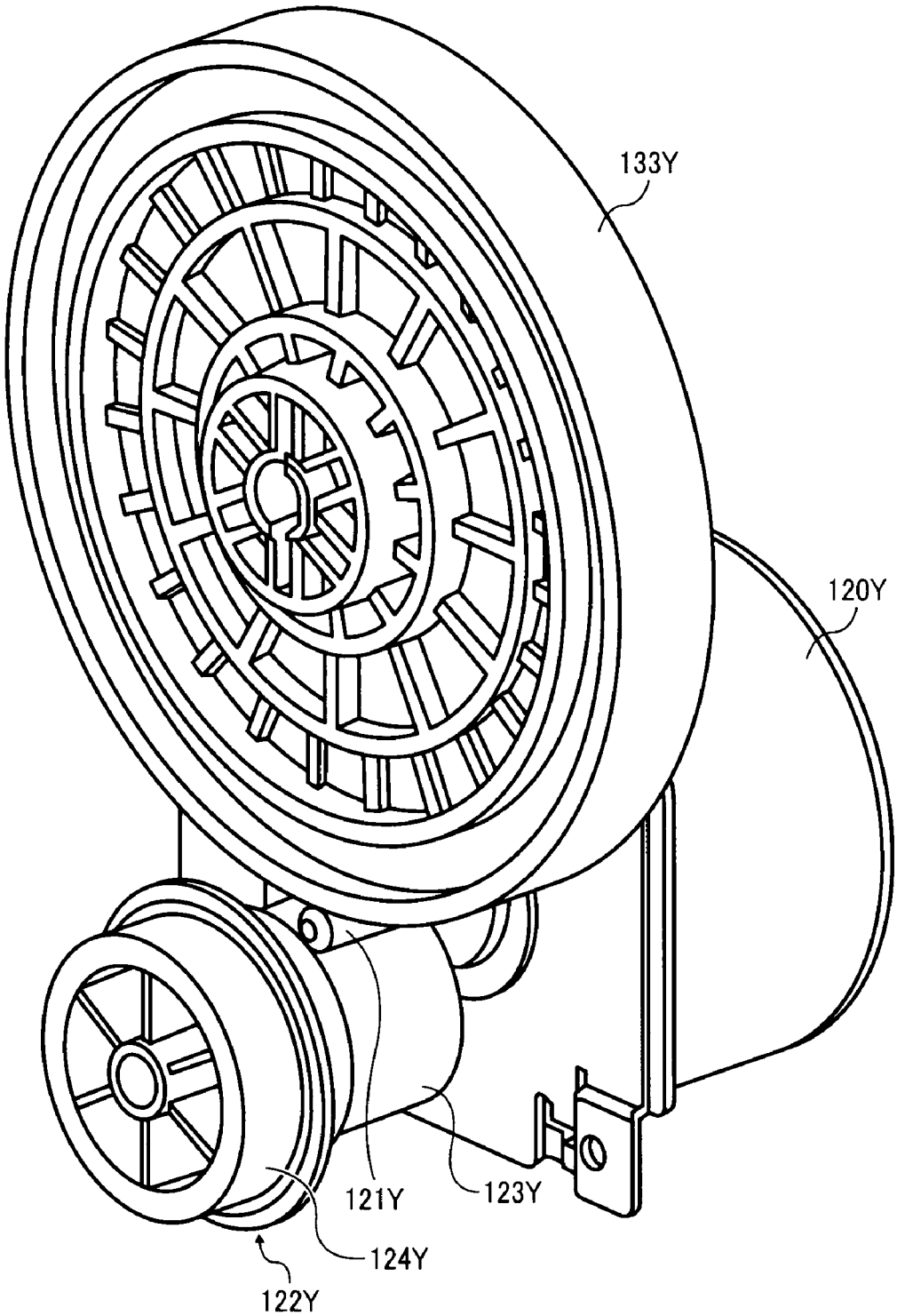
FIG. 8 is a perspective view of a photoconductor gear and its surrounding configuration.

FIG. 8 is a perspective view of the photoconductor gear 133Y and its surrounding configuration.

As shown in FIG. 8, the drive gear 121Y meshes the first gear 123Y of the developing gear 122Y, and the photoconductor gear 133Y.

With such configuration, the photoconductor gear 133Y, used as drive force transmitting member, may be rotatable by the drive force transmitting configuration of the printer 100. In the first exemplary embodiment, a diameter of the photoconductor gear 133Y is set greater than a diameter of the photoconductor 3. When the process drive motor 120Y rotates, a rotation force of the process drive motor 120Y is transmitted to the photoconductor gear 133Y via the drive gear 121 with one-stage speed reduction, by which the photoconductor 3 rotates.

A similar configuration may be applied to other process units 1C, 1M, and 1K in the printer 1000. Therefore, four sets of gears including the drive gear 121 and the photoconductor gear 133 are applied to each of the process units 1Y, 1C, 1M, and 1K in the printer 1000.

A shaft of the photoconductor 3 in the process unit 1 may be connected to the photoconductor gear 133 with a coupling, not shown, attached to one end of the shaft of photoconductor 3. The photoconductor gear 133 may be supported by an internal configuration of the printer 1000, for example. In the above description, one motor (e.g., the process drive motor 120) may be used for driving gears. Alternatively, a plurality of motors may be used for driving gears. For example, a motor for driving the photoconductor gear 133, and a motor for driving the drive gear 121 may be a different motor for each of the process unit 1Y, 1C, 1M, and 1K.

Hereinafter, a configuration for controlling an image forming in the printer 1000 is described.

Figure 9:
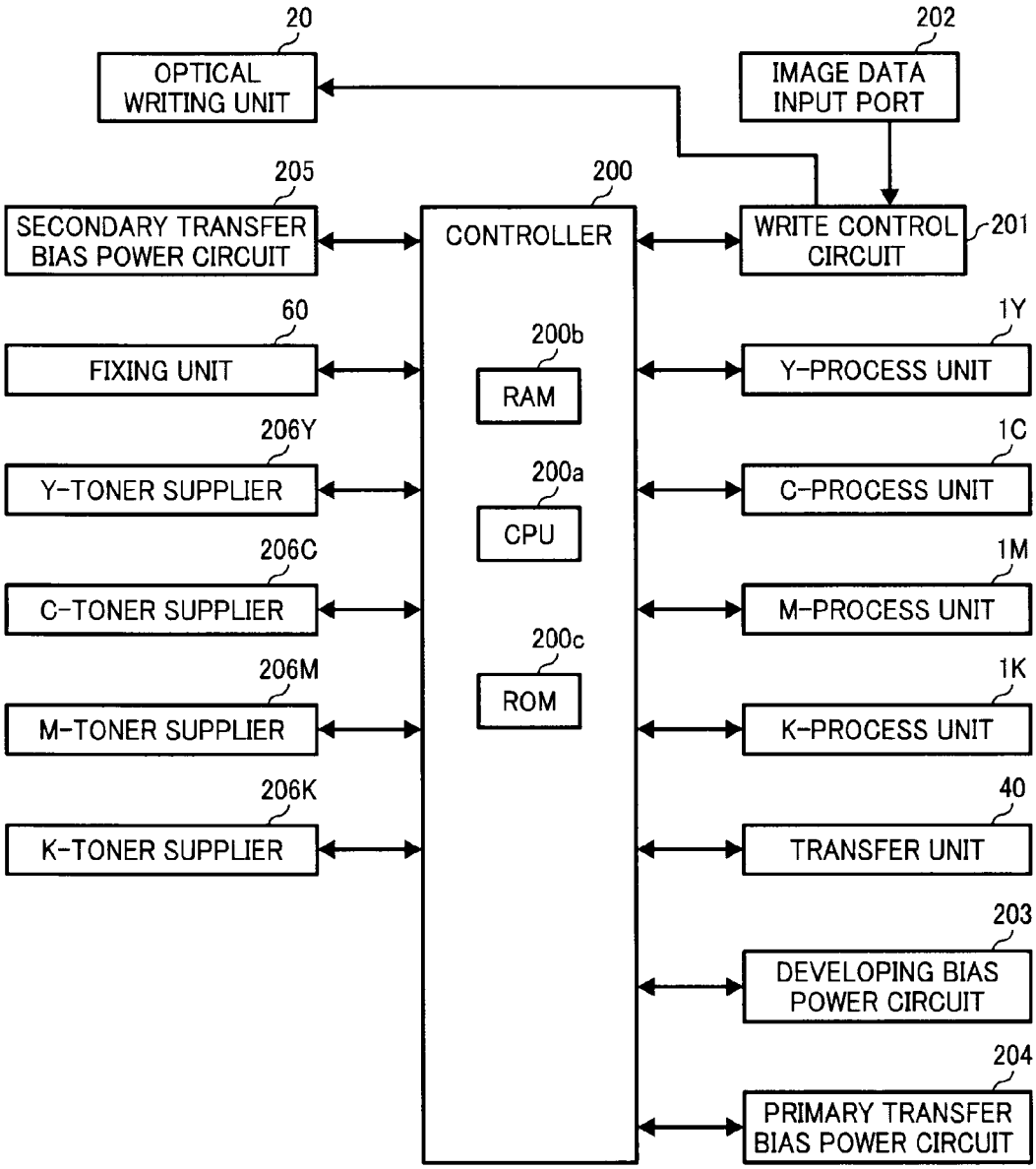
FIG. 9 is a block diagram explaining a circuit configuration of a controller of the image forming apparatus of FIG. 1.

FIG. 9 is a block diagram of a main part of an electrical circuit of the printer 1000.

In FIG. 9, the controller 200 includes a central processing unit or CPU 200*a*, a random access memory or RAM 200*b*, a read-only memory or ROM 200*c*, and so forth, and controls driving of the process units 1Y, 1C, 1M, and 1K, the transfer unit 40, a developing bias power circuit 203, a primary transfer bias power circuit 204, a secondary transfer bias power circuit 205, the fixing unit 60, a Y-toner supplier 206Y, a C-toner supplier 206C, a M-toner supplier 206M, and a K-toner supplier 206K.

The developing bias power circuit 203 outputs developing biases to the developing sleeve 22 for each of yellow, cyan, magenta, and black toners, based on each control signal sent from the controller 200.

The primary transfer bias power circuit 204 outputs respective primary transfer biases according to the primary transfer rollers 45Y, 45C, 45M, and 45K, based on each control signal sent from the controller 200.

The secondary transfer bias power circuit 205 outputs a secondary transfer bias according to the secondary transfer roller 50, based on a control signal sent from the controller 200.

The Y-toner supplier 206Y, C-toner supplier 206C, M-toner supplier 206M, and K-toner supplier 206K supply yellow toner, cyan toner, magenta toner, and black toner, respectively, based on each control signal sent from the controller 200.

As shown in FIG. 9, the printer 1000 further includes an image data input port 202, which receives image data sent from an external personal computer, etc. The image data received by the image data input port 202 is input to the controller 200 via a write control circuit 201. The write control circuit 201 controls driving of the optical writing unit 20 based on the image data.

FIG. 10 illustrates a flowchart of a control of a forced toner consumption determination process executed by the controller 200.

In step S1, the controller 200 calculates respective output image areas of yellow, cyan, magenta, and black toners per print sheet, based on the image data transmitted from the write control circuit 201. Hereinafter, the yellow toner, cyan toner, magenta toner, and black toner are also referred to as Y-toner, C-toner, M-toner, and K-toner, respectively.

In step S2, the controller 200 determines whether the Y-toner output image area is smaller than a given threshold.

When the output image area of Y-toner is smaller than the given threshold, which is YES in step S2, the controller 200 calculates and stores an amount of forcibly consuming Y-toner according to the Y-toner output image area in step S3, sets a Y-toner consumption flag in step S4, and the process proceeds to step S5.

When the Y-toner output image area is equal to or greater than the given threshold, which is NO in step S2, the controller 200 determines whether the C-toner output image area is smaller than a given threshold, in step S5.

When the output image area of C-toner is smaller than the given threshold, which is YES in step S5, the controller 200 calculates and stores an amount of forcedly consuming C-toner according to the C-toner output image area in step S6, sets a C-toner consumption flag in step S7, and the process proceeds to step S8.

When the C-toner output image area is equal to or greater than the given threshold, which is NO in step S5, the controller 200 determines whether the M-toner output image area is smaller than a given threshold, in step S8.

When the output image area of M-toner is smaller than the given threshold, which is YES in step S8, the controller 200 calculates and stores an amount of forcedly consuming M-toner according to the M-toner output image area in step S9, sets a M-toner consumption flag in step S10, and the process proceeds to step S11.

When the M-toner output image area is equal to or greater than the given threshold, which is NO in step S8, the controller 200 determines whether the K-toner output image area is smaller than a given threshold, in step S11.

When the output image area of K-toner is smaller than the given threshold, which is YES in step S11, the controller 200 calculates and stores an amount of forcedly consuming K-toner according to the K-toner output image area in step S12, sets a K-toner consumption flag in step S13, and the process ends.

When the K-toner output image area is equal to or greater than the given threshold, which is NO in step S11, the process ends.

Figure 11:
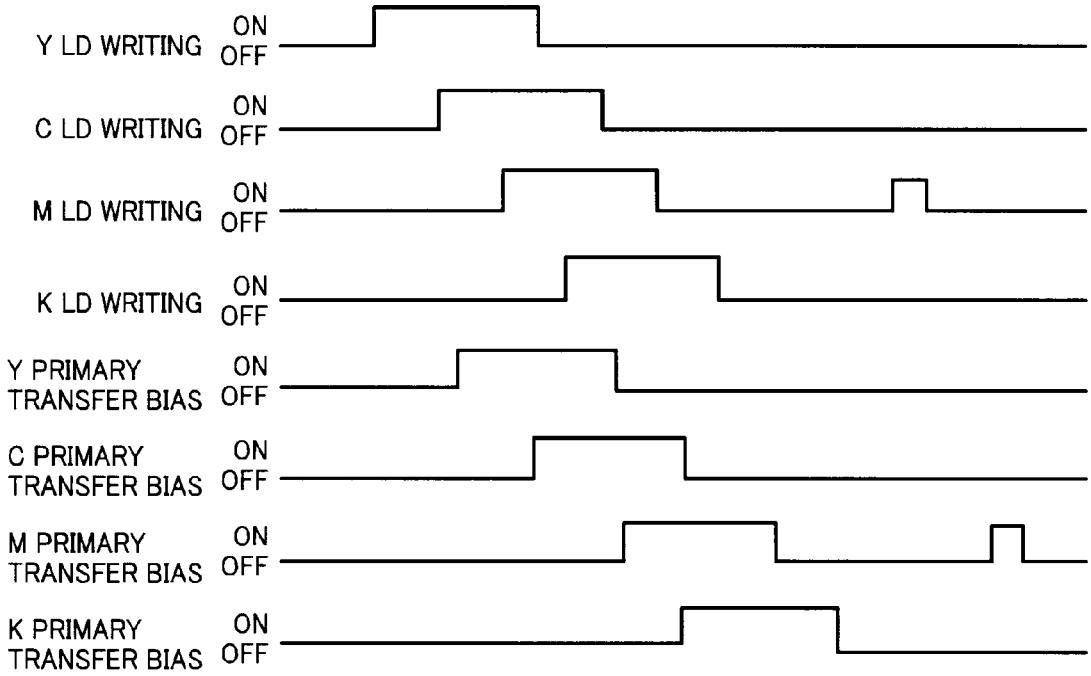
FIG. 11 is a drawing of timing charts explaining drive timings of components when a M-toner consumption flag is set.

FIG. 11 is an example of timing charts showing drive timings of the optical writing unit 20 and the primary transfer rollers 45Y, 45C, 45M, and 45K for a single job of producing one print in a full-color print mode of the printer 1000, when the M-toner consumption flag is set. In FIG. 11, each "LD writing" represents an optical writing process performed by the optical writing unit 20.

Shortly after the optical writing processes for the photoconductors 3Y, 3C, 3M, and 3K have started, respective primary transfer biases are applied to the primary transfer rollers 45Y, 45C, 45M, and 45K for a given time period. According to the application of the primary transfer biases, the Y-toner image, C-toner image, M-toner image, and K-toner image formed on the photoconductors 3Y, 3C, 3M, and 3K, respectively, are primarily transferred onto the intermediate transfer belt 41. After the primary transfer process has been completed, the optical writing process of the M-toner image only may be performed for a given time period. Accordingly, an electrostatic latent image for forcibly consuming M-toner is formed on the photoconductor 3M for developing a M-forcible toner consumption image.

After the M-forcible toner consumption image is formed as described above, the primary transfer bias may be applied to the primary transfer rollers 45M, so that the M-forcible toner consumption image can be primarily transferred onto the intermediate transfer belt 41. The M-forcible toner consumption image may be removed from the intermediate transfer belt 41 by the belt cleaning unit 42 serving as a remover shown in FIG. 1.

Each forcible toner consumption image of yellow, cyan, magenta, and black toners is formed in an area according to a corresponding amount of forcibly consuming toner calculated and obtained in the forced toner consumption determination process shown in FIG. 10. The greater a difference between an output image are and the above-described threshold is, the larger the forcible toner consumption images of yellow, cyan, magenta, and black toners are formed, and the more yellow, cyan, magenta, and black toners are forcibly consumed.

After the forcible toner consumption images of yellow, cyan, magenta, and black toners are formed and removed, the consumption flags of yellow, cyan, magenta, and black toners set in the forced toner consumption determination process are cancelled.

The timing chart in FIG. 11 shows an example in which the M-toner consumption flag is set. However, when a different consumption flag is set, a forcible toner consumption image for a corresponding color toner is formed on a corresponding photoconductor, transferred primarily onto the intermediate transfer belt 41, and removed by the belt cleaning unit 42.

In the printer 1000 having the above-described configuration, the residual yellow, cyan, magenta, and black toners remaining on the photoconductors 3Y, 3C, 3M, and 3K are removed, respectively, by a corresponding drum cleaning unit such as the drum cleaning unit 4Y, and conveyed to each developing unit such as the developing unit 7Y by a toner recycling mechanism such as the toner recycling mechanism 16Y, which enables a low cost performance.

Further, a forcible toner consumption image formed on a photoconductor is transferred onto the intermediate transfer belt 41, then removed by the belt cleaning unit 42. When the forcible toner consumption image is removed, toner particles, which are included in the forcible toner consumption image and may be excessively agitated, cannot be returned to the developing unit 7 via the drum cleaning unit 4 and the toner recycling mechanism 16. If the toner is not deteriorated in the developing unit 7, degradation of image quality can be reduced.

In the above-described example, the forcible toner consumption image is formed immediately before an end of a single job of producing one print. However, it is not limited to but the forcible toner consumption image can be formed during a print job of producing multiple prints. For example, in a serial print mode in which an image is continuously printed on multiple recording media, the forcible toner consumption image may be formed in an area between the trailing edge of one sheet and the leading edge of a subsequent sheet in a sheet travel direction on the surface of the photoconductor 3. For another example, the forced toner consumption process may be executed after the print job. For yet another example, while forming an output toner image based on image data in an image forming area of the photoconductor 3, an image for forcibly consuming toner may be formed in a non-image forming area, which has a width greater than a width of a recording medium having a maximum size, in the vicinity of both ends of an axial line of the photoconductor 3. In this case, the secondary transfer roller 50 may have an axial length that does not contact non-image forming areas formed at both axial ends of the intermediate transfer belt 41. Such secondary transfer roller 50 may not receive the forcible toner consumption image on a surface thereof but can remove the forcible toner consumption image by the belt cleaning unit 42.

As described above, toner can be forcibly consumed when the output image area per print sheet is calculated below the given threshold. However, it is not limited to but the forced toner consumption process can be executed based on an accumulated output image area accumulated or summed in a given period, when the accumulated output image area in a given number of prints is below the given threshold.

Further, the above-described printer 1000 is designed to form a full-color image. However, the present invention can also apply to an image forming apparatus or printer that forms only black-and-white images.

Further, the above-described printer 1000 employs a tandem system including multiple photoconductors each dedicated to a specific color toner to form a full-color image. However, the present invention can also apply to an image forming apparatus having one photoconductor to form a full-color image. For example, respective developing units for yellow, cyan, magenta, and black toners can be disposed around a single photoconductor, to sequentially form a Y-toner image, C-toner image, M-toner image, and K-toner image on the photoconductor, so as to sequentially transfer the toner images onto an intermediate transfer member to form a full-color image.

Further, the above-described printer 1000 employs an indirect transfer method in which the Y-toner image, C-toner image, M-toner image, and K-toner image formed on the photoconductor 3Y, 3C, 3M, and 3K, respectively, are sequentially transferred onto the intermediate transfer belt 41 to form a composite image, and the composite image is then transferred onto a recording sheet S. However, the present invention can apply to an image forming apparatus employing a direct transfer method in which the Y-toner image, C-toner image, M-toner image, and K-toner image formed on the photoconductors 3Y, 3C, 3M, and 3K, respectively, are directly transferred, as a primary transfer operation, onto a recording medium carried by a surface of an endless moving member such as a sheet conveyor belt. For the image forming apparatus with the above-described configuration, the forcible toner consumption images of yellow, cyan, magenta, and black toners may be transferred onto the surface of the endless moving member, instead of the recording medium.

When the printer 1000 is in the color print mode, all of the photoconductors 3Y, 3C, 3M, and 3K contact the surface of the intermediate transfer belt 41 to form primary transfer nips.

However, in some cases in the color print mode of the printer 1000, one or two of yellow, cyan, and magenta toners may not be output at all. Even in such cases, the photoconductors 3Y, 3C, and 3M may contact the intermediate transfer belt 41 and be rotated with the movement of the intermediate transfer belt 41 so that the surface of a formed image cannot be abraded due to the contact with the intermediate transfer belt 41. However, when the toner is not output, the developing unit 7 may not need to be driven. Therefore, when any toner of the yellow, cyan, and magenta toners is not output at all in the color print mode, it is preferable that the above-described developing clutch 127 (127Y, 127C, and/or 127M) of the corresponding color toner or toners is disengaged to stop driving the developing unit 7. By stopping idling of the developing unit 7 that the toner therein is not used in the job, deterioration of the toner can be reduced or prevented.

For enabling the low cost of manufacturing the printer 1000, the above-described developing clutch 127 may not be used but a tandem-type image forming apparatus in which the photoconductor 3 and the developing unit 7 are constantly drive in synchronization with each other has been used. However, in performing a print job in the color print mode with such configuration, when one or more of the yellow, cyan, and magenta toners is not output at all, the developing unit 7 containing the toner not to be output needs to drive, which can accelerates deterioration of toner. The present invention is effective to the above-described deterioration of toner.

Next, a description is given of more characteristic configuration and functions of the printer 1000 according to Examples 1 and 2 of the first exemplary embodiment of the present invention. The printer 1000 according to Examples 1 and 2 of the first exemplary embodiment includes additional characteristic configurations. Elements and members corresponding to those of the printer 1000 of the example shown in FIG. 1 are denoted by the same reference numerals and descriptions thereof are omitted or summarized. Although not particularly described, configurations of the printer 1000 and operations that are not particularly described in Examples 1 and 2 are the same as those of the printer 1000 of the example previously described with reference to FIG. 1.

EXAMPLE 1

In reference to FIG. 1, the forcible toner consumption images of yellow, cyan, magenta, and black toners are transferred from the photoconductors 3Y, 3C, 3M, and 3K to the intermediate transfer belt 41 in the primary transfer process, and pass a position opposite the secondary transfer roller 50 before a position for cleaning the toner by the belt cleaning unit 42. At this time, if the secondary transfer roller 50 serving as a contact member contacts the intermediate transfer belt 41 with the secondary transfer nip is formed, it is likely that the forcible toner consumption images of yellow, cyan, magenta, and black toners transfer to the secondary transfer roller 50.

Figure 12:
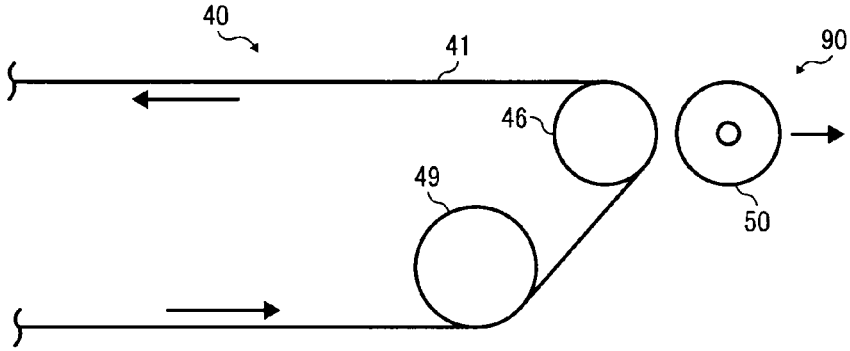
FIG. 12 is an enlarged view of a part of a transfer unit according to Example 1 of the first exemplary embodiment of the present invention.

To avoid the transfer of the forcible toner consumption images, a contact and separation unit 90 shown in FIG. 12 is provided to the printer 1000 according to Example 1 of the first exemplary embodiment.

The contact and separation unit 90 causes the secondary transfer roller 50 to contact to and separate from the intermediate transfer belt 41. The controller 200 forms forcible toner consumption images of yellow, cyan, magenta, and black toners on the photoconductors 3Y, 3C, 3M, and 3K at timings different from the output images of yellow, cyan, magenta, and black toners based on image data. At least at timings that the forcible toner consumption images of yellow, cyan, magenta, and black toners on the intermediate transfer belt 41 pass the secondary transfer nip, the contact and separation unit 90 causes the secondary transfer roller 50 to separate from the surface of the intermediate transfer belt 41, as shown in FIG. 12.

This configuration can prevent the forcible toner consumption images of yellow, cyan, magenta, and black toners from transferring onto the secondary transfer roller 50, thereby avoiding background contamination on the recording sheet S.

EXAMPLE 2

As described above, the printer 1000 according to Example 1 of the first exemplary embodiment can avoid the background contamination on the recording sheet S. In Example 2, instead of installing the contact and separation unit 90, the printer 1000 of Example 2 varies polarities of a secondary transfer bias, so that the overall machine size can be smaller.

Figure 13:
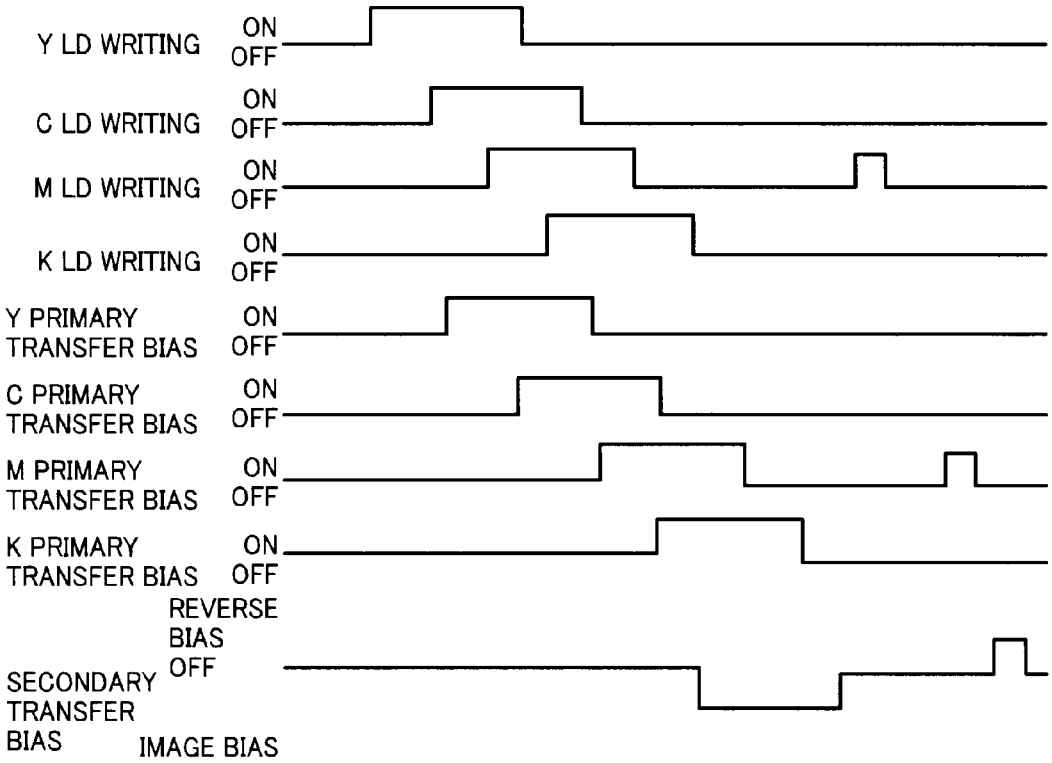
FIG. 13 is a drawing of timing charts explaining drive timings of components when a M-toner consumption flag is set according to Example 2 of the first exemplary embodiment of the present invention.

FIG. 13 illustrates an example of timing charts showing drive timings of the optical writing unit 20, the primary transfer rollers 45Y, 45C, 45M, and 45K, and the secondary transfer roller 50 for a single job of producing one print in a full-color print mode of the printer 1000, when the M-toner consumption flag is set.

Shortly after the optical writing processes for the photoconductors 3Y, 3C, 3M, and 3K have started, respective primary transfer biases are applied to the primary transfer rollers 45Y, 45C, 45M, and 45K for a given time period. According to the application of the primary transfer biases, the Y-toner image, C-toner image, M-toner image, and K-toner image formed on the photoconductors 3Y, 3C, 3M, and 3K are primarily transferred onto the intermediate transfer belt 41. After the primary transfer process has been completed, prior to the transfer of a composite toner image of the yellow, cyan, magenta, and black toner to the secondary transfer nip, the secondary transfer bias having a polarity opposite to a toner charge polarity is applied for a given period of time. This application of the secondary transfer bias generates an electrical field at and in the vicinity of the secondary transfer nip, and the electrical field electrostatically moves the toners from the surface of the intermediate transfer belt 41 to the secondary transfer roller 50. Accordingly, the full-color toner image formed on the intermediate transfer belt 41 may be transferred to the recording sheet S in the secondary transfer nip.

Shortly after the secondary transfer process as described above, the optical writing process relative to M-toner is conducted for a given period of time, so as to form an electrostatic latent image for forcibly consuming M-toner on the photoconductor 3M to develop a M-forcible toner consumption image. A primary transfer bias is applied to the primary transfer roller 45M, and the M-forcible toner consumption image is transferred onto the intermediate transfer belt 41 in the primary transfer process. Then, prior to the M-forcible toner consumption image proceeding to the position facing the secondary transfer roller 50, a secondary transfer reverse bias having the toner charge polarity is applied to the secondary transfer roller 50. Accordingly, a reverse electrical field that electrostatically moves the toner from the secondary transfer roller 50 to the surface of the intermediate transfer belt 41 is formed at or in the vicinity of the secondary transfer nip, so that the full-color toner image formed on the intermediate transfer belt 41 cannot be reversely transferred to the secondary transfer roller 50.

As described above, the secondary transfer bias having the polarity opposite the toner charge polarity is applied to the secondary transfer roller 50 to generate the secondary transfer electrical field in a forward direction, and at the same time the secondary transfer bias having the toner charge polarity is also applied to the secondary transfer roller 50 to generate the reverse electrical field in the secondary transfer nip. However, a method of generating the secondary transfer electrical field in a forward direction and/or the reverse electrical field, including, but not limited to the above-described method. For example, the reverse electrical field can be generated by stopping the application of the secondary transfer bias to the secondary transfer roller 50 and by applying a bias having the polarity opposite to the toner charge polarity to the secondary transfer backup roller 46. For another example, when a bias having the polarity opposite to the toner charge polarity is applied to the secondary transfer backup roller 46, the secondary transfer electrical field may be generated at the secondary transfer nip in the forward direction.

Figure 14:
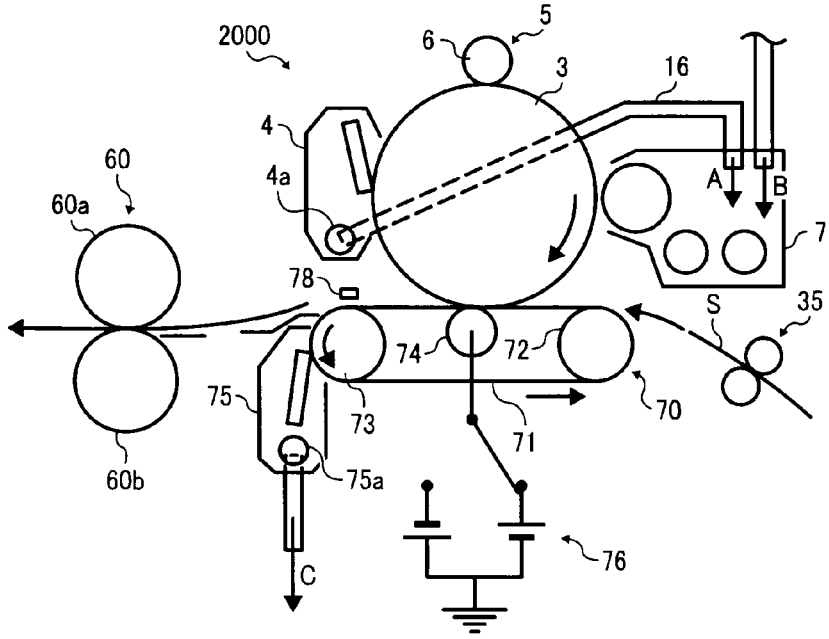
FIG. 14 is a schematic configuration of an internal portion of an image forming apparatus according to a second exemplary embodiment of the present invention.

Next, a schematic configuration of a printer 2000 is described according to a second exemplary embodiment of the present invention, in reference to FIG. 14.

The printer 2000 of FIG. 14 includes a drum-shaped photoconductor 3 serving as an image carrier, a charging unit 5, a developing unit 7, a sheet transfer unit 70, a drum cleaning unit 4 serving as a remover, and so forth.

The photoconductor 3 is rotated by a drive unit, not shown, in a clockwise direction in FIG. 14. The charging unit 5, developing unit 7, sheet transfer unit 70, and drum cleaning unit 4 are disposed around the photoconductor 3.

The charging unit 5 includes a charging roller 6 that is rotated while a charge bias is applied thereto by a charge bias power circuit, not shown. The charging roller 6 is disposed in the vicinity of the photoconductor 3 or is held in contact with the photoconductor 3. By charging electricity between the charging roller 6 and the photoconductor 3, a surface of the photoconductor 3 is uniformly charged to a negative polarity or minus polarity, which is same as a given toner charge polarity. The given toner charge polarity represents a polarity of an average charge volume of toner contained in the developing unit 7 and agitated adequately. The average charge voltage can be measured by a toner charge distribution measuring instrument. Further, the charge bias corresponds to an alternating current voltage superimposed by a direct current voltage. A charging brush can be used in place of the charging roller 6. A charger method can be employed to uniformly charge the surface of the photoconductor 3, such as a scorotron charger.

The printer 2000 includes an image data receiving unit, not shown, and an optical writing unit, not shown.

The image data receiving unit receives image data transmitted from a personal computer or PC, not shown, or a scanner. The optical writing unit generates a laser light beam for optical writing based on the image data received by the image data receiving unit, so as to expose the surface of the photoconductor 3. The configuration of the optical writing unit is substantially same as the optical writing unit 20 of the printer 1000 shown in FIG. 1, for example.

After the charging unit 5 has uniformly charged the surface of the photoconductor 3 to the negative polarity, the optical writing unit that generates and emits a laser light beam based on the image data received by the image data receiving unit exposes the surface of the photoconductor 3 to form an electrostatic latent image thereon. The developing unit 7 that accommodates developer including black toner and magnetic carriers develops the electrostatic latent image into a black toner image. The configuration of the developing unit 7 is substantially same as the developing unit 7Y of the printer 1000 shown in FIG. 1, for example.

The sheet transfer unit 70 serving as a transfer unit includes an endless sheet transfer belt 71, a driven roller, a drive roller 73, a transfer roller 74, a transfer bias power circuit 76, and so forth.

The endless sheet transfer belt 71 that serves as a moving member is extended by the driven roller 72 and the drive roller 73, and is rotated by rotations of the drive roller 73 in a counterclockwise direction in FIG. 14. Inside a loop of the sheet transfer belt 71, the transfer roller 74 to which the transfer bias power circuit 76 applies a transfer bias is disposed, while sandwiching the sheet transfer belt 71 between the transfer roller 74 and the photoconductor 3. With the above-described configuration of the printer 2000, the outer surface of the sheet transfer belt 71 and the circumferential surface of the photoconductor 3 may contact each other to form a transfer nip.

A pair of registration rollers 35 is disposed at the right-hand side of the sheet transfer unit 70 in FIG. 14. The pair of registration rollers 35 stops and holds a recording medium or a recording sheet S transferred from the a sheet feeding cassette, not shown, therebetween, and sends the recording sheet S to the upper extended surface of the sheet transfer belt 71 at a timing to receive a toner image formed on the photoconductor 3 at the transfer nip. The recording sheet S transferred from the pair of registration rollers 35 is attracted electrostatically by the upper extended surface of the sheet transfer belt 71, and moves to the transfer nip according to the movement of the sheet transfer belt 71.

Prior to the entrance of the recording sheet S to the transfer nip, the transfer bias power source 76 of the sheet transfer unit 70 applies a transfer bias having a positive polarity, which is a polarity opposite to the given toner charge polarity, to the transfer roller 74. The application of the transfer bias causes a transfer current with the positive polarity to flow from the transfer roller 74 to the inner surface of the sheet transfer belt 71, and the toner image formed on the photoconductor 3 is transferred onto the recording sheet S in the transfer nip. That is, when an output toner image formed on the photoconductor 3 according to the image data is transferred onto the recording sheet S carried by the sheet transfer belt 71, the sheet transfer unit 70 serving as a transfer unit charges the sheet transfer belt 71 to the polarity opposite to the given toner charge polarity. Accordingly, an electrical field providing an electrostatic force from the surface of the photoconductor 3 to the outer surface of the sheet transfer belt 71 is formed between the photoconductor 3 and the sheet transfer belt 71, so that the electrostatic force may be provided to toner particles charged to the given toner charge polarity or the negative polarity on the surface of the photoconductor 3.

The recording sheet S that has passed the transfer nip according to the movement of the surface of the sheet transfer belt 71 is separated from the sheet transfer belt 71 at a portion where the sheet transfer belt 71 is extended by the drive roller 73 due to a curvature separation or by a separator, not shown, and is conveyed to a fixing unit 60.

The fixing unit 60 includes a fixing roller 60*a* including a heater such as halogen lamp therein, and a pressure roller 60*b* pressing contact with the fixing roller 60*a*. The fixing roller 60*a* and the pressure roller 60*b* form a fixing nip therebetween.

The recording sheet S conveyed from the sheet transfer belt 71 to the fixing unit 60 is sandwiched by the fixing nip so that the output toner image on the recording sheet S can be fixed onto the surface of the recording sheet S by action of nip pressure and heat. The recording sheet S to which the output toner image is fixed is conveyed via a pair of discharging rollers, not shown, to outside of the printer 1000.

Residual toner remaining on the surface of the photoconductor 3 even after the recording sheet S has passed may be removed from the surface of the photoconductor 3 by the drum cleaning unit 4 serving as a remover. After the removal, the residual toner is conveyed by a collection screw 4*a* in the drum cleaning unit 4 to a far end portion of the drum cleaning unit 4, which is a portion located at a far end in a direction perpendicular to the drawing sheet. The residual toner is then conveyed to a toner recycling mechanism 16.

The toner recycling mechanism 16 serves as a toner recycling unit, and conveys the toner received by the drum cleaning unit 4 to the developing unit 7, as indicated by arrow A as shown in FIG. 14. Accordingly, the residual toner removed from the surface of the photoconductor 3 is returned to the developing unit 7 for reusing and recycling.

In the second exemplary embodiment, a toner recycling mechanism having a configuration substantially same as the toner recycling mechanism 16 of FIG. 2 according to the first exemplary embodiment can be also applied. Further, the toner recycling mechanism 16 can include a rotary member such as an auger in a conveying tube to convey toner according to rotations of a rotary member. This configuration can also be applied to the printer 1000 of FIG. 2 according to the first exemplary embodiment.

The developer contained in the developing unit 7 may be same as the developer used in the printer 1000 according to the first exemplary embodiment, so that toner contained in a toner cartridge, not shown, can be supplied at an appropriate timing, which is indicated by arrow B in FIG. 14.

Figure 15:
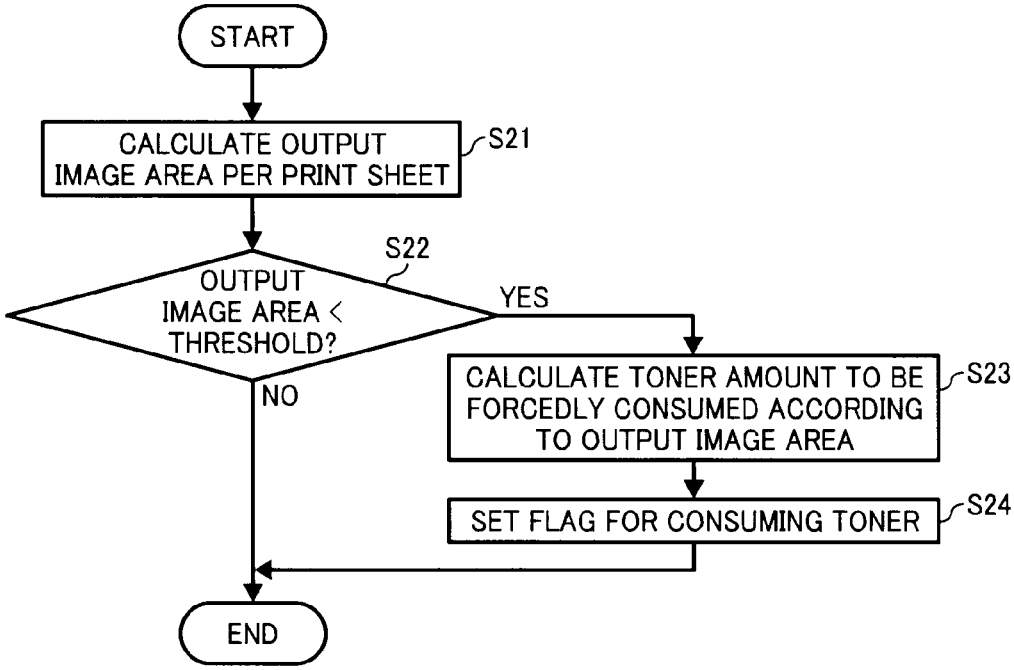
FIG. 15 is a flowchart of a forced toner consumption determination process executed by a controller of the image forming apparatus of FIG. 14.

FIG. 15 illustrates a flowchart of a forced toner consumption determination process executed by the controller of the printer 2000 according to the second exemplary embodiment of the present invention, similar to the controller 200 of the printer 1000 of the first exemplary embodiment of the present invention. Since the configuration of the controller of the printer 2000 according to the second exemplary embodiment of the present invention is same as the configuration of the controller 200 (see FIG. 9) of the printer 1000 according to the first exemplary embodiment of the present invention, the identical reference numeral "200" is hereinafter attached to the controller of the printer 2000.

As shown in step S21 of FIG. 15, the controller 200 of the printer 2000 according to the second exemplary embodiment of the present invention calculates an output image area per print sheet, based on image data transmitted from a write control circuit, not shown.

The controller 200 determines whether the calculated toner output image area is smaller than a given threshold, in step S22. That the output image area is smaller than the given threshold means that the size of the output image area and the amount of the toner consumption are insufficient, which indicates that the toner is excessively agitated and deteriorated in the developing unit 7.

When the calculated output image area is smaller than the given threshold, which is YES in step S22, the controller 200 calculates and stores an amount of forcedly consuming toner according to the toner output image area in step S23, and sets a toner consumption flag in step S24.

When the toner output image area is equal to or greater than the given threshold, which is NO in step S22, the controller 200 completes the process.

When the toner consumption flag is sent, the forcible toner consumption image can be formed on the surface of the photoconductor 3 after a completion of one print job. When a print job in which an image is printed onto multiple recording media continuously, the continuous print job can be temporarily suspended to form the forcible toner consumption image on the surface of the photoconductor 3 between two print sheets that travel in a sequential order. The forcible toner consumption image is formed to a toner output image area and toner concentration according to the amount of forcedly consuming toner calculated in the forced toner consumption determination process. Specifically, as a difference between the output image area and the given threshold is greater, the forcible toner consumption image becomes greater so as to discharge a greater amount of forcibly consuming toner from the developing unit 7.

Figure 16:
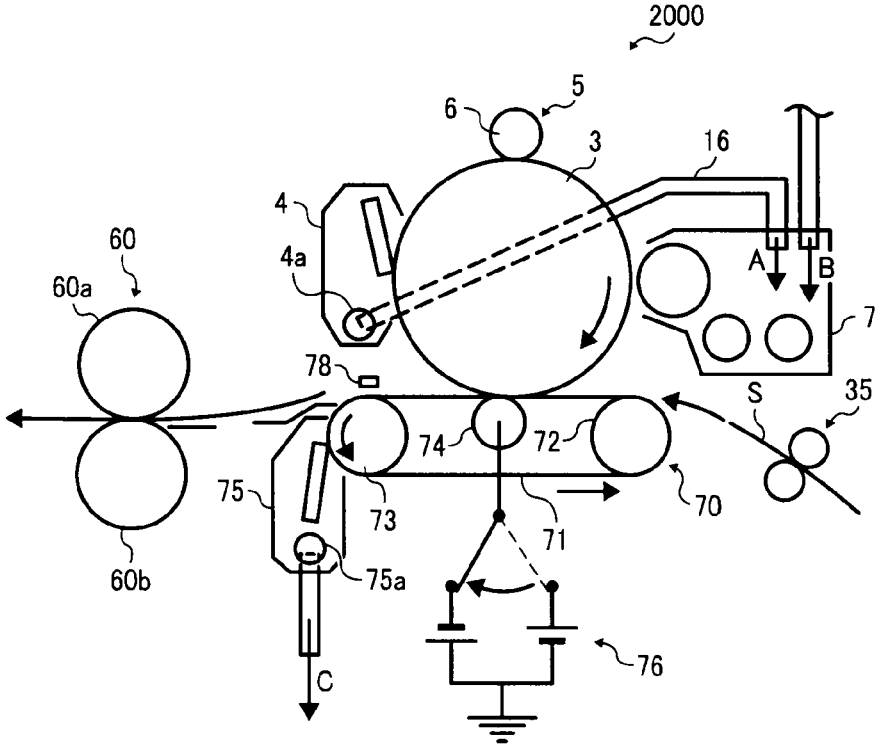
FIG. 16 is a schematic view of the image forming apparatus of FIG. 14 during a forced toner consumption process.

FIG. 16 illustrates a schematic configuration of the printer 2000 during a forced toner consumption process.

As shown in FIG. 16, the forced toner consumption process may be executed while the recording sheet S is not traveling in the conveying path of the printer 2000. The forcible toner consumption image formed on the photoconductor 3 moves to the transfer nip in synchronization with the rotations of the photoconductor 3. Prior to the movement of the forcible toner consumption image to the transfer nip, the transfer bias power circuit 76 of the sheet transfer unit 70 may apply a toner consumption transfer bias to the transfer roller 74. The toner consumption transfer bias may have a polarity identical to the given toner charge polarity, which is a negative or minus polarity. Thus, the controller 200 causes a transfer current of the minus polarity to flow from the transfer roller 74 onto the back side of the sheet transfer belt 71. That is, when the forcible toner consumption image is transferred from the surface of the photoconductor 3 onto the sheet transfer belt 71, the sheet transfer unit 70 serving as a transfer unit may give a same charge polarity as the given toner charge polarity to the sheet transfer belt 71. Accordingly, an electrical field exerting a force of static electricity from the surface of the photoconductor 3 to the front surface of the sheet transfer belt 71 is build between the photoconductor 3 and the sheet transfer belt 71.

Figure 17:
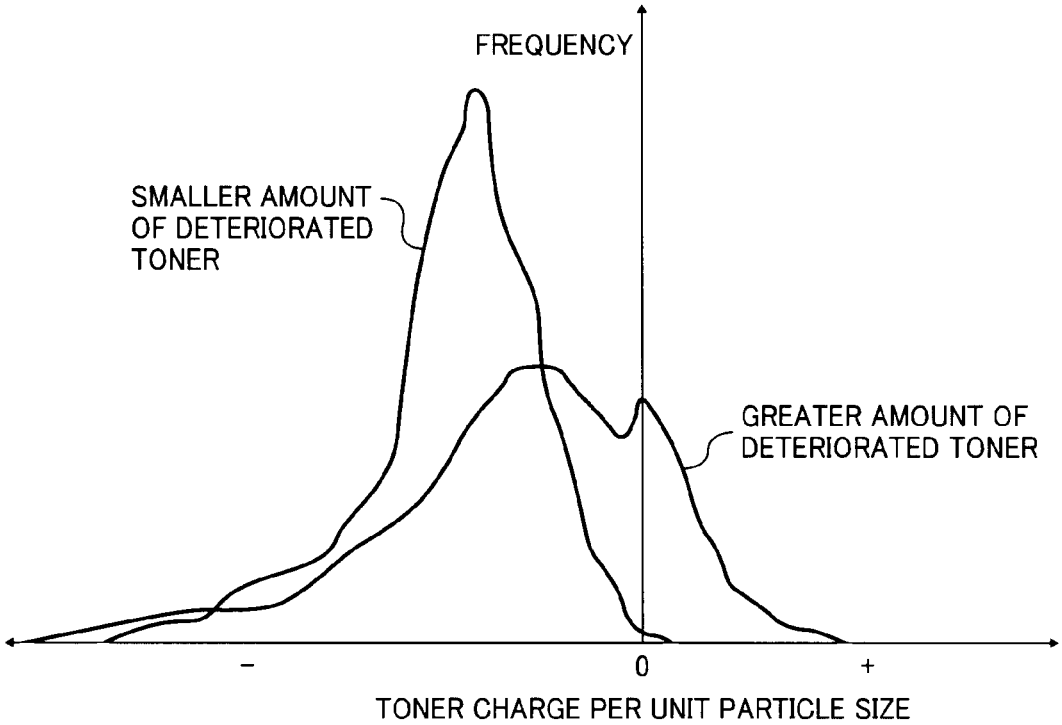
FIG. 17 is a graph showing a charge distribution of charged toner particles.

In order to exert appropriate electrical charge and flowability, an additive agent such as silica is added onto a surface of each toner particle in the toner used for development. When the additive agent is adsorbed to the surface of each toner particle, the toner particle can be charged properly. However, when being agitated excessively, toner particles in the developing unit 7 may be stressed repeatedly, which can result in degrade or deterioration of the toner particles. The excessive agitation may cause the additive agent to be separated or removed from the surface of the toner particle or to be embedded into a mother material of the toner particle. Such deteriorated toner particle may significantly reduce a charge amount to the given toner charge polarity or charge to the opposite polarity to the given toner charge polarity, as shown in FIG. 17. Further, since the deteriorated toner particle has flowability smaller than a normal toner particle, the toner particles can be easily aggregated. Therefore, when passing through the transfer nip, the deteriorated toner particles may not be transferred onto the sheet transfer belt 71 but easily remain on the surface of the photoconductor 3. It is more likely that the residual deteriorated toner remaining on the surface of the photoconductor 3 after the transfer nip is cleaned and conveyed back to the developing unit 7 for recycling and reusing.

To prevent the deteriorated toner from returning to the developing unit 7, when the forcible toner consumption image moves to the transfer nip with a movement of the surface of the photoconductor 3, the printer 2000 may apply a forced toner consumption transfer bias having a same polarity as the given toner charge polarity, which is the negative or minus polarity in FIG. 17, to the transfer roller 74. By applying the negative polarity to the transfer roller 74, deteriorated toner particles in the forcible toner consumption image may be transferred from the photoconductor 3 to the sheet transfer belt 71 while non-deteriorated toner particles that are charged to the negative polarity in the forcible toner consumption image can remain on the surface of the photoconductor 3 at the transfer nip. If the deteriorated toner particles are transferred onto the sheet transfer belt 71, a belt cleaning unit 75 serving as a remover may remove the deteriorated toner particles from the surface of the sheet transfer belt 71. The removed deteriorated toner particles are conveyed by a discharging screw 75*a* provided in the belt cleaning unit 75 is conveyed to an end portion of the belt cleaning unit 75, which is located at a far end in a direction perpendicular to the drawing sheet of FIG. 16, and is conveyed as indicated by arrow C in FIG. 16 into a wasted toner bottle, not shown.

By contrast, non-deteriorated toner particles remaining on the surface of the photoconductor 3 may be removed therefrom, and are conveyed back to the developing unit 7 by the toner recycling mechanism 16. By so doing, the non-deteriorated toner particles can be reused effectively. When the above-described forced toner consumption process is completed, the controller of the printer 2000 cancels the toner consumption flag.

As described above, the printer 2000 according to the second exemplary embodiment forms the forcible toner consumption image to consume the deteriorated toner particles from the developing unit 7 to the surface of the photoconductor 3, transfers the forcible toner consumption image onto the sheet transfer belt 71 at the transfer nip, and removes the residual toner remaining on the sheet transfer belt 71 by the belt cleaning unit 75. The above-described series of actions can prevent degradation of image quality due to accumulation of deteriorated toner particles in the developing unit 7. Further, the printer 2000 causes non-deteriorated toner particles adhering to the forcible toner consumption image to stay on the surface of the photoconductor 3 so as to return the non-deteriorated toner particles from the drum cleaning unit 4 via the toner recycling mechanism 16 to the developing unit 7. Therefore, compared to the printer 1000 according to the first exemplary embodiment of the present invention, unnecessary removal or consumption of the non-deteriorated toner particles while using the forcible toner consumption image can be more reduced. That is, the printer 2000 uses the forcible toner consumption image to forcibly consume the toner from the developing unit 7, to selectively transfer only the deteriorated toner particles of the overall toner particles on the forcible toner consumption image from the photoconductor 3 to the sheet transfer belt 71, and at the same time to collect the non-deteriorated toner particles by the drum cleaning unit 4 for recycling. Accordingly, unnecessary removal or discarding of the non-deteriorated toner particles can be more reduced.

FIG. 17 is a graph showing a charge distribution of charged toner particles. Specifically, the graph shows the result of actual measurement of the charge distribution in which the toner consumed from the developing unit 7 is measured by a measuring instrument, E-SPART ANALYZER EST-3 manufactured by Hosokawa Micron Corporation.

Alternative to the forced toner consumption process illustrated in the flowchart of FIG. 15, a different process to determine the necessity consumption of the toner in the developing unit 7 can be applied. For example, a process in which the controller 200 of the printer 2000 measures the development ability of the image forming mechanism thereof, and determines the necessity of toner consumption based on the result of the above measurements can be applied. Specifically, the printer 2000 includes the photoconductor 3, the charging unit 5, the developing unit 7, the optical writing unit 20, and the like, and has the development ability is represented by a development γ indicated by a slope in a graph showing a relation of development potential and toner adhesion per unit area. The development potential means a difference in potential of an electrostatic latent image formed on the surface of the photoconductor 3 and the surface of the development sleeve 22 to which the developing bias is applied.

The development γ is measured at a given timing as follows. The printer 2000 forms a pattern image that includes multiple solid toner images. The patterns of the multiple solid toner images are different from each other and have approximately 5 $cm^2$. Then, the pattern image is formed on the surface of the photoconductor 3, and transferred onto the sheet transfer belt 71.

The printer 2000 further includes a reflective photosensor 78 over the sheet transfer belt 71, where the inner surface thereof contacts the drive roller 73, as shown in FIGS. 14 and 16. The reflective photosensor 78 detects the toner adhesion per unit area on each solid toner image of the pattern image.

Figure 18:
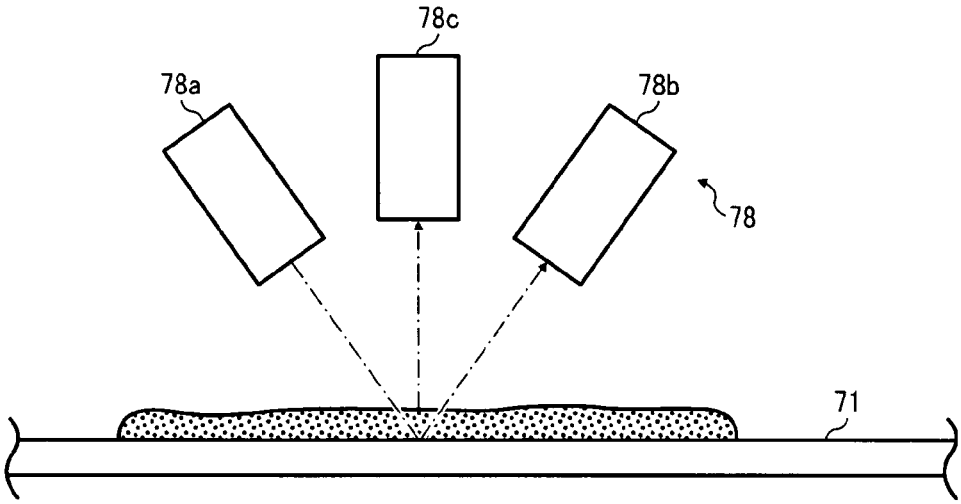
FIG. 18 is an enlarged schematic view of a reflective photosensor with respect to a belt member.

As shown in FIG. 18, the reflective photosensor 78 includes a light emitting element 78*a*, a specular reflection-type light receiving element 78*b*, and a diffuse reflection-type light receiving element 78*c*.

The light emitting element 78*a* emits light to the solid toner image formed on the sheet transfer belt 71. The specular reflection-type light receiving element 78*b* receives specular reflected light or specular light reflected on the sheet transfer belt 71. The diffuse reflection-type light receiving element 78*c* receives diffuse reflected light or diffuse light reflected on the solid toner image. The amount of toner adhesion per unit area with respect to the solid toner image can be obtained based on an amount of light received by the specular reflection-type light receiving element 78*b* and an amount of light received by the diffuse reflection-type light receiving element 78*c*.

The controller 200 of the printer 2000 calculates an approximate straight line indicating a relation of the amount of toner adhesion with respect to each solid toner image and the development potential, and defines the slope of the approximate straight line as the development γ. When such development γor the slope of the approximate straight line is smaller than a given threshold, it is determined that the deteriorated toner particles are accumulated in the developing unit 7, and therefore it is highly likely that a target amount of toner has not been transferred onto the sheet transfer belt 71 at the transfer nip.

Figure 19:
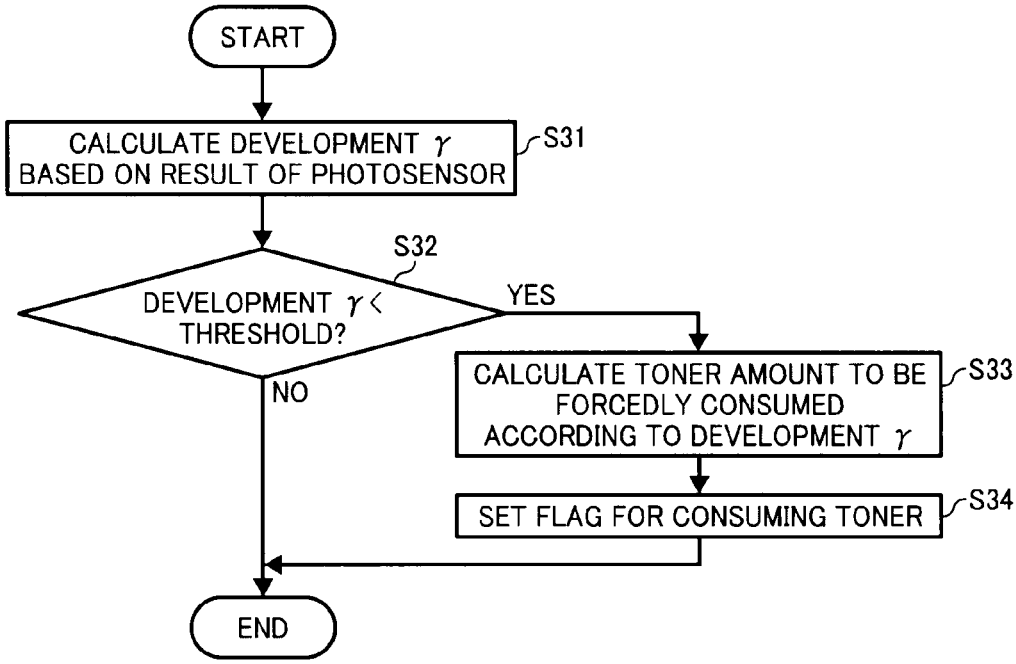
FIG. 19 is a flowchart of a different forced toner consumption determination process executed by the controller of the image forming apparatus of FIG. 14.

FIG. 19 illustrates a flowchart of a forced toner consumption determination process performed by the controller 200 of the printer 2000 according to the second exemplary embodiment of the present invention. The forced toner consumption determination process in the flowchart of FIG. 19 is executed after the above-described pattern image that is formed on the surface of the photoconductor 3 at the given timing is transferred onto the sheet transfer belt 71.

As shown in step S31 of FIG. 19, the controller 200 of the printer 2000 according to the second exemplary embodiment of the present invention calculates the development γ based on the detection result obtained by the reflective photosensor 78 and the development potential of each solid toner image of the pattern image.

The controller 200 determines whether the calculated development γ is smaller than a given threshold, in step S32.

When the calculated development γ is smaller than the given threshold, which is YES in step S32, the controller 200 calculates and stores an amount of forcedly consuming toner according to the development γ in step S33, and sets a toner consumption flag in step S34.

Similar to the printer 2000, the above-described toner consumption determination process can be applied to the printer 1000. For example, the printer 1000 can determine the necessity toner consumption of each color based on the development γ of each toner color.

When an image passes the transfer nip, a given absolute charging value may be applied from the transfer roller 74 to the sheet transfer belt 71. The printer 2000 sets an absolute charging value applied to the forcible toner consumption image smaller than an absolute charging value applied to an output toner image for a regular transfer process. Specifically, when the output toner image passes the transfer nip during the regular transfer operation, an effective transfer current that flows from the sheet transfer belt 71 to the photoconductor 3 is set to a constant current of +30 μA. By contrast, when the forcible toner consumption image passes the transfer nip during the forced toner consumption process, the effective transfer current that flows from the sheet transfer belt 71 to the photoconductor 3 is set to a constant current of −20 μA.

When a value of effective transfer current or intensity of electrical field for transfer is set to an appropriate value to obtain preferable transfer efficiency, electrical discharge may be caused in the transfer nip. When the toner adhering to the recording medium moving to the transfer nip includes a relatively small percentage of deteriorated toner particles, each toner particle is not degraded and has a sufficient charge amount. Therefore, the electrical discharge may not affect the charge polarity of the toner particles, i.e., may change the charge polarity of only a significantly small amount of toner particles to the polarity opposite to the given toner charge polarity. In addition, the significantly small amount of toner particles that has been charged opposite to the given toner charge polarity may be returned to the developing unit 7 for recycling.

By contrast, the oppositely charged toner particles included in the forcible toner consumption image are not charged sufficiently to the opposite polarity. Therefore, when the electrical discharge occurs in the transfer nip, the oppositely charged toner particles may easily be charged to the given toner charge polarity, and as a result, may remain on the surface of the photoconductor 3 without being transferred onto the sheet transfer belt 71 in the transfer nip and be returned to the developing unit 7. Further, fresh toner particles can be used for development immediately after being supplied and not sufficiently charged in the developing unit 7. If such new, non-deteriorated toner particles are charged to the polarity opposite to the given toner charge polarity due to the electrical discharge in the transfer nip, the non-deteriorated toner particles can be transferred onto the sheet transfer belt 71, and conveyed via the belt cleaning unit 75 to the wasted toner bottle 71. Accordingly, when the forcible toner consumption image is conveyed to the transfer nip, the absolute charging value applied to the forcible toner consumption image may be set to a smaller value compared to the absolute charging value for the regular transfer process.

Accordingly, the above-described configuration of the printer 2000 can prevent from reusing deteriorated toner particles induced by the electrical discharge in the transfer nip and causing unnecessary disposal of non-deteriorated toner particles.

In the printer 2000, the sheet transfer belt 71 has its friction coefficient of the surface or surface friction coefficient greater than that of the photoconductor 3.

The deteriorated toner includes toner particles charged to the plus polarity that is opposite to the given toner charge polarity and toner particles charged to the minus polarity that corresponds to the given toner charge polarity but with a significantly small amount of charge. Such toner particles with a low charge amount are likely not to be transferred from the photoconductor 3 to the sheet transfer belt 71 under a condition with the given toner charge polarity and the transfer bias for consuming toner particles charged to the given toner charge polarity. Even when the toner particles are oppositely charged or have the low charge amount, the deteriorated toner particles have low flowability as described above and can easily be adhered to another material. When such deteriorated toner particles are conveyed into two members then separated, the deteriorated toner particles may adhere to one of the two members having a greater surface friction coefficient than the other member. Therefore, the printer 2000 may include the sheet transfer belt 71 having a surface friction coefficient greater than that of the photoconductor 3, thereby easily transferring the deteriorated toner particles from the surface of the photoconductor 3 to the sheet transfer belt 71 at the transfer nip. Accordingly, even when the toner particles are oppositely charged or have the low charge amount, the deteriorated toner particles included in the forcible toner consumption image can be transferred to the sheet transfer belt 71, thereby enhancing collection efficiency of deteriorated toner particles.

In the present invention, the friction coefficients of the surfaces of the photoconductor 3 and of the sheet transfer belt 71 can be measured by an Euler belt method.

Figure 20:
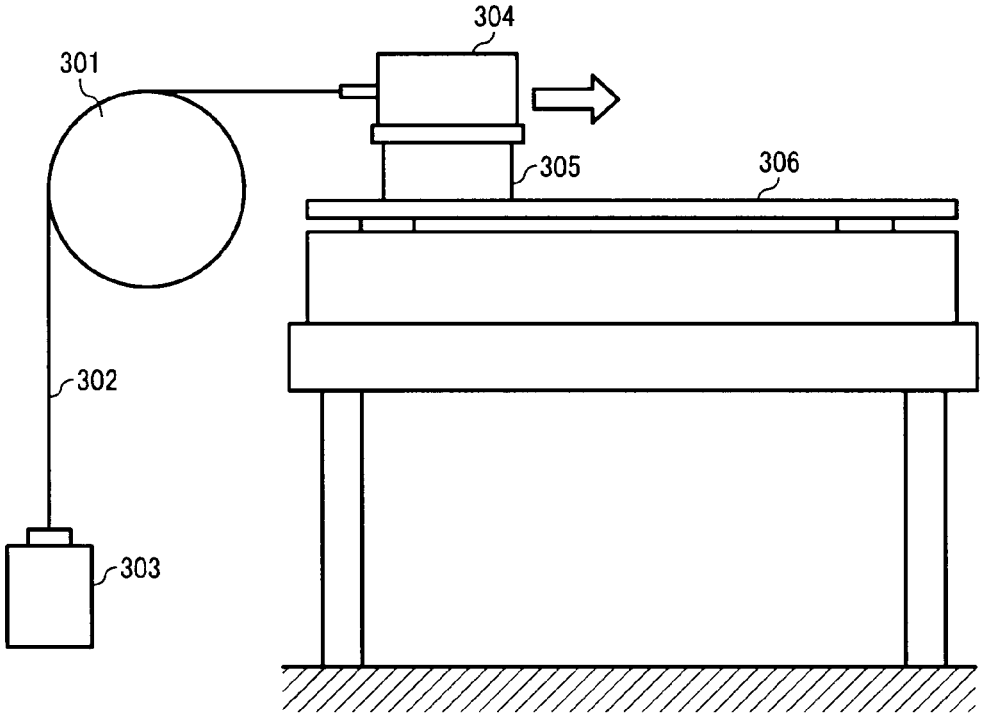
FIG. 20 is a schematic view illustrating a measuring instrument for measuring a friction coefficient of a surface of a target member by an Euler belt method.

FIG. 20 is a schematic view illustrating a measuring instrument in which the friction coefficient of the surface of a target member 301 (e.g. the photoconductor 3 or the sheet transfer belt 71) is measured by an Euler belt method.

In FIG. 20, reference numeral 302 denotes a paper sheet which has high quality (#6200 paper manufactured by Ricoh Co., Ltd.) and a dimension of 30 mm in width and 297 mm in length. Two hooks are set at each shorter edge of the paper sheet 302; a weight 303 (0.98N, i.e., 100 g) is set at one hook and a digital force gauge 304 is set at the other hook. As shown in FIG. 20, the digital force gauge 304 is mounted on a movable stage 305 that moves on a rail 306. A force "F" that moves the movable stage 305 along the rail 306 at or below 5 mm/sec. is provided and measured when the moving stage 305 starts to move. Accordingly, the friction coefficient "μ" of the surface of the target member 301, the photoconductor 3 in this case, is determined by the following equation:

$$\mu=(2/\pi)\times\mathrm{Log}(F/100\ g),$$

where "π" is pi (=3.14).

When the target member 301 corresponds to a belt such as the sheet transfer belt 71, the belt is fixed onto a circumferential surface of a drum-shaped, cylindrical member.

As described above, the printer 2000 uses the sheet transfer belt 71 having a structure to exert the surface friction coefficient greater than that of the photoconductor 3. However, it is not limited to but the present invention can be applied to a different structure of the sheet transfer belt 71. For example, application of lubricant to the surface of the sheet transfer belt 71 can increase the surface friction coefficient thereof more than that of the photoconductor 3 at least in the transfer nip.

When lubricant such as zinc stearate is applied by the drum cleaning unit 4 and the belt cleaning unit 75 to a surface of a target member, an amount of lubricant applied by the drum cleaning unit 4 may be greater than an amount of lubricant applied by the belt cleaning unit 75, thereby increasing the surface friction coefficient of the sheet transfer belt 71 than the surface friction coefficient of the photoconductor 3 in the transfer nip.

Further, the printer 2000 can include the drum cleaning unit 4 without a function for lubricant application and the belt cleaning unit 75 having a function for lubricant application. With this configuration of the printer 2000, an amount of applying lubricant can be controlled to increase the surface friction coefficient of the sheet transfer belt 71 to be greater than that of the photoconductor 3 in the transfer nip.

Further, the surface friction coefficient after the lubricant is applied to the sheet transfer belt 71 and the photoconductor 3 can be measured using the Euler belt method.

The inventors of the present invention conducted the following test.

The inventors prepared the drum cleaning unit 4 and the belt cleaning unit 75, each having a lubricant applying mechanism. The lubricant applying mechanism includes a brush roller and a spring.

The brush roller rotates while contacting both the block of zinc stearate, which serves as a lubricant, and a cleaning target member, which corresponds to the photoconductor 3 or the sheet transfer belt 71 in the test. The spring presses the block of zinc stearate to the brush roller. The brush roller contacts and scrapes the block of zinc stearate in a form of powder, and applies the powder lubricant to the cleaning target member.

The lubricant applying mechanism was disposed downstream from a position to contact the cleaning blade. By adjusting the density of bristles of the brush roller, the brush rigidity, the rotation speed of the brush roller, a pressure force exerted by the spring to the block of zinc stearate, and so forth, the amount of powder lubricant of zinc stearate applied by the drum cleaning unit 4 and the belt cleaning unit 75. Specifically, the surface friction coefficient of the photoconductor 3 after the powder lubricant of zinc stearate was applied was adjusted to a range of from approximately 0.1 to approximately 0.2, based on the Euler belt method. The surface friction coefficient of the sheet transfer belt 71 after the powder lubricant of zinc stearate was applied was adjusted to a range of from approximately 0.25 to approximately 0.35, based on the Euler belt method.

Under the above-described condition, the inventors conducted test printing to execute the forced toner consumption process at a given timing, and as a result, the deteriorated toner particles were effectively collected by the belt cleaning unit 75, when compared to a condition in which the surface friction coefficient of the photoconductor 3 is greater than that of the sheet transfer belt 71.

In the printer 2000 according to the second exemplary embodiment of the present invention, when the forcible toner consumption image moves to the transfer nip for an image transfer process with the movement of the surface of the photoconductor 3, it is controlled that a surface speed of the sheet transfer belt 71 in the transfer nip is greater than the surface speed of the photoconductor 3.

By providing a difference in a speed of the sheet transfer belt 71 and a speed of the photoconductor 3, a shear force may be exerted to toner layers of the forcible toner consumption image formed on the photoconductor 3. With the above-described action, the toner can easily move between the photoconductor 3 and the sheet transfer belt 71 by following the movement of the sheet transfer belt 71 that has a greater frictional resistance of the surface thereof. Accordingly, of the toner particles included in the forcible toner consumption image, the deteriorated toner particles having an adhesion force significantly higher than the other toner particles can easily move from the surface of the photoconductor 3 to the surface of the sheet transfer belt 71 mechanically.

Further, the surface speed of the sheet transfer belt 71 is greater than the surface speed of the photoconductor 3. Therefore, by extending the forcible toner consumption image in a direction of movement of the sheet transfer belt 71 when transferring the forcible toner consumption image onto the sheet transfer belt 71, the cohesion force of toner can be decreased. By so doing, the electrostatical transfer of the oppositely charged toner particles of the deteriorated toner may be encouraged. As a result, the transfer of the deteriorated toner from the surface of the photoconductor 3 to the surface of the sheet transfer belt 71 can be encouraged to surely select the deteriorated toner particles from the forcible toner consumption image.

The inventors also conducted the test with a testing machine. Through the test, the inventors found that, when the surface speed of the photoconductor 3 was set smaller by approximately 0.2% to approximately 2% than the surface speed of the sheet transfer belt 71, the deteriorated toner particles were well transferred to the sheet transfer belt 71. However, the difference between the linear speed of the photoconductor 3 and the linear speed of the sheet transfer belt 71 is not limited to the above-described range.

Conversely, when the surface speed of the photoconductor 3 was set greater than the surface speed of the sheet transfer belt 71, the toner layers of the forcible toner consumption image were reduced in a direction of movement of the surface of the sheet transfer belt 71 at the transfer nip. This reduction of the toner layers can increase the cohesion force of the toner particles in the toner layers, which can make the transfer of the deteriorated toner particles to the sheet transfer belt 71 to be difficult.

The printer 2000 is designed to apply a developing bias of approximately −600V to the developing sleeve 22 of the developing unit 7 so as to create an output toner image to be formed on the photoconductor 3 according to image data. Under the above-described condition, when the toner is transferred from the developing sleeve 22 onto the electrostatic latent image of the photoconductor 3 for development, an amount of toner adhesion or a development toner amount per unit area on the electrostatic latent image may be approximately 0.5 mg/cm$^2$. Then, three to five toner layers may be formed on the surface of the photoconductor 3.

Of these toner layers, a first layer thereof, which is formed closest to the surface of the photoconductor 3, may be least likely to be transferred among these toner layers. Therefore, when forming an output toner image, a small amount of the first toner layer can remain on the surface of the photoconductor 3. However, when forming the forcible toner consumption image, the deteriorated toner in the first toner layer remaining on the surface of the photoconductor 3 may be collected for recycling, which cannot prevent an increase of accumulation of the deteriorated toner in the developing unit 7.

Therefore, in the printer 2000, the development toner amount for developing the forcible toner consumption image may be smaller than the development toner amount for developing the output toner image based on image data. Specifically, when developing the forcible toner consumption image, the developing bias to be applied to the developing sleeve 22 may be changed from approximately −600V to approximately −300V, thereby reducing the development potential, and thereby reducing the development toner amount by half. In the above-described configuration, by reducing the number of toner layer of the forcible toner consumption image, the deteriorated toner particles in the first layer of the forcible toner consumption image may be encouraged to electrostatically transfer to the sheet transfer belt 71.

Further, it is controlled that the deteriorated toner particles in the first toner layer can easily contact the sheet transfer belt 71, thereby encouraging the deteriorated toner particles to transfer mechanically from the photoconductor 3 to the sheet transfer belt 71. As a result, the deteriorated toner particles can be well transferred to the sheet transfer belt 71.

Figure 21:
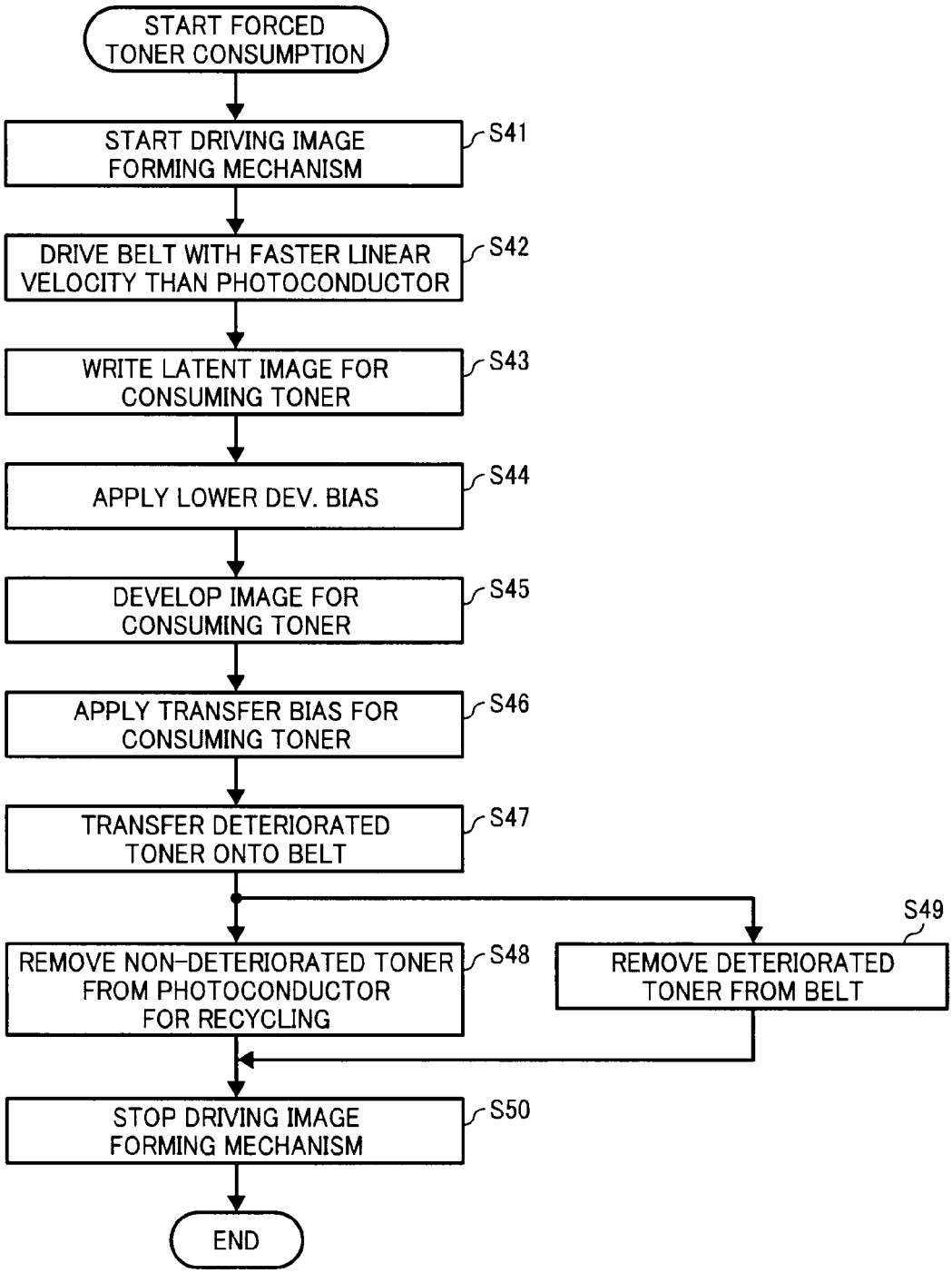
FIG. 21 is a flowchart of a forced toner consumption process executed by the controller of the image forming apparatus of FIG. 14.

FIG. 21 illustrates a flowchart of a control of a forced toner consumption process executed by the controller 200 of the printer 2000 according to the second exemplary embodiment of the present invention.

After the forced toner consumption process starts, the controller 200 that includes a part of the transfer unit starts driving an image forming mechanism including the photoconductor 3, the developing unit 7, the sheet transfer unit 70, and the like, in step S41. Then, the controller 200 causes the sheet transfer belt 71 to move with a linear velocity faster than that of the photoconductor 3, in step S42.

In step S43, while causing the charging unit 5 to uniformly charge the surface of the photoconductor 3 to the negative polarity, the controller 200 causes the optical writing unit 20 to form an electrostatic latent image of the forcible toner consumption image on the surface of the photoconductor 3. At this time, the electrostatic latent image corresponds to an output image area previously calculated in the forced toner consumption determination process.

Then, the controller 200 causes the developing bias power circuit 203 to apply the lower developing bias lower than the output toner image in step S44, causes the developing unit 7 to develop the electrostatic latent image into the forcible toner consumption image in step S45, causes the transfer bias power circuit 203 to apply the transfer bias for consuming toner in step S46, and causes the sheet transfer unit 70 to transfer the deteriorated toner included in the forcible toner consumption image formed on the surface of the photoconductor 3 onto the sheet transfer belt 71 in step S47.

After step S47, the controller 200 causes the drum cleaning unit 4 to remove the residual non-deteriorated toner from the surface of the photoconductor 3 to return the non-deteriorated toner to the developing unit 7 in step S48. At the same time, the controller 200 causes the belt cleaning unit 75 to remove the residual deteriorated toner from the surface of the sheet transfer belt 71 to collect and convey the deteriorated toner to the wasted toner bottle in step S49.

After step S49, the controller 200 stops the image forming mechanism in step S50, and complete the flow of the forced toner consumption process.

Next, a detailed description is given of a more characteristic configuration of the printer 2000 according to the second exemplary embodiment of the present invention.

The printer 2000 according to the second exemplary embodiment of the present invention covers the following examples, which are Examples 3 to 6. The printer 2000 corresponds to a tandem-type electrophotographic image forming apparatus that produces full-color images, and further includes a same basic configuration as the printer 1000 according to the first exemplary embodiment.

Figure 22:
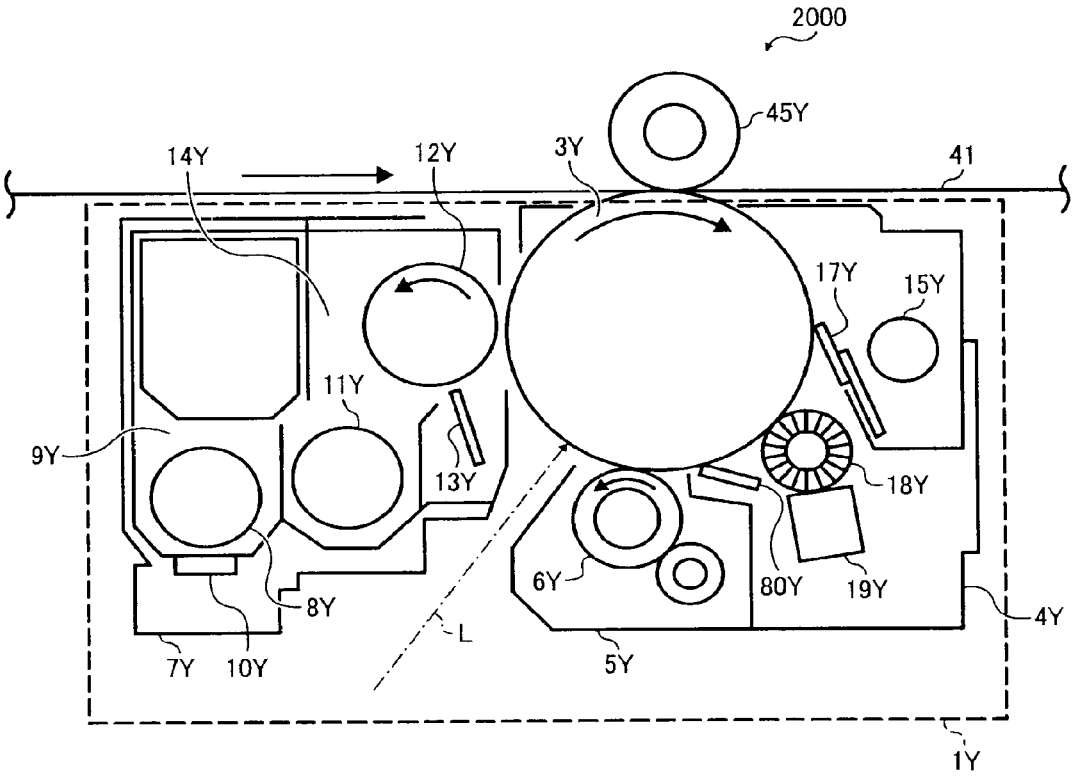
FIG. 22 is an enlarged view showing a schematic configuration of a process unit according to Examples of the second exemplary embodiment of the present invention.

Referring to FIG. 22, an enlarged schematic configuration of a process unit 1Y for yellow toner or Y-toner used in the following examples of the printer 2000. The internal configuration of the process unit 1Y is substantially similar to the process unit 1Y for Y-toner according to the first exemplary embodiment, even though the appearance of the process unit 1Y according to the second exemplary embodiment is slightly different from the process unit 1Y for Y-toner according to the first exemplary embodiment of FIG. 2.

A photoconductor 3Y, developing unit 7Y, charging unit 5Y of FIG. 22 correspond to the photoconductor 3Y, developing unit 7Y, charging unit 5Y of FIG. 2, respectively.

A drum cleaning unit 4Y includes a toner collecting screw 15Y, a cleaning blade 17Y, a rotary lubricant applying brush roller 18Y, and a lubricant 19Y including a block of zinc stearate.

The lubricant applying brush roller 18Y scrapes the lubricant 19Y in a form of powder at a position downstream from the cleaning blade 17Y in a direction of movement of the surface of the photoconductor 3Y, and applies the powder lubricant to the surface of the photoconductor 3Y.

A lubricant regulating blade 80Y is disposed downstream from the lubricant applying brush roller 18Y in the direction of movement of the surface of the photoconductor 3Y, and contacts the surface of the photoconductor 3Y to regulate the powder lubricant of zinc stearate into a uniform layer.

Figure 23:
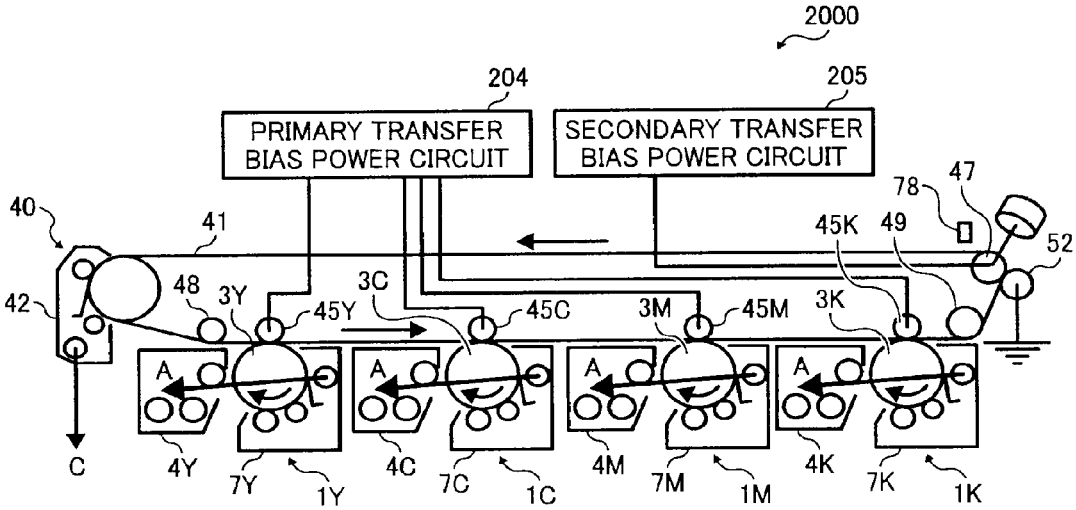
FIG. 23 is an enlarged schematic configuration of multiple process units and a transfer unit according to Examples of the second exemplary embodiment of the present invention.

Referring to FIG. 23, an enlarged schematic configuration of multiple process units 1Y, 1C, 1M, and 1K and a transfer unit 40 is depicted according to Examples 3 to 6 of the second exemplary embodiment of the present invention.

The transfer unit 40 according to the second exemplary embodiment of FIG. 23 includes common functions of the configuration with the transfer unit 40 according to the first exemplary embodiment of FIG. 1, except the following.

Instead of the secondary transfer roller 50 of the printer 1000 according to the first exemplary embodiment, the transfer unit 40 of the printer 2000 includes a secondary transfer nip forming roller 52 that contacts the surface of the intermediate transfer belt 41 to form a secondary transfer nip. The secondary transfer nip forming roller 52 is electrically grounded, as shown in FIG. 23.

Further, of the rollers extending the intermediate transfer belt 41 by supporting the inner surface thereof in the loop, a drive roller 47 is disposed in the vicinity of the secondary transfer nip to support or backup the intermediate transfer belt 41 from the inner surface thereof. That is, the secondary transfer nip forming roller 52 and the drive roller 47 are disposed facing each other and sandwiching the intermediate transfer belt 41.

The drive roller 47 also serves as a secondary transfer roller, so that the controller 200 may cause the secondary transfer bias power circuit 205 to apply a secondary transfer bias with the given toner charge polarity, which is the negative polarity in the second exemplary embodiment of the present invention. By applying the secondary transfer bias having the given toner charge polarity to the drive roller 47 disposed to the opposite side of the intermediate transfer belt 41, the toner image formed on the intermediate transfer belt 41 can be transferred from the surface of the intermediate transfer belt 41 to the secondary transfer nip forming roller 52. As describe above, the secondary transfer process is conducted.

Figure 24:
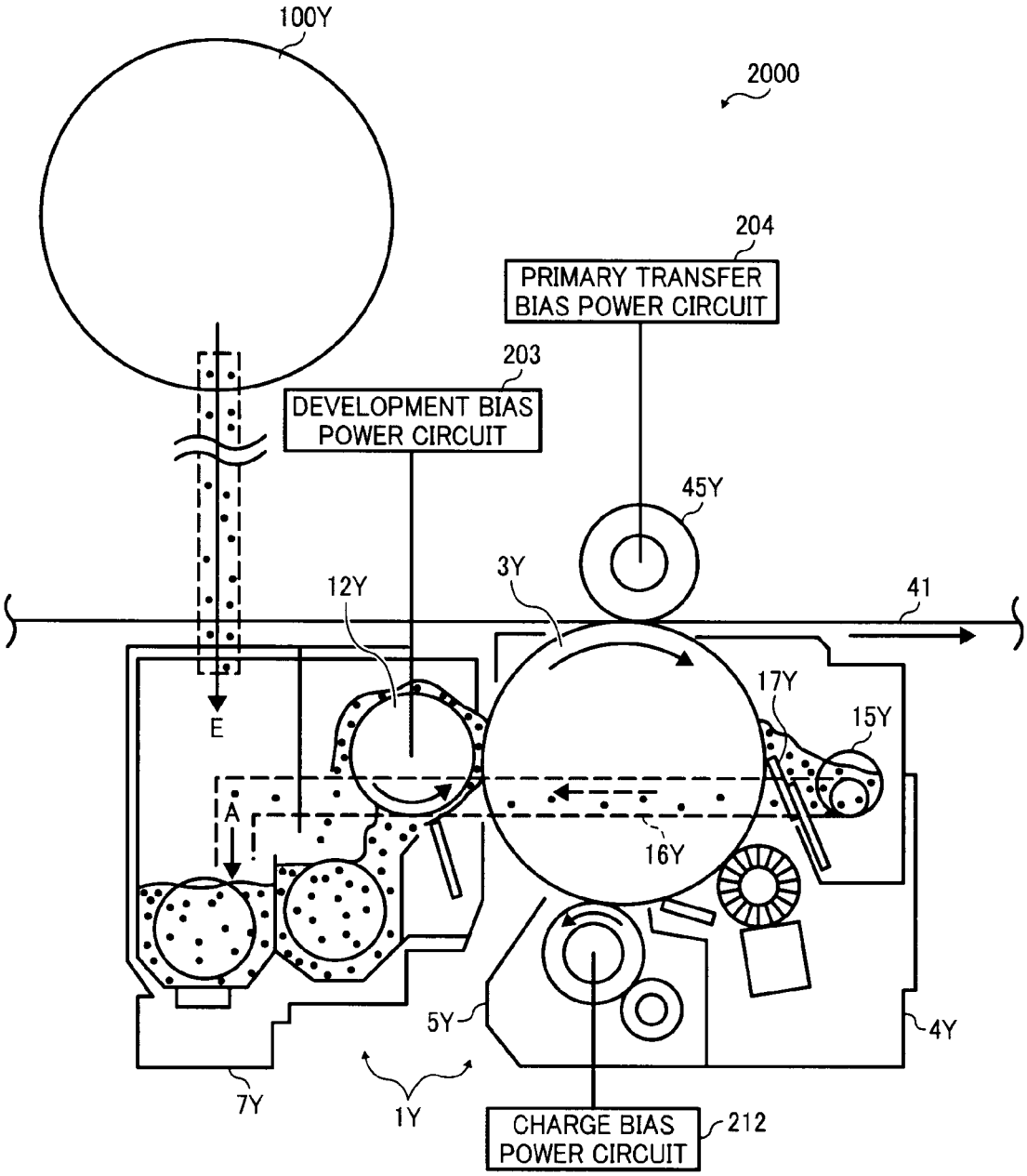
FIG. 24 is a schematic configuration for explaining a flow of yellow toner in the process unit and components around the process unit.

Referring to FIG. 24, a schematic diagram to explain the flow of Y-toner in the process unit 1Y and the peripherals is shown.

When the Y-toner concentration of the developer in the developing unit 7Y in FIG. 24 drops lower than the target value, a Y-toner supplying unit, not shown, supplies yellow toner accommodated in the toner cartridge 100Y to the developing unit 7Y, as indicated by arrow E in FIG. 24. The yellow toner supplied by the Y-toner supplying unit may be blended in the developer and circulate in the developing unit 7Y. Some yellow toner particles may be supplied to the electrostatic latent image on the photoconductor 3Y to form a yellow toner image. A great amount of yellow toner included in the yellow toner image may be transferred onto the surface of the intermediate transfer belt 41 at the primary transfer nip. A small amount of yellow toner remaining on the surface of the photoconductor 3 may be removed therefrom by the drum cleaning unit 4Y, and consequently, conveyed back to the developing unit 7Y by the toner recycling mechanism 16Y. As described above, the yellow toner remaining on the photoconductor 3Y can be recycled. Similarly, the process units 1C, 1M, and 1K for cyan toner (C-toner), magenta toner (M-toner), and black toner (K-toner) may conduct the above-described process for recycling the residual toners of these colors, as indicated by arrow A in FIG. 23.

After passing the secondary transfer nip in FIG. 23, the residual toner remaining on the surface of the intermediate transfer belt 41 may be removed from the surface thereof by the belt cleaning unit 42, and consequently, conveyed to the wasted toner bottle, as indicated by arrow C in FIG. 23.

Figure 25:
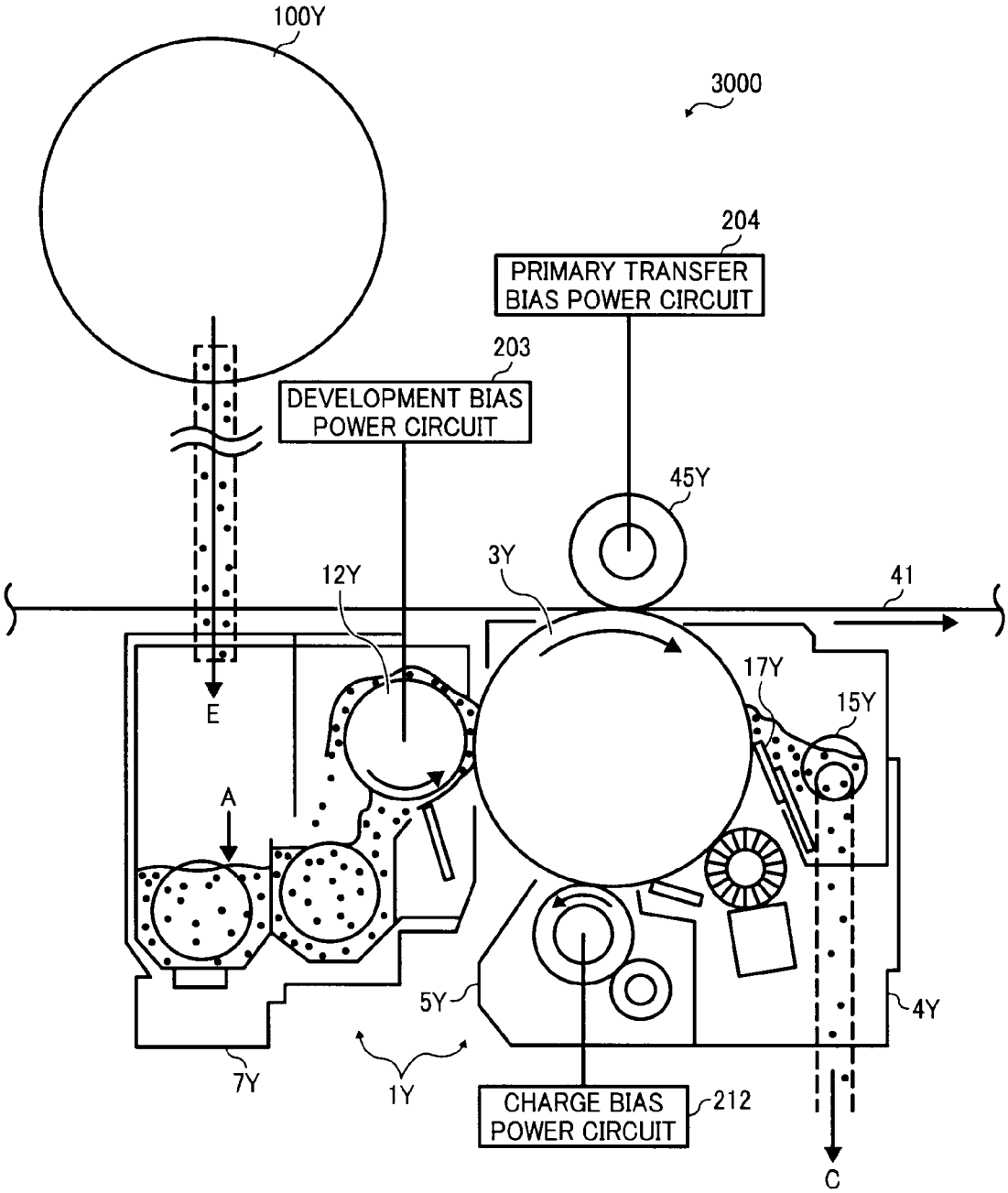
FIG. 25 is a block diagram explaining a circuit configuration of the controller of the image forming apparatus of FIG. 14.

Now, in order to further understand the configuration according to each example for recycling residual toner remaining on the photoconductors 1Y, 1C, 1M, and 1K, a description is given of a tandem-type electrophotographic image forming apparatus 3000 that does not include the toner recycling mechanism 16, in reference to FIG. 25.

FIG. 25 illustrates a schematic configuration for explaining a flow of yellow toner in a process unit 1Y for yellow toner and its peripherals of the tandem-type image forming apparatus 3000. Elements and members corresponding to those of the tandem-type image forming apparatus 3000 shown in FIG. 25 are denoted by the same reference numerals, and the descriptions thereof are omitted or summarized. Although not particularly described, configurations of the tandem-type image forming apparatus 3000 and operations that are not particularly described in the tandem-type image forming apparatus 3000 are the same as those of the process unit 1Y and the peripherals of the printer 2000 in reference to FIG. 24.

In FIG. 25, when the Y-toner concentration of the developer accommodated in the developing unit 7Y drops lower than a target value, a Y-toner supplying unit, not shown, supplies yellow toner accommodated in the Y-toner cartridge 100Y to the developing unit 7Y, as indicated by arrow E in FIG. 25. The yellow toner supplied by the Y-toner supplying unit may be blended in the developer and circulate in the developing unit 7Y. A small amount of yellow toner, which has not been transferred onto the intermediate transfer belt 41 at the primary transfer nip but remains on the surface of the photoconductor 3Y, may be removed therefrom by the drum cleaning unit 4Y, and consequently, conveyed to a wasted toner bottle, not shown, as indicated by arrow C in FIG. 25. The forcibly consumed yellow toner can include non-deteriorated Y-toner, which cannot be reused effectively.

Figure 26:
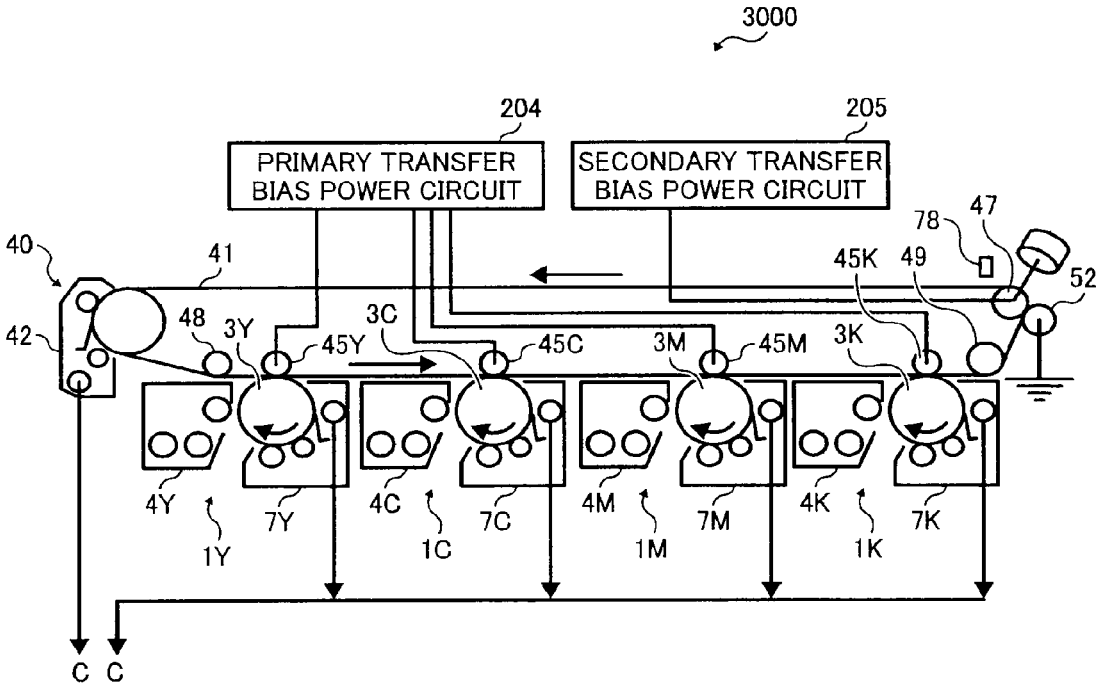
FIG. 26 is a schematic configuration for explaining a flow of yellow toner in the process unit and components around the process unit of a tandem-type image forming apparatus.

FIG. 26 illustrates a schematic configuration of the process units 1Y, 1C, 1M, and 1K and the transfer unit 40 of the tandem-type image forming apparatus 3000 without the toner recycling mechanism 16. Elements and members corresponding to those of the tandem-type image forming apparatus 3000 shown in FIG. 26 are denoted by the same reference numerals, and the descriptions thereof are omitted or summarized. Although not particularly described, configurations and operations of the process units 1Y, 1C, 1M, and 1K and the transfer unit 40 included in the tandem-type image forming apparatus 3000 are the same as those of the process units 1Y, 1C, 1M, and 1K and the transfer unit 40 of the printer 2000 in reference to FIG. 23.

As indicated by arrow C shown in FIG. 26, similar to residual Y-toner removed from the photoconductor 3Y, residual C-toner, M-toner, and K-toner removed from the photoconductors 3C, 3M, and 3K provided to the process units 1C, 1M, and 1K, respectively, are conveyed to the wasted toner bottle without being recycled or reused. If the image forming apparatus employing the above-described configuration forms the forcible toner consumption image, an amount of non-deteriorated toner may increase, which can result in a significant increase of running cost.

By contrast, the printer 2000 according to Examples 3-6 in reference to FIGS. 23 and 24 can selectively collect the deteriorated particles of Y-toner, C-toner, M-toner, and K-toner and conveys the deteriorated toner particles to the wasted toner bottle. At the same time, the printer 2000 can remove non-deteriorated particles of Y-toner, C-toner, M-toner, and K-toner included in the forcible toner consumption image, and returns to the developing units 7Y, 7C, 7M, and 7K, respectively, for recycling and reusing. Accordingly, the printer 2000 can prevent unnecessary removal or disposal of non-deteriorated toner and an increase of running cost.

Figure 27:
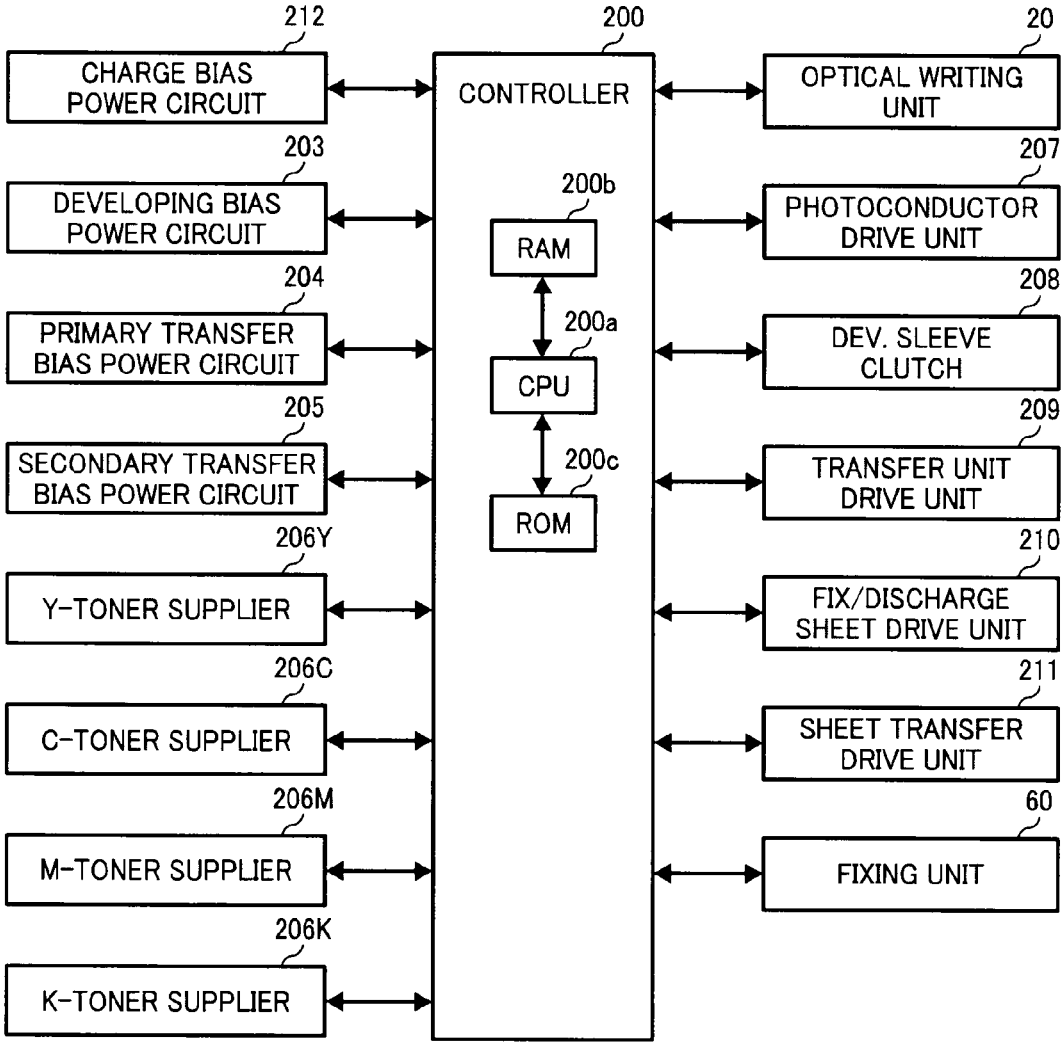
FIG. 27 is a schematic configuration of multiple process units and a transfer unit 40 of the image forming apparatus of FIG. 26.

Referring to FIG. 27, a block diagram of a main part of electrical circuits of the printer 2000 according to Examples 3-6 is illustrated.

In FIG. 27, the controller 200 includes a central processing unit or CPU 200*a* serving as a calculating unit, a random access memory or RAM 200*b* serving as an information storage unit, and a read-only memory or ROM 200*c* serving as an information storage unit. The controller 200 is connected to a developing bias power circuit 203, a primary transfer bias power circuit 204, a secondary transfer bias power circuit 205, a Y-toner supplier 206Y, a C-toner supplier 206C, a M-toner supplier 206M, and a K-toner supplier 206K. The controller 200 is further connected to an optical writing unit 20, a photoconductor drive unit 207, a developing sleeve clutch 208, a transfer unit drive unit 209, a fixing and discharge sheet drive unit 210, a sheet transfer drive unit 211, a charge bias power circuit 212, and a fixing unit 60.

EXAMPLE 3

The printer 2000 according to Example 3 executes the forced toner consumption process for each of the process units 1Y, 1C, 1M, and 1K when necessary, as shown in FIG. 23. Toner images formed on the photoconductors 3Y, 3C, 3M, and 3K of the process units 1Y, 1C, 1M, and 1K, respectively, are primarily transferred onto the intermediate transfer belt 41.

Of the process units 1Y, 1C, 1M, and 1K, the process unit 1Y for forming Y-toner image is disposed at the extreme upstream side in a direction of movement of the intermediate transfer belt 41, and therefore the toner image formed on the photoconductor 3Y may be a first image to be transferred onto the intermediate transfer belt 41 during a primary transfer process and the photoconductor 3Y may be a first image carrier to move to the primary transfer roller 45Y for the primary transfer process. In such configuration, the deteriorated Y-toner included in the forcible toner consumption image transferred from the photoconductor 3Y to the intermediate transfer belt 41 may be removed from the surface of the intermediate transfer belt 41 by the belt cleaning unit 42 after passing the primary transfer nips of the C-toner image, M-toner image, and K-toner image sequentially.

Prior to this removal, if the deteriorated Y-toner is transferred to the photoconductors 3C, 3M, and 3K at the primary transfer nips of the C-toner image, M-toner image, and K-toner image, the colors of different toners may be mixed in the drum cleaning units 4C, 4M, and 4K.

Further, the toner image formed on the photoconductor 3C may be a second image to be transferred onto the intermediate transfer belt 41 during the primary transfer process and the photoconductor 3C may be a second image carrier to move to the primary transfer roller 45C for the primary transfer process prior to the photoconductors 3M and 3K. In such configuration, the deteriorated C-toner included in the forcible toner consumption image transferred from the photoconductor 3C to the intermediate transfer belt 41 may be removed from the surface of the intermediate transfer belt 41 by the belt cleaning unit 42 after passing the primary transfer nips of the M-toner image and K-toner image sequentially.

Prior to this removal, if the deteriorated C-toner is transferred to the photoconductors 3M and 3K at the primary transfer nips of the M-toner image and K-toner image, the colors of different toners may be mixed in the drum cleaning units 4M and 4K.

Further, the toner image formed on the photoconductor 3M may be a third image to be transferred onto the intermediate transfer belt 41 during the primary transfer process and the photoconductor 3M may be a third image carrier to move to the primary transfer roller 45M for the primary transfer process prior to the photoconductor 3K. In such configuration, the deteriorated M-toner included in the forcible toner consumption image transferred from the photoconductor 3M to the intermediate transfer belt 41 may be removed from the surface of the intermediate transfer belt 41 by the belt cleaning unit 42 after passing the primary transfer nip of the K-toner image. However, prior to this removal, even if the deteriorated M-toner is transferred to the photoconductor 3K at the primary transfer nip of the K-toner image, an adverse affect may not be practically exerted to the color of K-toner, and therefore it is not likely to cause a color mixing problem.

However, such K-toner is conveyed from the drum cleaning unit 4K into the developing unit 7K, which can inhibit suppression of increase of the deteriorated K-toner in the developing unit 7K, i.e., can increase an amount of the deteriorated K-toner in the developing unit 7K.

Further, the toner image formed on the photoconductor 3K may be a last image to be transferred onto the intermediate transfer belt 41 during the primary transfer process and the photoconductor 3K may be a last image carrier to move to the primary transfer roller 45K for the primary transfer process. In such configuration, the deteriorated K-toner included in the forcible toner consumption image transferred from the photoconductor 3K to the intermediate transfer belt 41 may be removed from the surface of the intermediate transfer belt 41 by the belt cleaning unit 42 after the other deteriorated toners have passed their primary transfer nips, and therefore it is not likely that the deteriorated K-toner causes a color mixing problem.

When the deteriorated Y-toner included in the forcible toner consumption image transferred from the photoconductor 3Y onto the intermediate transfer belt 41 moves to the primary transfer nip for C-toner image, which is disposed downstream from the photoconductor 3Y with a movement of the surface of the intermediate transfer belt 41, the printer 2000 may conduct bias adjustment as described below.

A bias having the given toner charge polarity, which is a negative polarity in this exemplary embodiment, is applied to the primary transfer roller 45C to provide electrical charge with the negative polarity to the intermediate transfer belt 41. By charging the primary transfer roller 45C with the negative polarity, the deteriorated Y-toner that is charged with the polarity opposite to the given toner charge polarity on the intermediate transfer belt 41 may be attracted to the surface of the intermediate transfer belt 41 in the primary transfer nip for transferring C-toner image, so as to prevent the deteriorated Y-toner from being oppositely transferred to the photoconductor 3C. Accordingly, the above-described configuration can prevent Y-toner from being blended or mixed in the developing unit 7C for C-toner image.

Further, when the deteriorated Y-toner and the deteriorated C-toner that is included in the forcible toner consumption image transferred from the photoconductor 3C onto the intermediate transfer belt 41 move to the primary transfer nip for transferring M-toner image, which is disposed downstream from the photoconductors 3Y and 3C with a movement of the surface of the intermediate transfer belt 41, the printer 2000 may conduct the bias adjustment. Specifically, a bias having the negative polarity is applied to the primary transfer roller 45M to provide electrical charge with the negative polarity to the intermediate transfer belt 41. By charging the primary transfer roller 45M with the negative polarity, the deteriorated Y-toner and the deteriorated C-toner may be attracted to the surface of the intermediate transfer belt 41 in the primary transfer nip for transferring M-toner image, so as to prevent the deteriorated Y-toner and the deteriorated C-toner from being reversely transferred to the photoconductor 3M. Accordingly, the above-described configuration can prevent Y-toner and C-toner from being blended or mixed in the developing unit 7M for M-toner image.

Further, when the deteriorated Y-toner, the deteriorated C-toner, and the deteriorated M-toner that is included in the forcible toner consumption image transferred from the photoconductor 3M onto the intermediate transfer belt 41 move to the primary transfer nip for transferring K-toner image, which is disposed downstream from the photoconductors 3Y, 3C, and 3M with a movement of the surface of the intermediate transfer belt 41, the printer 2000 may conduct the bias adjustment. Specifically, a bias having the negative polarity is applied to the primary transfer roller 45K to provide electrical charge with the negative polarity to the intermediate transfer belt 41. By charging the primary transfer roller 45K with the negative polarity, the deteriorated Y-toner, the deteriorated C-toner, and the deteriorated M-toner may be attracted to the surface of the intermediate transfer belt 41 in the primary transfer nip for transferring K-toner image, so as to prevent the deteriorated Y-toner, the deteriorated C-toner, and the deteriorated M-toner from being reversely transferred to the photoconductor 3K.

Accordingly, the above-described configuration can prevent an increase of the deteriorated toner in the developing unit 7K that is caused by the transfer of the deteriorated K-toner into the developing unit 7K.

When the deteriorated toner that is transferred onto the intermediate transfer belt 41 at any upstream primary transfer nip or any primary transfer nip located further upstream from a target photoconductor 3 holding the deteriorated toner thereon moves to a downstream primary transfer nip or nips or a primary transfer nip or nips located further downstream from the target photoconductor 3 holding the deteriorated toner thereon, a bias that is applied to the primary transfer roller(s) 45 may have an absolute value smaller than that employed for a regular primary transfer operation. Specifically, the bias that is applied for the above-described operation is approximately −20 μA while a primary transfer bias that is applied for the regular primary transfer operation is approximately +30 μA. By so doing, as previously described in the general configuration according to the second exemplary embodiment, the above-described configuration can prevent from oppositely charging the deteriorated toner particles induced by the electrical discharge in the transfer nip.

Further, when the deteriorated toner that is transferred onto the intermediate transfer belt 41 at the upstream primary transfer nip(s) from the target photoconductor holding the deteriorated toner thereon moves to the downstream primary transfer nip(s) from the target photoconductor 3 holding the deteriorated toner thereon, the configuration can stop applying the bias to the primary transfer roller 45 or can apply a bias of 0V, instead of applying a bias having the given toner charge polarity. The deteriorated toner having higher mechanical adhesion can easily adhere to the intermediate transfer belt 41 having a higher surface friction coefficient than the photoconductor 3 even if the bias does not apply any electrostatic force thereto. Therefore, unless an electrostatic force in an opposite direction is exerted, the deteriorated toner may not be transferred onto the photoconductor 3 oppositely. In this case, the deteriorated toner may not be transferred when the application of zinc stearate in a powder form to the intermediate transfer belt 41 is temporarily stopped and when the surface friction coefficient of the intermediate transfer belt 41 is set to approximately 0.5 or a similar rather high value.

As previously described, a great amount of deteriorated toner particles transferred from the forcible toner consumption image formed on the photoconductor 3 onto the intermediate transfer belt 41 is charged with the polarity opposite to the given toner charge polarity or the positive polarity. By contrast, a background part or non-latent image part on the photoconductor 3 is uniformly charged with the given toner charge polarity. When the deteriorated toner that is transferred onto the intermediate transfer belt 41 at the upstream primary transfer nip(s) from the target photoconductor 3 holding the deteriorated toner thereon moves to the downstream primary transfer nip(s) from the target photoconductor 3 holding the deteriorated toner thereon with a movement of the surface of the intermediate transfer belt 41, if the potential on the background part of the downstream photoconductor is identical to the regular image forming operation, the deteriorated toner oppositely charged can easily be transferred electrostatically onto the background part.

Therefore, in the printer 2000, when the deteriorated toner that is transferred from the forcible toner consumption image formed on the surface of the photoconductor 3 onto the intermediate transfer belt 41 at the upstream primary transfer nip(s) from the target photoconductor 3 holding the deteriorated toner thereon moves to the downstream primary transfer nip(s) downstream from the target photoconductor 3 holding the deteriorated toner thereon, the printer 2000 may conduct the adjustment of the charge bias prior to the movement of the deteriorated toner. Specifically, the background potential of the photoconductor 3 at the downstream primary transfer nip from the photoconductor 3 is set lower than the background potential of the target photoconductor 3 that holds the output toner image formed according to image data. More specifically, the background potential of the photoconductor 3 at the downstream primary transfer nip from the target photoconductor 3 may be set to approximately −700V when forming an output toner image, while the background potential of the photoconductor 3 may be set to a range of from 0V to approximately −350V. Accordingly, the above-described configuration of the printer 2000 can prevent the deteriorated toner from transferring to the photoconductor 3 at the downstream primary transfer nip(s) from the target photoconductor 3.

Regarding the color mixing among different colors of the toners, Y-toner is most affected. Even if a small amount of different toner is mixed, Y-toner may significantly change its color tone. Therefore, in the printer 2000 according to Example 3 of the second exemplary embodiment, the photoconductor 3Y on which a Y-toner image is formed is disposed at the primary transfer nip located at an extreme upstream position, so that the toner image formed on the photoconductor 3Y can be transferred at an earliest timing among the photoconductors 3Y, 3C, 3M, and 3K. When transferring the Y-toner image from the photoconductor 3Y at the extreme upstream primary transfer nip, any different color toner image and deteriorated toner may not move thereto, and therefore any toner image having different color is not mixed or blended in the developing unit 7Y that accommodates Y-toner. Accordingly, the printer 2000 can prevent disturbance in color tone of the formed toner image due to color mixing.

Further, in the printer 2000 according to Example 3 of the second exemplary embodiment, the photoconductor 3K on which a K-toner image is formed is disposed at the primary transfer nip located at an extreme downstream position, so that the toner image formed on the photoconductor 3K can be transferred at a last timing among the photoconductors 3Y, 3C, 3M, and 3K. As previously described, even if any different color of toner is mixed on the K-toner image, it is not likely to cause an adverse affect to a color tone of K-toner. Accordingly, the printer 2000 can further prevent disturbance in color tone of the formed toner image due to color mixing.

As previously described, when a print job or image forming operation is interrupted or stopped due to occurrence of paper jams, for example, then is recovered from the interruption, the printer 2000 according to the second exemplary embodiment of the present invention causes the first bracket 43 to rotate in the counterclockwise direction in FIG. 1 so as to disconnect or separate the intermediate transfer belt 41 from the photoconductors 3Y, 3C, and 3M. While spacing apart the intermediate transfer belt 41 from the photoconductors 3Y, 3C, 3M, and 3K, the belt cleaning unit 42 may remove residual toner remaining on the surface of the intermediate transfer belt 41 therefrom.

When the image forming operation or print job is stopped abnormally, the deteriorated toner transferred from the forcible toner consumption image formed on the photoconductor 3 can adhere to the intermediate transfer belt 41. During a general recovery operation, the intermediate transfer belt 41 may be driven for a given period of time while not applying bias for a test drive. However, it is likely that the deteriorated toner is transferred back to the photoconductor 3 at the downstream primary transfer nip during the above-described operation. Therefore, when conducting the recovery operation, the intermediate transfer belt 41 is spaced apart from the photoconductors 3Y, 3C, and 3M.

By contrast, the photoconductor 3K can remain contact with the intermediate transfer belt 41 since the K-toner may not cause an adverse affect to the color mixing, as previously described. Accordingly, the above-described configuration can prevent occurrence of color mixing during the recovery operation.

As described above, the printer 2000 separates the intermediate transfer belt 41 from the photoconductors 3Y, 3C, and 3M when recovering from the paper jams, for example. However, when at least the photoconductors 3 other than the extreme upstream photoconductor 3 and the extreme downstream photoconductor 3 are separated from the intermediate transfer belt 41, the color mixing can be prevented.

Further, when a photoconductor 3 other than the photoconductor 3K is disposed at the extreme downstream side, it is preferable that the intermediate transfer belt 41 is separated from the extreme downstream photoconductor 3. By contrast, since the photoconductor disposed at the extreme upstream side may not cause the color mixing, the extreme upstream photoconductor can remain contact with the intermediate transfer belt 41.

EXAMPLE 4

The printer 2000 according to Example 4 includes a contact and separation unit for each photoconductor 3. That is, each of the photoconductors 3Y, 3C, 3M, and 3K is provided with a contact and separation unit that can contact and separate the intermediate transfer belt 41 with respect to the photoconductors 3Y, 3C, 3M, and 3K at the individual primary transfer nips. The deteriorated toner that is transferred from the forcible toner consumption image formed on the surface of the photoconductor 3 onto the intermediate transfer belt 41 at the upstream primary transfer nip or the primary transfer nip located further upstream from the target photoconductor 3 holding the deteriorated toner thereon moves to the downstream primary transfer nip or the primary transfer nip located further downstream from the target photoconductor 3 holding the deteriorated toner thereon with the movement of the surface of the intermediate transfer belt 41. Prior to the movement of the forcibly consumed toner, the individual contact and separation unit according to Example 4 of the second exemplary embodiment may separate the intermediate transfer belt 41 from the photoconductor 3 located at the primary transfer nip. Thus, the downstream primary transfer nip(s) may be separated effectively.

For example, when the deteriorated Y-toner is transferred onto the intermediate transfer belt 41 from the forcible toner consumption image formed on the photoconductor 3Y that is located at the extreme upstream position, the intermediate transfer belt 41 may be separated from the photoconductors 3C, 3M, and 3K, prior to the movement of the deteriorated Y-toner to the primary transfer nip for transferring the C-toner image.

When the deteriorated C-toner is transferred from the forcible toner consumption image formed on the photoconductor 3C onto the intermediate transfer belt 41, the intermediate transfer belt 41 may be separated from the photoconductors 3M and 3K, prior to the movement of the deteriorated C-toner to the primary transfer nip for transferring the M-toner image.

When the deteriorated M-toner is transferred onto the intermediate transfer belt 41 from the forcible toner consumption image formed on the photoconductor 3M, the intermediate transfer belt 41 may be separated from the photoconductor 3K, prior to the movement of the deteriorated M-toner to the primary transfer nip for transferring the K-toner image.

The forcible toner consumption images for Y-toner, C-toner, M-toner, and K-toner are not formed at the same timing, but at individual timings different from each other.

Accordingly, the above-described configuration can prevent that the deteriorated toner transferred onto the intermediate transfer belt 41 at the upstream primary transfer nip(s) transfers onto the photoconductor(s) 3 located downstream from the target photoconductor 3.

EXAMPLE 5

In the printer 2000 according to Example 5 of the second exemplary embodiment, the forcible toner consumption image is formed only on the photoconductor, so as to transfer the deteriorated K-toner included in the forcible toner consumption image onto the intermediate transfer belt 41. As previously described, the K-toner is most unlikely to cause a change of color tone in toner image due to color mixing. Therefore, when only the deteriorated K-toner is collected, the color tone in toner image may not change due to color mixing, and therefore an increase of amount of deteriorated K-toner in the developing unit 7K can be prevented.

EXAMPLE 6

In the printer 2000 according to Example 6 of the second exemplary embodiment, the forcible toner consumption images are formed only on the photoconductors 3Y and 3K, so as to transfer the deteriorated Y-toner and the deteriorated K-toner included in each forcible toner consumption image onto the intermediate transfer belt 41. By so doing, the color tone in toner image may not change due to color mixing caused by providing the deteriorated K-toner in the developing units 7Y, 7C, and 7M.

Further, the K-toner image is transferred at the extreme downstream primary transfer nip so that a change of the color tone in toner image can be prevented even if the deteriorated color toners are transferred back to any photoconductor 3 of the photoconductors 3Y, 3C, and 3M at the extreme downstream primary transfer nip.

Further, an increase of amount of the deteriorated toner in the developing unit 7Y disposed at the extreme upstream position can be reduced effectively. For example, the Y-toner image transferred onto the intermediate transfer belt 41 at the extreme upstream primary transfer nip may be formed firstly, and therefore the Y-toner image may be formed as the bottom layer. Therefore, the color tone of the Y-toner image cannot easily be recognized compared with the other color tones of the C-toner, M-toner, and K-toner images.

To make a toner image developed by an extreme upstream process unit 1 more recognizable on the intermediate transfer belt 41, the extreme upstream process unit 1 generally uses a greater amount of toner than the other process units 1. When the greater amount of toner is used, a greater amount of residual toner can remain on the corresponding photoconductor 3, which can result in a higher increase of deteriorated toner through recycling.

Therefore, the deteriorated Y-toner, for example, is transferred from the extreme upstream photoconductor 3Y onto the intermediate transfer belt 41 to collect the deteriorated Y-toner into the wasted toner bottle. By so doing, an increase of the deteriorated Y-toner in the developing unit 7Y can be reduced effectively, when compared to the collection of the deteriorated color toner from the other photoconductors 3C, 3M, and 3K.

The above-described image forming apparatus including the printers 1000 and 2000 employs two-component developer that includes toner and carrier. However, even when an image forming apparatus using a one-component developer system that includes non-magnetic toner or magnetic toner, the toner may deteriorate in the image forming apparatus. Accordingly, the present invention can be applied to the image forming apparatus using the one-component developer system.

Further, the above-described image forming apparatus including the printers 1000 and 2000 includes the sheet transfer belt system in which a toner image is transferred onto a recording medium directly or the intermediate transfer belt system in which a toner image is transferred onto an intermediate transfer belt before a recording medium. However, the present invention can be applied to an image forming apparatus including a mechanism that can transfer the deteriorated toner included in a forcible toner consumption image to a transfer unit. For example, the present invention can be applied to a monochrome image forming apparatus in which the deteriorated toner included in a forcible toner consumption image is transferred onto a transfer roller that contacts the photoconductor, and the deteriorated toner is removed from the transfer roller.

As described above, the printer 1000 according to Examples 1 and 2 of the first exemplary embodiment uses the transfer unit 40 that serves as a transfer unit in which a toner image formed on the photoconductor 3 according to image data is transferred onto the surface of the intermediate transfer belt 41 that serves as an endless moving member, and the toner image on the intermediate transfer belt 41 is further transferred onto the recording medium that is sandwiched at the secondary transfer nip that is formed between the intermediate transfer belt 41 and the secondary transfer roller 50 that serves as a contact member. Different from the image forming apparatus employing a direct transfer system in which the toner images formed on the photoconductors 3Y, 3C, 3M, and 3K are directly transferred and superimposed on the recording medium carried by a surface of a belt member, the above-described image forming apparatus employing the indirect transfer system may not need to convey the recording sheet S to respective contact positions between the photoconductors 3Y, 3C, 3M, and 3K and the intermediate transfer belt 41, as shown in FIG. 1. Accordingly, flexibility in designing a sheet transfer path of the recording sheet S in such image forming apparatus can be expanded and enhanced.

Further, the printer 1000 according to the first exemplary embodiment of the present invention includes the contact and separation unit 90 that can separate or contact the secondary transfer roller 50 that serves as a contact member with respect to the surface of the intermediate transfer member 41 that serves as an endless moving member. The printer 1000 further includes the controller 200 that serves as a control unit that can control to separate the secondary transfer roller 50 from the surface of the intermediate transfer belt 41 at the timing that the forcible toner consumption image on the intermediate transfer belt 41 passes the secondary transfer nip. With the above-described configuration, the printer 1000 can prevent the forcible toner consumption image from being transferred onto the secondary transfer roller 50, thereby avoiding background contamination on the recording sheet S.

Further, the printer 2000 according to the second exemplary embodiment of the present invention includes the secondary transfer bias power circuit 205 that serves as an electrical field generator to form an electrical field in the secondary transfer nip that corresponds to a transfer nip. The printer 2000 further includes a controller 200 that serves as a control unit to control to form the secondary transfer electrical field at a timing that a toner image formed according to image data and transferred onto the surface of the intermediate transfer belt 41 passes the secondary transfer nip, so that the toner can electrostatically move in a forward direction from the intermediate transfer belt 41 to the secondary transfer roller 50. At the same time, the controller 200 controls to form the opposite electrical field at a timing that a forcible toner consumption image formed on the photoconductor 3 and transferred onto the surface of the intermediate transfer belt 41 passes the secondary transfer nip, so that the toner can electrostatically move in an opposite direction, which is a direction opposite to the forward direction, from the secondary transfer roller 50 to the intermediate transfer belt 41.

With the above-described configuration, the printer 2000 can prevent an increase in an overall machine size due to installation of the contact and separation unit 90 to contact or separate the secondary transfer roller 50 with respect to the intermediate transfer belt 41, and at the same time, prevent the forcible toner consumption image from being transferred onto the secondary transfer roller 50, thereby avoiding background contamination on the recording sheet S.

Further, the printer 2000 according to the second exemplary embodiment of the present invention includes the sheet transfer unit 70 in which, when the given toner charge polarity is provided to the sheet transfer belt 71 that serves as a moving member, a charge amount may be set to be smaller than the polarity opposite to the given toner charge polarity is provided to the sheet transfer belt 71. With the above-described configuration, the printer 2000 can prevent erroneous recycling of the toner particles deteriorated due to consumption in the transfer nip and unnecessary removal or disposal of the non-deteriorated toner particles.

Further, in the printer 2000 according to the second exemplary embodiment of the present invention, the surface friction coefficient of the sheet transfer belt 71 is set greater than the surface friction coefficient of the photoconductor 3 at the transfer nip where the photoconductor 3 and the sheet transfer belt 71 contact each other. With the above-described configuration, the oppositely charged toner particles and the low charged toner particles of the deteriorated toner particles included in the forcible toner consumption image may be transferred to the sheet transfer belt 71, thereby enhancing efficiency in collection of the deteriorated toner.

Further, in the printer 2000 according to the second exemplary embodiment of the present invention, when the forcible toner consumption image moves to the transfer nip for the image transfer process with the movement of the surface of the photoconductor 3, it is controlled that the surface speed of the sheet transfer belt 71 in the transfer nip is greater than the surface speed of the photoconductor 3. With the above-described configuration, the toner may easily move from the surface of the photoconductor 3 to the sheet transfer belt 71 by following the movement of the sheet transfer belt 71, thereby surely selecting the deteriorated toner particles from the forcible toner consumption image.

Further, in the printer 2000 according to the second exemplary embodiment of the present invention, a ratio of the development toner amount per unit area to the photoconductor 3 for developing the forcible toner consumption image is set smaller than a ratio of the development toner amount per unit area to the photoconductor 3 for developing the output toner image based on image data. With the above-described configuration, the deteriorated toner particles included in the forcible toner consumption image formed on the photoconductor 3 is encouraged to electrostatically and mechanically transfer to the sheet transfer belt 71, thereby enhancing efficiency in collection of the deteriorated toner particles.

Further, the printer 2000 according to Example 3 of the second exemplary embodiment of the present invention includes the multiple process units 1Y, 1C, 1M, and 1K, each including the photoconductor 3 (i.e., the photoconductors 3Y, 3C, 3M, and 3K) and the developing unit 7 (i.e., the developing units 7Y, 7C, 7M, and 7K). The Y-toner image, C-toner image, M-toner image, and K-toner image are formed and developed on the photoconductors 3Y, 3C, 3M, and 3K, respectively, and are transferred onto the intermediate transfer belt 41 that serves as a moving member.

At the same time, the deteriorated Y-toner, C-toner, and M-toner included in the forcible toner consumption image are transferred from the photoconductors 3Y, 3C, and 3M, which are not the last photoconductor to receive the toner image onto the intermediate transfer belt 41. When the deteriorated toner moves to a position facing the downstream photoconductor(s) 3 or the downstream primary transfer nip(s) with the movement of the surface of the intermediate transfer belt 41, the printer 2000 may charge the bias having the given toner charge polarity to the intermediate transfer belt 41 at the position(s).

With the above-described configuration, the deteriorated toner on the intermediate transfer belt 41 may not be transferred to the photoconductor 3 at the downstream primary transfer nip(s), thereby preventing the deteriorated toner from being blended or mixed in the developing unit 7 to cause disturbance in color tone of the formed toner image due to color mixing.

Further, in the printer 2000 according to Example 3 of the second exemplary embodiment of the present invention, when the deteriorated toner that is transferred from the forcible toner consumption image formed on the surface of the photoconductor 3 onto the intermediate transfer belt 41 at the upstream primary transfer nip(s) from the target photoconductor 3 holding the deteriorated toner thereon moves to the downstream primary transfer nip(s) from the target photoconductor 3 holding the deteriorated toner thereon, the background potential that is a surface potential of the non-latent image of the photoconductor 3 at the primary transfer nip is set lower than the background potential of the photoconductor 3 that holds the toner image formed according to image data. With the above-described configuration, the transfer of the deteriorated toner to the photoconductor 3 at the downstream primary transfer nip(s) can be further surely prevented.

Further, the printer 2000 according to Example 4 of the second exemplary embodiment of the present invention includes the multiple process units 1Y, 1C, 1M, and 1K, each including the photoconductor 3 (i.e., the photoconductors 3Y, 3C, 3M, and 3K) and the developing unit 7 (i.e., the developing units 7Y, 7C, 7M, and 7K). The Y-toner image, C-toner image, M-toner image, and K-toner image are formed and developed on the photoconductors 3Y, 3C, 3M, and 3K, respectively, and are transferred onto the intermediate transfer belt 41 that serves as a moving member.

At the same time, the deteriorated Y-toner, C-toner, and M-toner included in the forcible toner consumption image are transferred onto the intermediate transfer belt 41 from the photoconductors 3Y, 3C, and 3M, which are not the last photoconductor 3. Prior to the movement of the deteriorated toner to the downstream transfer nip(s), the photoconductors 3C and 3M may be separated from the intermediate transfer belt 41 while the extreme upstream photoconductor 3Y and the extreme downstream photoconductor 3K may remain contact with the intermediate transfer belt 41. Accordingly, the above-described configuration can prevent that the deteriorated toner transferred onto the intermediate transfer belt 41 at the upstream primary transfer nip(s) transfers onto the photoconductor 3 located at the downstream primary transfer nip.

Further, in the printer 2000 according to Examples 3 and 6 of the second exemplary embodiment of the present invention, the forcible toner consumption image is formed on the photoconductor 3Y to which the transfer operation is conducted first, and transferred onto the intermediate transfer belt 41. With the above-described configuration, an increase of the deteriorated Y-toner in the developing unit 7Y can be reduced effectively, when compared to the collection of the deteriorated color toner from the other photoconductors 3C, 3M, and 3K.

Further, in the printer 2000 according to Example 3 of the second exemplary embodiment of the present invention, the photoconductor 3Y on which a Y-toner image is formed is disposed at the primary transfer nip located at an extreme upstream position, so that the toner image formed on the photoconductor 3Y is transferred at an earliest timing among the photoconductors 3Y, 3C, 3M, and 3K. With the above-described configuration, disturbance in color tone of the formed toner image due to color mixing to the Y-toner.

Further, in the printer 2000 according to Example 3 of the second exemplary embodiment of the present invention, the photoconductor 3K on which a K-toner image is formed is disposed at the primary transfer nip located at an extreme downstream position, so that the toner image formed on the photoconductor 3K is transferred at a last timing among the photoconductors 3Y, 3C, 3M, and 3K. With the above-described configuration, disturbance in color tone of the formed image can be prevented, when compared to a case that the photoconductor 3K is disposed at any other position.

Further, in the printer 2000 according to Example 5 of the second exemplary embodiment of the present invention, the forcible toner consumption image is formed only on the photoconductor 3K of the multiple photoconductors 3Y, 3C, 3M, and 3K, so as to transfer the deteriorated K-toner included in the forcible toner consumption image onto the intermediate transfer belt 41. With the above-described configuration, the color tone in toner image may not change due to color mixing of the deteriorated toner, and therefore an increase of amount of deteriorated K-toner in the developing unit 7K can be prevented.

Further, in the printer 2000 according to Example 6 of the second exemplary embodiment of the present invention, the photoconductor 3K for forming K-toner image is disposed at the extreme downstream position where the transfer operation of the multiple photoconductors 3Y, 3C, 3M, and 3K is conducted at the last timing. At the same time, the forcible toner consumption images are formed only on the photoconductor 3Y disposed at the extreme upstream position and the photoconductor 3K. Therefore, only the deteriorated Y-toner and the deteriorated K-toner included in each forcible toner consumption image may be transferred onto the intermediate transfer belt 41.

With the above-described configuration, the color tone in toner image may not change due to color mixing caused by providing the deteriorated K-toner in the developing units 7Y, 7C, and 7M. Further, the color tone in the toner image may not change if the deteriorated color toners transfer back to any one of the photoconductors 3Y, 3C, and 3M at the extreme downstream primary transfer nip. Further still, an increase of the deteriorated toner in the developing unit 7Y disposed at the extreme upstream position can be reduced effectively.

Further, in the printer 2000 according to Example 3 of the second exemplary embodiment of the present invention, when the image forming operation or print job is stopped abnormally, the recovery operation is conducted. While at least the photoconductors 3C and 3M, which are not the extreme upstream and/or extreme downstream photoconductors, are separated from the intermediate transfer belt 41 during the recovery operation, the belt cleaning unit 42 may remove residual toner remaining on the surface of the intermediate transfer belt 41 therefrom. Accordingly, the above-described configuration can prevent occurrence of color mixing of the deteriorated toners during the recovery operation.

The above-described example embodiments are illustrative, and numerous additional modifications and variations are possible in light of the above teachings. For example, elements and/or features of different illustrative and exemplary embodiments herein may be combined with each other and/or substituted for each other within the scope of this disclosure. It is therefore to be understood that, the disclosure of this patent specification may be practiced otherwise than as specifically described herein.

Obviously, numerous modifications and variations of the present invention are possible in light of the above teachings. It is therefore to be understood that, the invention may be practiced otherwise than as specifically described herein.

What is claimed is:

1. An image forming apparatus, comprising:

an image carrier configured to carry a latent image on a surface thereof;

an optical writing unit configured to optically write the latent image on the surface of the image carrier;

a developing unit configured to develop with toner the latent image into a toner image including an output image and a forcible toner consumption image;

a moving member including either a first moving member configured to receive the toner image from the image carrier and hold the toner image on a surface thereof or a second moving member configured to carry a recording medium on a surface thereof to receive the toner image from the image carrier on the surface thereof;

a transfer unit configured to transfer the toner image to the moving member while forming a given electrical field in a transfer nip formed between the image carrier and the moving member, the given electrical field comprising a first electrical field for providing an electrostatic force from the image carrier to the moving member with respect to the toner charged with a given polarity, negative or positive, when the output image based on the image data is transferred from the surface of the image carrier onto either the first moving member or the recording medium carried by the second moving member and a second electrical field between the image carrier and the moving member for providing an electrostatic force from the image carrier to the moving member with respect to the toner charged with a polarity opposite to the given polarity when the forced toner consumption image is transferred from the surface of the image carrier onto either the first moving member or the recording medium carried by the second moving member;

a remover configured to remove residual toner remaining on the surface of the image carrier after the toner image is transferred by the transfer unit, the remover removing the toner from the surface of the moving member after the moving member passes the transfer unit;

a toner recycling unit configured to convey the residual toner to the developing unit for recycling; and a controller configured to form the forcible toner consumption image on the image carrier at a given timing.

2. The image forming apparatus according to claim 1, wherein the transfer unit charges the moving member with the polarity opposite to the given polarity when the output image based on the image data is transferred from the surface of the image carrier onto either the first moving member or the recording medium carried by the second moving member, and charges the moving member with the given polarity when the forcible toner consumption image is transferred along with a movement of the surface of the image carrier.

3. The image forming apparatus according to claim 2, wherein the transfer unit applies a smaller amount of charge when charging the moving member with the given polarity than when charging the moving member with the polarity opposite to the given polarity.

4. The image forming apparatus according to claim 2, wherein the image carrier is constituted as multiple image carriers configured to carry respective latent images formed on surfaces thereof and the developing unit is constituted as multiple developing units configured to develop the latent images with respective colors of toner into toner images, the transfer unit sequentially transferring the toner images onto the moving member to form a composite color toner image, the transfer unit charging the moving member with the given polarity at respective positions facing the other downstream image carriers, and stopping charging when the moving member carrying the toner transferred from the forcible toner consumption image formed on an extreme upstream image carrier onto the moving member moves to the positions with a movement of the surface of the moving member.

5. The image forming apparatus according to claim 4, wherein, when the moving member carrying the toner transferred from the forcible toner consumption image onto the moving member moves to the positions facing the other downstream image carriers, a surface potential applied at the positions to a non-image forming part of the forcible toner consumption image on the extreme upstream image carrier is set lower than a surface potential applied at the positions to a non-image forming part of the output image on the image carrier.

6. The image forming apparatus according to claim 1, wherein a surface friction coefficient of the moving member is greater than a surface friction coefficient of the image carrier in the transfer nip where the image carrier and the moving member contact each other.

7. The image forming apparatus according to claim 6, wherein, when the forcible toner consumption image is transferred with the movement of the surface of image carrier, a surface speed of the moving member is greater than a surface speed of the image carrier.

8. The image forming apparatus according to claim 1, wherein a ratio of an amount of toner per unit area to the image carrier for developing the forcible toner consumption image is smaller than a ratio of an amount of toner unit area to the image carrier for developing the output image.

9. The image forming apparatus according to claim 1, wherein the image carrier is constituted as multiple image carriers configured to carry respective latent images formed on surfaces thereof and the developing unit is constituted as multiple developing units configured to develop the latent images with respective colors of toner into toner images, the transfer unit sequentially transferring the toner images onto the moving member to form a composite color toner image, the transfer unit separating the moving member from the multiple image carriers disposed downstream from an extreme upstream image carrier and moving the moving member carrying the toner transferred from the forcible toner consumption image formed on the extreme upstream image carrier to the moving member to positions to face the image carriers disposed downstream from the extreme upstream image carrier with a movement of the surface of the moving member.

10. The image forming apparatus according to claim 9, wherein the forcible toner consumption image is formed on the extreme upstream image carrier to transfer the toner included in the forcible toner consumption image onto the moving member.

11. The image forming apparatus according to claim 9, wherein, of the multiple image carriers, a yellow image carrier for forming a yellow toner image is disposed at an extreme upstream position to transfer the yellow toner image before other color toner images.

12. The image forming apparatus according to claim 11, wherein, of the multiple image carriers, a black image carrier for forming a black toner image is disposed at an extreme downstream position to transfer the black toner image last.

13. The image forming apparatus according to claim 9, wherein the forcible toner consumption image is formed only on a black image carrier of the multiple image carriers to transfer the toner included in the forcible toner consumption image formed on the black image carrier onto the moving member.

14. The image forming apparatus according to claim 9, wherein, of the multiple image carriers, a black image carrier for forming a black toner image is disposed at an extreme downstream position to transfer the black toner image last, the forcible toner consumption image being formed only on the black image carrier and on the extreme upstream image carrier each to transfer the toners included in the forcible toner consumption images formed on the black image carrier and the extreme upstream image carrier onto the moving member.

15. The image forming apparatus according to claim 9, wherein the remover removes the toner remaining on the moving member while the moving member is separated from the multiple image carriers other than the extreme upstream image carrier and an extreme downstream image carrier when an image forming operation is stopped abnormally and a recovery operation is conducted.

* * * * *